US009381419B2

(12) United States Patent
Adair et al.

(10) Patent No.: US 9,381,419 B2
(45) **Date of Patent: *Jul. 5, 2016**

(54) REPLACEABLE SECTIONS OF A PITCHING MOUND AND APPLICATIONS THEREOF

(71) Applicant: AdMark Athletic Ventures, Mesa, AZ (US)

(72) Inventors: Michael R. Adair, Woodruff, SC (US); Timothy W. Markison, Mesa, AZ (US)

(73) Assignee: Athalonz, LLC, Mesa, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/506,299

(22) Filed: Oct. 3, 2014

(65) Prior Publication Data

US 2015/0024878 A1 Jan. 22, 2015

Related U.S. Application Data

(63) Continuation of application No. 13/593,360, filed on Aug. 23, 2012, now Pat. No. 8,882,615.

(51) Int. Cl.

| | |
|---|---|
| ***A63B 71/00*** | (2006.01) |
| ***A63B 71/02*** | (2006.01) |
| ***A63B 69/00*** | (2006.01) |

(52) U.S. Cl.

CPC ..... *A63B 71/02* (2013.01); *A63B 69/0002* (2013.01); *A63B 71/00* (2013.01); *A63B 2069/0006* (2013.01); *A63B 2102/18* (2015.10); *A63B 2102/182* (2015.10); *A63B 2243/0004* (2013.01); *A63B 2243/0008* (2013.01)

(58) Field of Classification Search

CPC ..... A63B 69/0002; A63B 69/0013; A63B 2069/0006; A63B 2069/0002

USPC ..... 473/422, 451, 497, 452, 499

See application file for complete search history.

(56) References Cited

U.S. PATENT DOCUMENTS

| | | | | | |
|---|---|---|---|---|---|
| 4,749,223 | A * | 6/1988 | Goeders | A63B 69/0002 | 473/497 |
| 5,058,889 | A * | 10/1991 | Burton | A63B 69/0002 | 473/452 |
| 5,707,305 | A * | 1/1998 | Goeders | A63B 69/0002 | 473/497 |
| 7,344,459 | B2 * | 3/2008 | Bykowsky | A63B 69/0013 | 473/497 |
| 8,251,843 | B1 * | 8/2012 | Goeders | A63B 69/3661 | 473/497 |
| 8,882,615 | B2 * | 11/2014 | Adair | A63B 69/0002 | 473/497 |
| 2007/0111828 | A1 * | 5/2007 | Goeders | A63B 69/0002 | 473/497 |
| 2007/0298915 | A1 * | 12/2007 | Goeders | A63B 69/0002 | 473/497 |
| 2013/0196797 | A1 * | 8/2013 | Lee | A63B 71/02 | 473/497 |
| 2014/0057745 | A1 * | 2/2014 | Adair | A63B 69/0002 | 473/497 |

* cited by examiner

*Primary Examiner* — Mitra Aryanpour

(74) *Attorney, Agent, or Firm* — Garlick & Markison; Timothy W. Markison

(57) ABSTRACT

A pitching mound includes a level area, a sloped area, and surrounding areas. The level area includes a replaceable drive area. The sloped area has a slope from a first end of the sloped area that abuts to the level area to a second end of the sloped area. The sloped area includes a replaceable landing area. The surrounding areas encircle the level area and the sloped area.

7 Claims, 76 Drawing Sheets cross section of pitching mound 10 mound level area 12
cross sectional view cross sectional view top view cross section of pitching mound 10 sectional pitching mound 210 cross section of pitching mound sections, mounting platform, and the ground mound level area 212 sloped area fixed mound
fill section 252
72" length x 60" width x
3-6" deep sloped area base 250
72" length x 60" width x 9
to 13" hight at level area to
3 to 7" at other end $\Phi = 2 \cos^{-1} (d/r)$
$\Phi = 2 \cos^{-1} (1/9) = 167.2^{o}$
$c = 2 r \sin \Phi/2$
$c = 18 \sin (83.6) = 17.88$ ft
$17.88 - 5 = 12.88'$
$12.88/2 = 6.44' = 77.3''$ $\theta = \sin\text{-}1(5/9) = 33.75^{o}$
$c1 = 18 \sin (90\text{-}33.75) = 14.97'$
$14.97' - 5 = 9.97'$
$9.97/2 = 4.98' = 59.8''$ front section 216
rear view front section frame 260
top view front left mid section 218
right side view front left mid section 218
top view front left mid section 218
top view rear section 222
top view rear section 222
front view rear section 222
cross section side view rear right mid section 224
top view rear right mid section 224
side view rear right mid section 224
front view

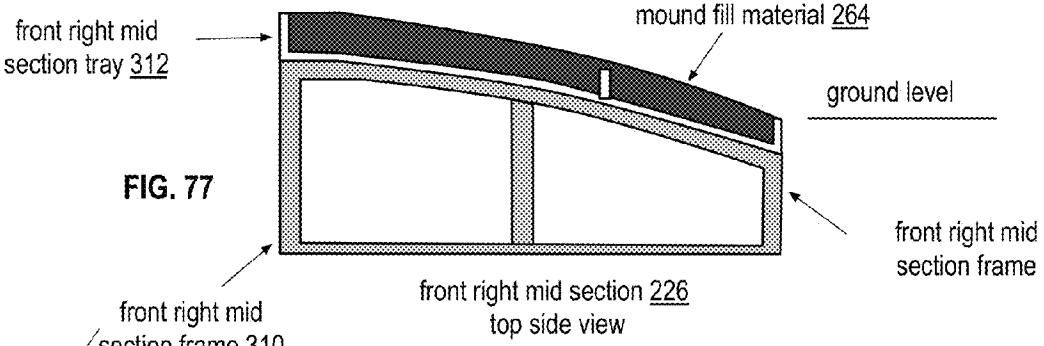
FIG. 77
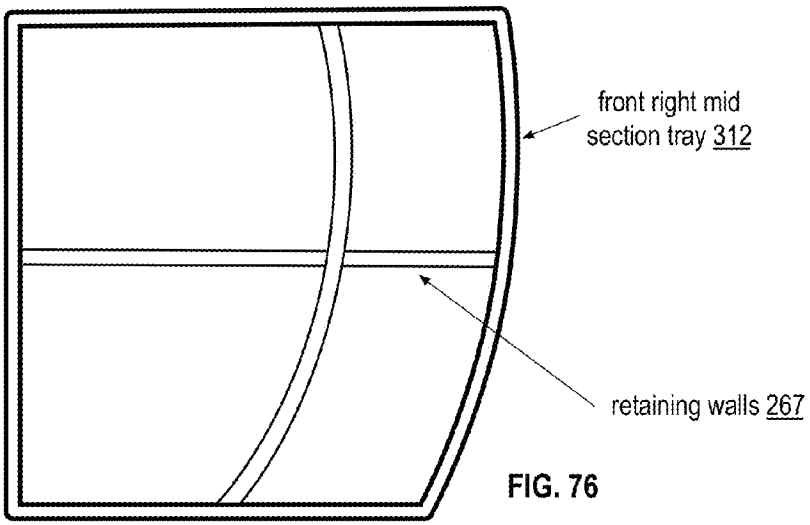
FIG. 76
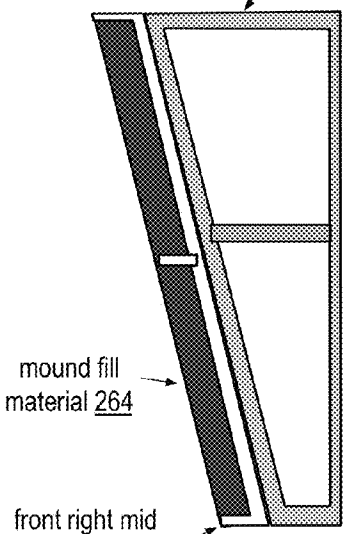
FIG. 78 front right mid section 226 side view cross section of bullpen mound 320, mounting platform, and the ground left section 324 upper side view left section 324 top view left section 324 inside side view left section 324 outside side view

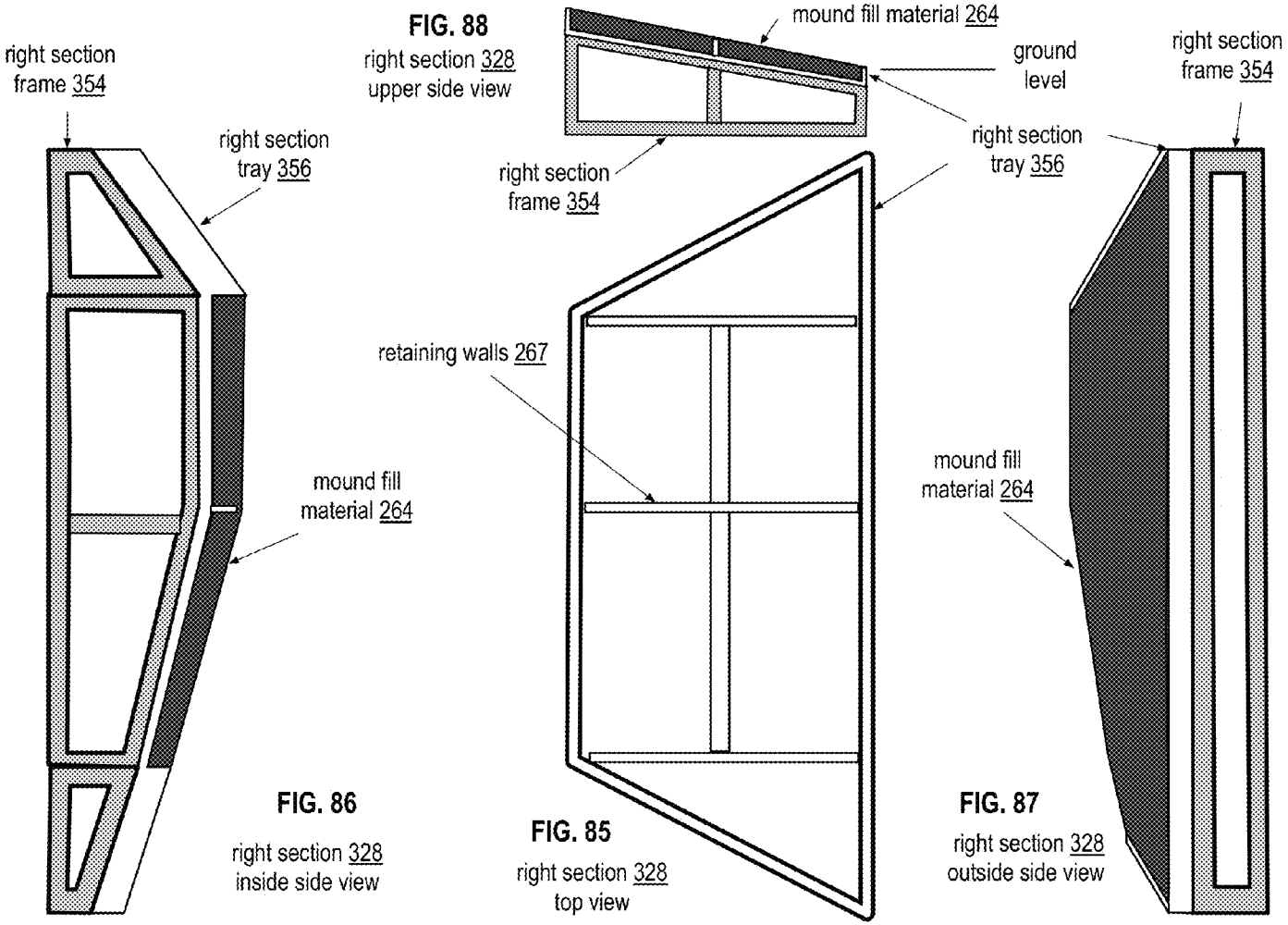
FIG. 87 right section 328 outside side view
FIG. 88 right section 328 upper side view
FIG. 85 right section 328 top view
FIG. 86 right section 328 inside side view rear section 326
rear view rear section 326
top view rear section 326
front view rear section 326
side view left front section tray 392 mound fill material 264
left front section 372 rear view
left front section frame 390 left front section 372 top view
left front section tray 392
retaining walls 267 left front section frame 390
mound fill material 264
left front section 372 front view
ground level
left front section tray 392
mound fill material 264
left front section frame 390 left front section 372 side view

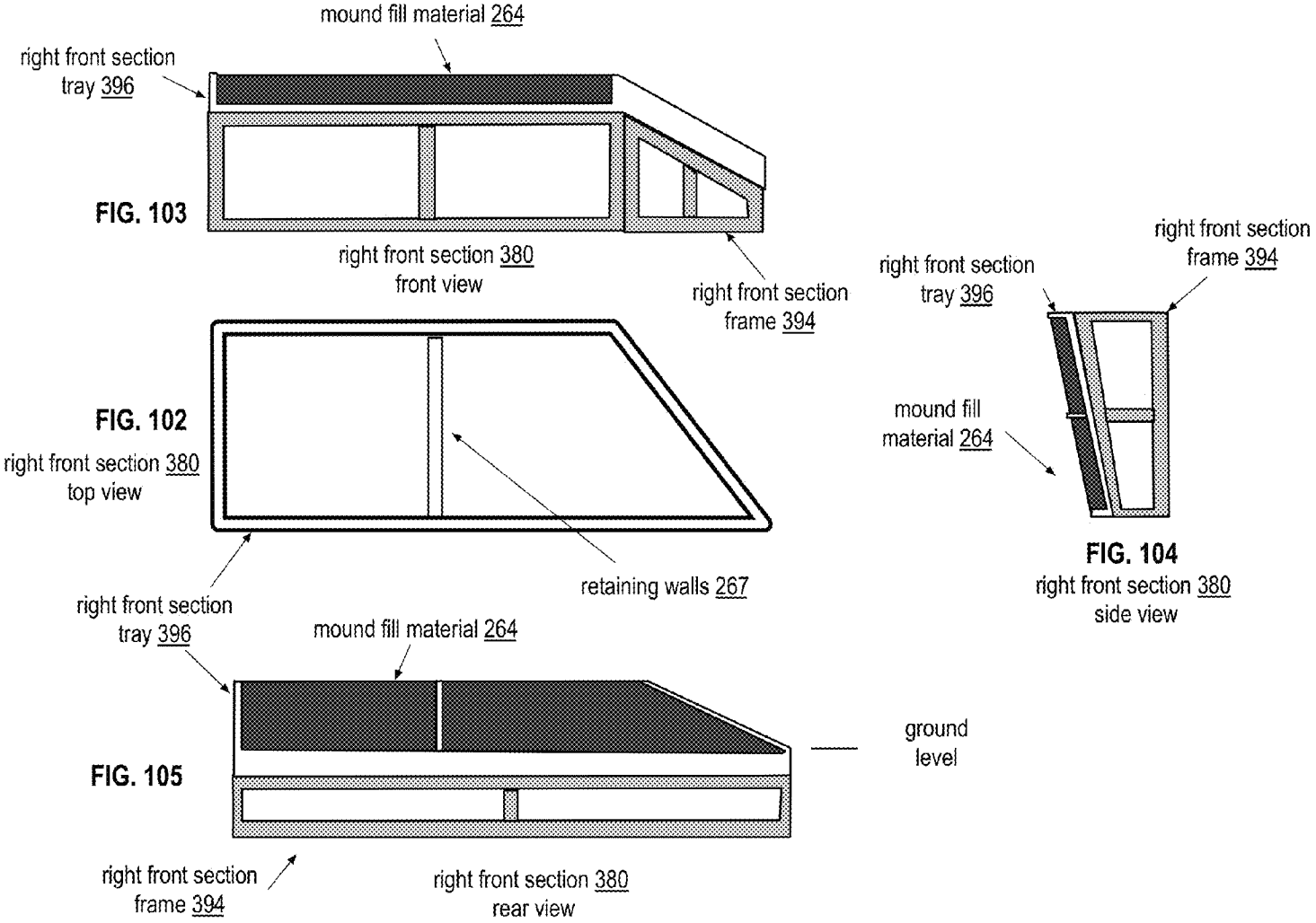
right front section frame 394
right front section tray 396
mound fill material 264
right front section 380 side view
FIG. 104
mound fill material 264
right front section tray 396
right front section 380 front view
right front section frame 394
FIG. 103
retaining walls 267
right front section tray 396
right front section 380 top view
FIG. 102
ground level
mound fill material 264
right front section 380 rear view
right front section frame 394
FIG. 105 left rear section 374
rear view left rear section 374
top view left rear section 374
front view left rear section 374
side view right rear section 378
rear view right rear section 378
top view right rear section 378
side view right rear section 378
front view inter-connecting section 384
top view inter-connecting section 384
side view intermediate rear section 376
side view intermediate rear section 376
top view intermediate front section 382
side view intermediate front section 382
top view cross section cross section cross section replaceable batter's box tray 432 cross section replaceable batter's box receptacle 430

REPLACEABLE SECTIONS OF A PITCHING MOUND AND APPLICATIONS THEREOF

CROSS REFERENCE TO RELATED PATENTS

The present U.S. Utility patent Application claims priority pursuant to 35 U.S.C. §120 as a continuation of U.S. Utility application Ser. No. 13/593,360, entitled "REPLACEABLE SECTIONS OF A PITCHING MOUND AND APPLICATIONS THEREOF," filed Aug. 23, 2012, which is hereby incorporated herein by reference in its entirety and made part of the present U.S. Utility patent Application for all purposes.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND OF THE INVENTION

1. Technical Field of the Invention

This invention relates generally to sporting equipment and more particularly to baseball equipment.

2. Description of Related Art

From Little League to the major leagues, baseball prescribes rules regarding the physical requirements of pitching mounds. For example, a major-league pitching mound is 18 feet in diameter with a maximum height of 10 inches. In addition, major league rules prescribed that the mound has a level area and a sloped area. While the rules prescribed the physical dimensions of a pitching mound, from field to field, from bullpen to field, the implementation of a pitching mound varies. For instance, the height of the mound will vary, the prescribed slope will vary, etc.

In addition to varying implementations of a mound, during a game, the mound experiences degradation. For instance, the area immediately adjacent to the pitching rubber (where the pitcher drives) wears down creating holes. In addition, where the pitcher lands on the slope area creates holes. The holes in the drive area and/or in the sloped area caused the pitcher to make adjustments throughout a game.

In multiple use stadiums (e.g., for baseball and football), the pitching mound may be placed on a metal platform such that it is portable. When the stadium is used for baseball, the "portable" pitching mound is placed it is appropriate position on the field. When the stadium is used for football, the "portable" pitching mound is removed from the field.

In addition to the mound degrading during the course of a game, the batter's box undergoes a similar degradation. For instance, many batters like to "dig-in" by using their spikes to create holes for their feet. In addition, many batters like to obscure the batter's box lines to make it difficult to determine whether the batter is within the prescribed area for the batter's box.

BRIEF DESCRIPTION OF THE SEVERAL VIEWS OF THE DRAWING(S)

FIG. 76 is a top view diagram of an embodiment of a front right mid section of a sectional pitching mound in accordance with the present invention;

FIG. 77 is a cross sectional top side view diagram of an embodiment of a front right mid section of a sectional pitching mound in accordance with the present invention;

FIG. 78 is a cross sectional front view diagram of an embodiment of a front right mid section of a sectional pitching mound in accordance with the present invention;

FIG. 85 is a top view diagram of an embodiment of a right section of a sectional bullpen mound in accordance with the present invention;

FIG. 86 is a cross sectional inside view diagram of an embodiment of a right section of a sectional bullpen mound in accordance with the present invention;

FIG. 87 is an outside view diagram of an embodiment of a right section of a sectional bullpen mound in accordance with the present invention;

FIG. 88 is a cross sectional top side view diagram of an embodiment of a right section of a sectional bullpen mound in accordance with the present invention;

FIG. 102 is a top view diagram of an embodiment of a right front section of sectional multiple bullpen mounds in accordance with the present invention;

FIG. 103 is a front view diagram of an embodiment of a right front section of sectional multiple bullpen mounds in accordance with the present invention;

FIG. 104 is a side view diagram of an embodiment of a right front section of sectional multiple bullpen mounds in accordance with the present invention;

FIG. 105 is a rear view diagram of an embodiment of a right front section of sectional multiple bullpen mounds in accordance with the present invention;

DETAILED DESCRIPTION OF THE INVENTION

Figure 1:
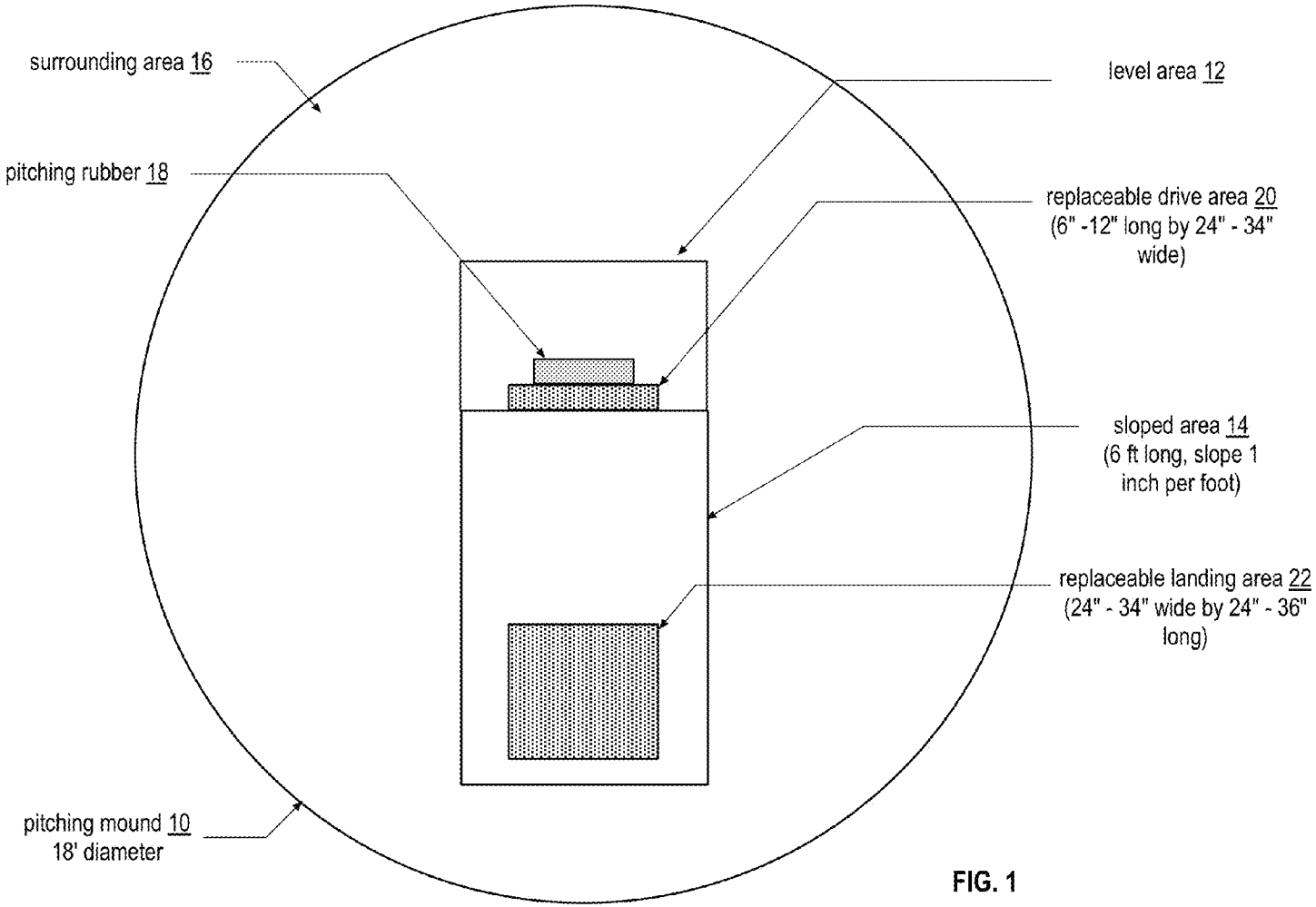
FIG. 1 is a top view diagram of an embodiment of a pitching mound in accordance with the present invention.

FIG. 1 is a top view diagram of an embodiment of a pitching mound 10 that includes a level area 12, a sloped area 14, a surrounding area 16, a pitching rubber 18, a replaceable drive area 20, and a replaceable landing area 22. The pitching mound 10 is positioned on a baseball field and has dimensions per baseball rules. For example, the major league baseball (MLB) rules provide that the pitching mound has a diameter of 18 feet. In addition, the rules prescribe that the mound 10 has a level area 12 (e.g., 34 inches in length by 60 inches in width) and a sloped area 14 (e.g., 6 feet long, 60 inches wide, and a slope of 1 inch per 1 foot). The surrounding areas have no specific rules as to their slope.

The level area 12 includes a pitching rubber 18 and a replaceable drive area 20. The replaceable drive area 20 may reside in front of the pitching rubber 18 or it may include the pitching rubber 18. In general, the replaceable drive area 20 includes a replaceable drive tray and a drive area receptacle. The drive area receptacle is embedded or fixed within the level area 12 of the pitching mound and is of a size to securely receive the replaceable drive tray. In this manner, the replaceable drive tray can be readily replaced during a game as needed. Note that the replaceable drive area 20 may be 6 to 12 inches long by 24 to 34 inches wide.

The sloped area 14 includes a replaceable landing area 22. The replaceable landing area 22 is positioned within the sloped area 14 to accommodate the landing foot of most pitchers. In general, the replaceable landing area 22 includes a replaceable tray and a landing area receptacle. The landing area receptacle is embedded or fixed within the sloped area 14 of the pitching mound and is of a size to securely receive the replaceable landing tray. In this manner, the replaceable landing tray can be readily replaced during a game as needed. Note that the replaceable landing area 20 maybe 24 to 36 inches long by 24 to 34 inches wide.

The surrounding area 16 may be fabricated using one or more pieces. For example, the surrounding area 16 may include one piece that encircles the level area 12 and the sloped area 14. In another example, the surrounding area 16 includes a plurality of sections that collectively encircle the level area 12 and the sloped area 14.

Figure 2:
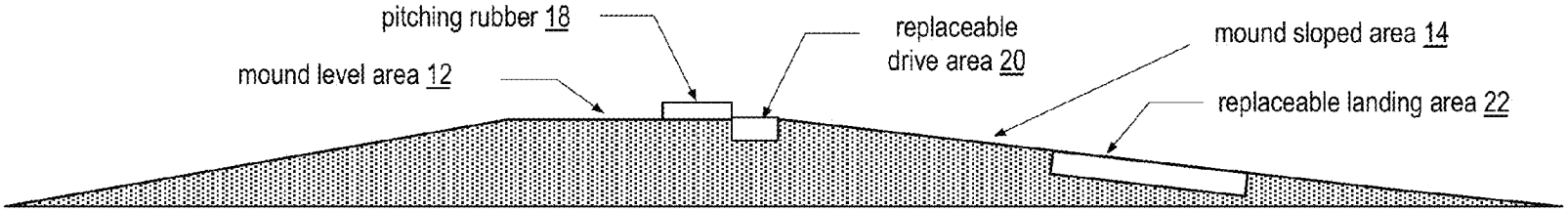
FIG. 2 is a side view diagram of an embodiment of a pitching mound in accordance with the present invention.

FIG. 2 is a side view diagram of an embodiment of a pitching mound 10 that includes a level area 12, a sloped area 14, a surrounding area 16, a pitching rubber 18, a replaceable drive area 20, and a replaceable landing area 22. If the mound 10 is fabricated in accordance with the MLB rules, the height of the level area is limited to 10 inches.

Figure 3:
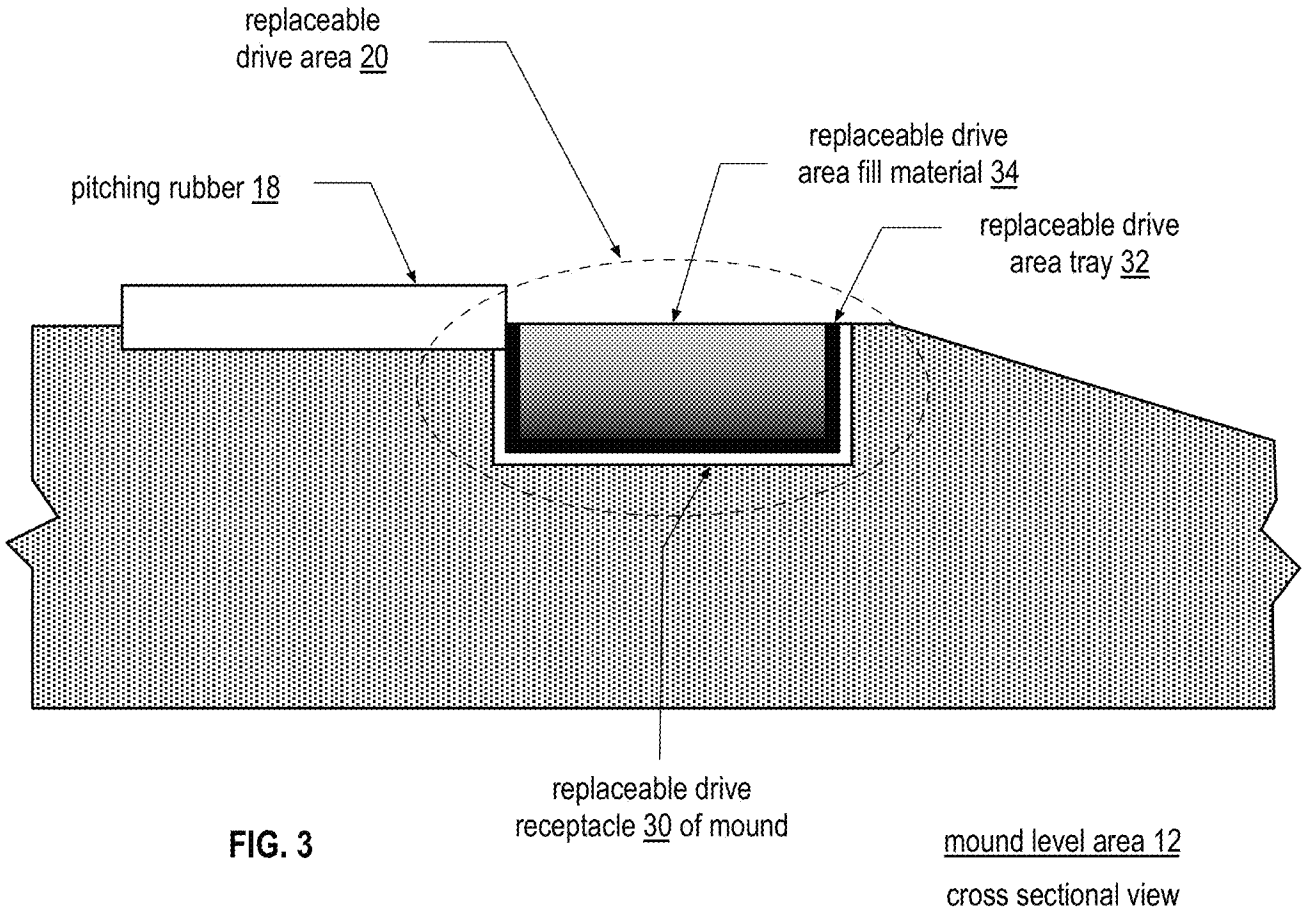
FIG. 3 is a cross sectional side view diagram of an embodiment of the level area of a pitching mound in accordance with the present invention.

FIG. 3 is a cross sectional side view diagram of an embodiment of the level area 12 that includes the pitching rubber 18 and the replaceable drive area 20. The replaceable drive area 20 includes a replaceable drive area tray 32 and a replaceable drive receptacle 30. The replaceable drive area tray 32 is filled with a replaceable drive area fill material 34, which may be dirt, clay, a quick dry material, sand, a composite material, rubber composite, and/or a combination thereof.

In this embodiment, the replaceable drive area tray 32 and the replaceable drive receptacle 30 have a rectangular cross sectional shape. The inner dimensions of the replaceable drive receptacle 30 are of sufficient size to receive the replaceable drive area tray 32 and, via a pressure fit, securely hold the replaceable drive area tray 32 in place. The replaceable drive receptacle 30 may include guides, ridges, and/or other aligning mechanisms to align with corresponding guides, ridges, and/or aligning mechanisms of the replaceable drive area tray 32. Note that the replaceable drive area tray 32 may have a depth of 3 to 6 inches. Further note that, as an alternative to a pressure fit, the receptacle drive area 20 may include a securing mechanism as will be described with reference to one or more subsequent figures.

Figure 4:
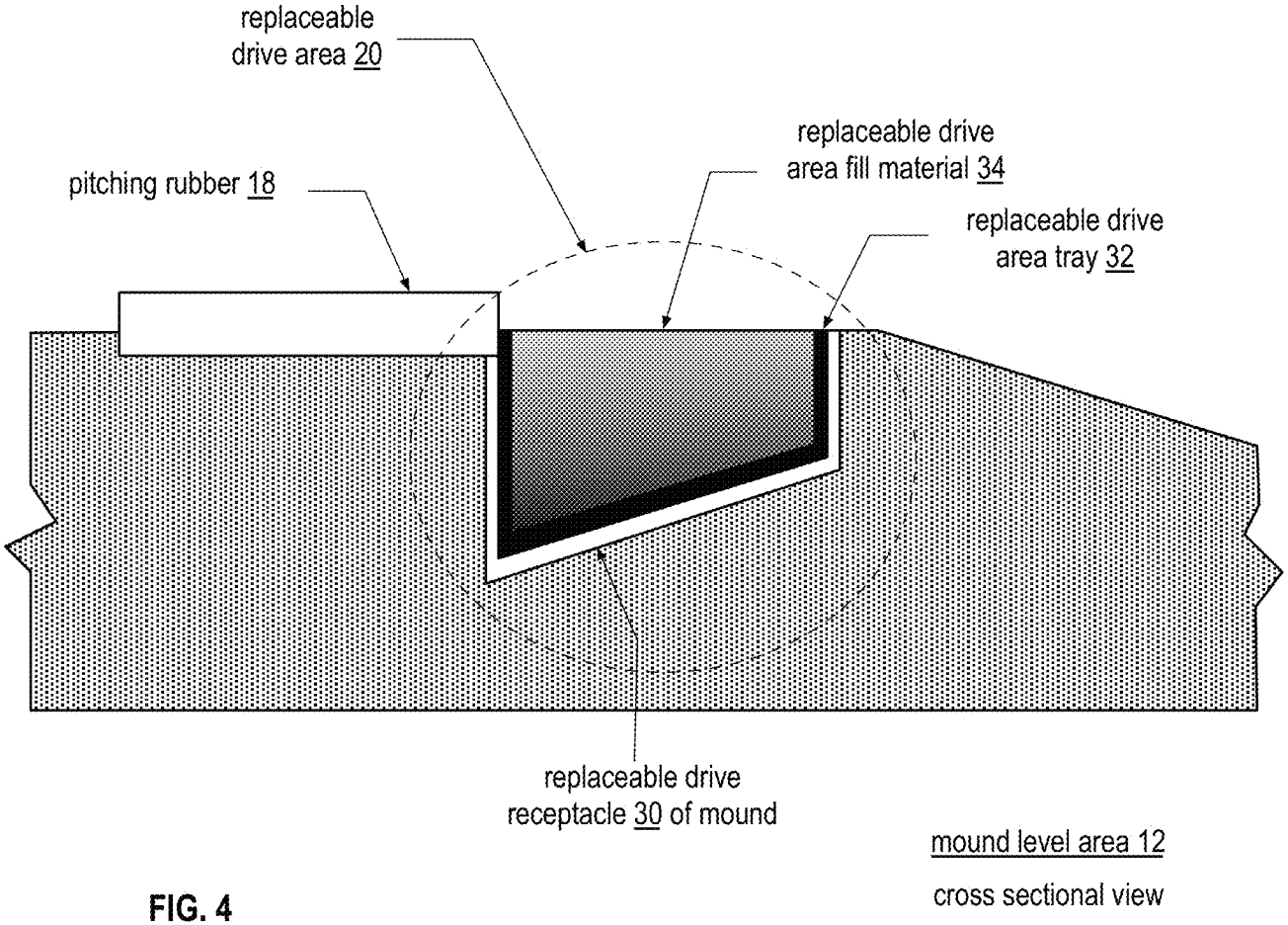
FIG. 4 is a cross sectional side view diagram of another embodiment of the level area of a pitching mound in accordance with the present invention.

FIG. 4 is a cross sectional side view diagram of another embodiment of the level area 12 that includes the pitching rubber 18 and the replaceable drive area 20. The replaceable drive area 20 includes a replaceable drive area tray 32 and a replaceable drive receptacle 30. The replaceable drive area tray 32 is filled with a replaceable drive area fill material 34.

In this embodiment, the replaceable drive area tray 32 and the replaceable drive receptacle 30 have an imbalanced rectangular cross sectional shape, where one side is longer than the other. The inner dimensions of the replaceable drive receptacle 30 are of sufficient size to receive the replaceable drive area tray 32 and, via a pressure fit, securely hold the replaceable drive area tray 32 in place. The replaceable drive receptacle 30 may include guides, ridges, and/or other aligning mechanisms to align with corresponding guides, ridges, and/or aligning mechanisms of the replaceable drive area tray 32. Note that the replaceable drive area tray 32 may have a depth of 3 to 6 inches at the front end and 6-9 inches at the back end. Further note that, as an alternative to a pressure fit, the receptacle drive area 20 may include a securing mechanism as will be described with reference to one or more subsequent figures.

Figure 5:
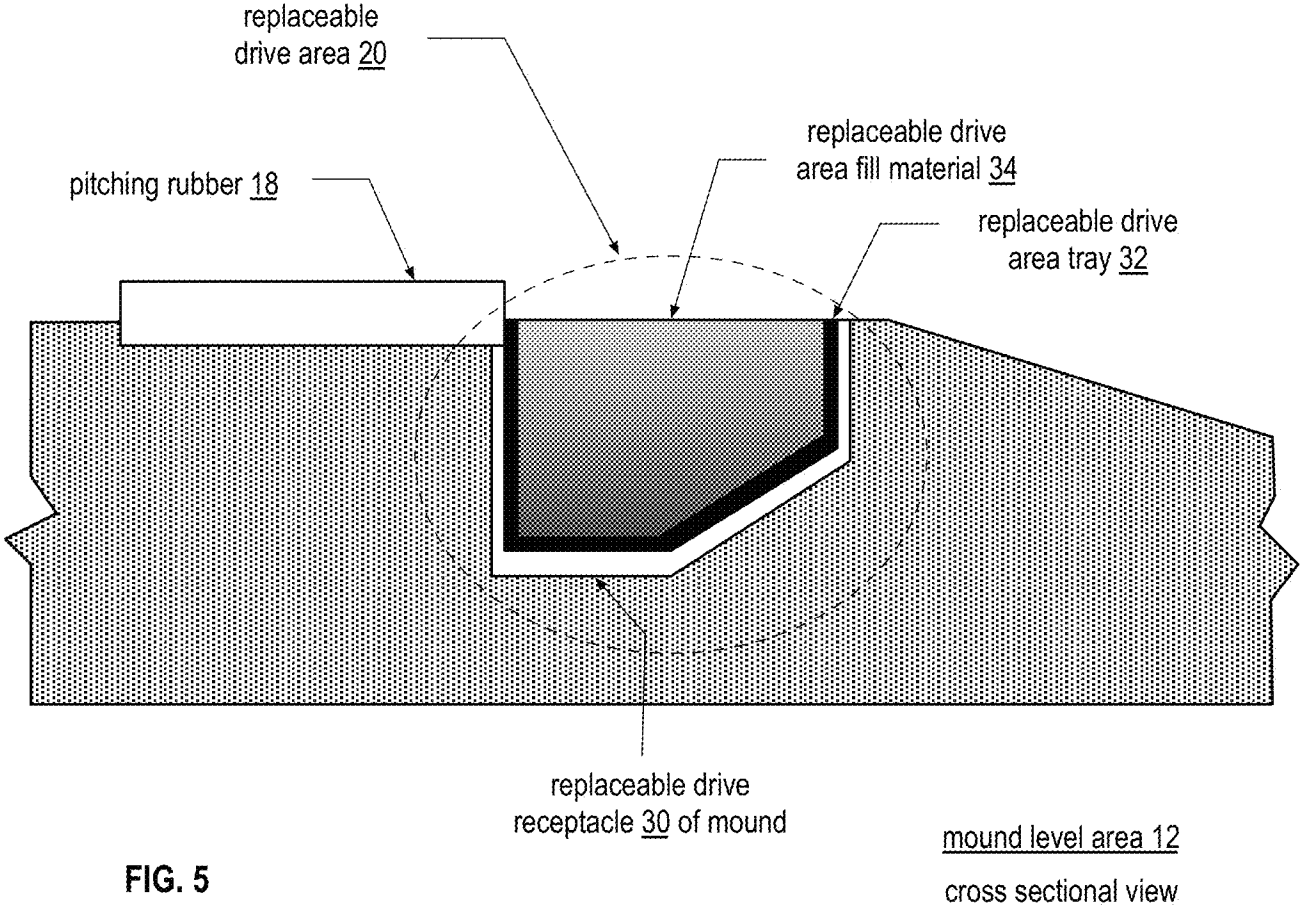
FIG. 5 is a cross sectional side view diagram of another embodiment of the level area of a pitching mound in accordance with the present invention.

FIG. 5 is a cross sectional side view diagram of another embodiment of the level area 12 that includes the pitching rubber 18 and the replaceable drive area 20. The replaceable drive area 20 includes a replaceable drive area tray 32 and a replaceable drive receptacle 30. The replaceable drive area tray 32 is filled with a replaceable drive area fill material 34.

In this embodiment, the replaceable drive area tray 32 and the replaceable drive receptacle 30 have a partial rectangular cross sectional shape that includes an angled section. The inner dimensions of the replaceable drive receptacle 30 are of sufficient size to receive the replaceable drive area tray 32 and, via a pressure fit, securely hold the replaceable drive area tray 32 in place. The replaceable drive receptacle 30 may include guides, ridges, and/or other aligning mechanisms to align with corresponding guides, ridges, and/or aligning mechanisms of the replaceable drive area tray 32. Note that the replaceable drive area tray 32 may have a depth of 3 to 6 inches at the front end and depth of 6-9 inches at the back end. Further note that, as an alternative to a pressure fit, the receptacle drive area 20 may include a securing mechanism as will be described with reference to one or more subsequent figures.

Figure 6:
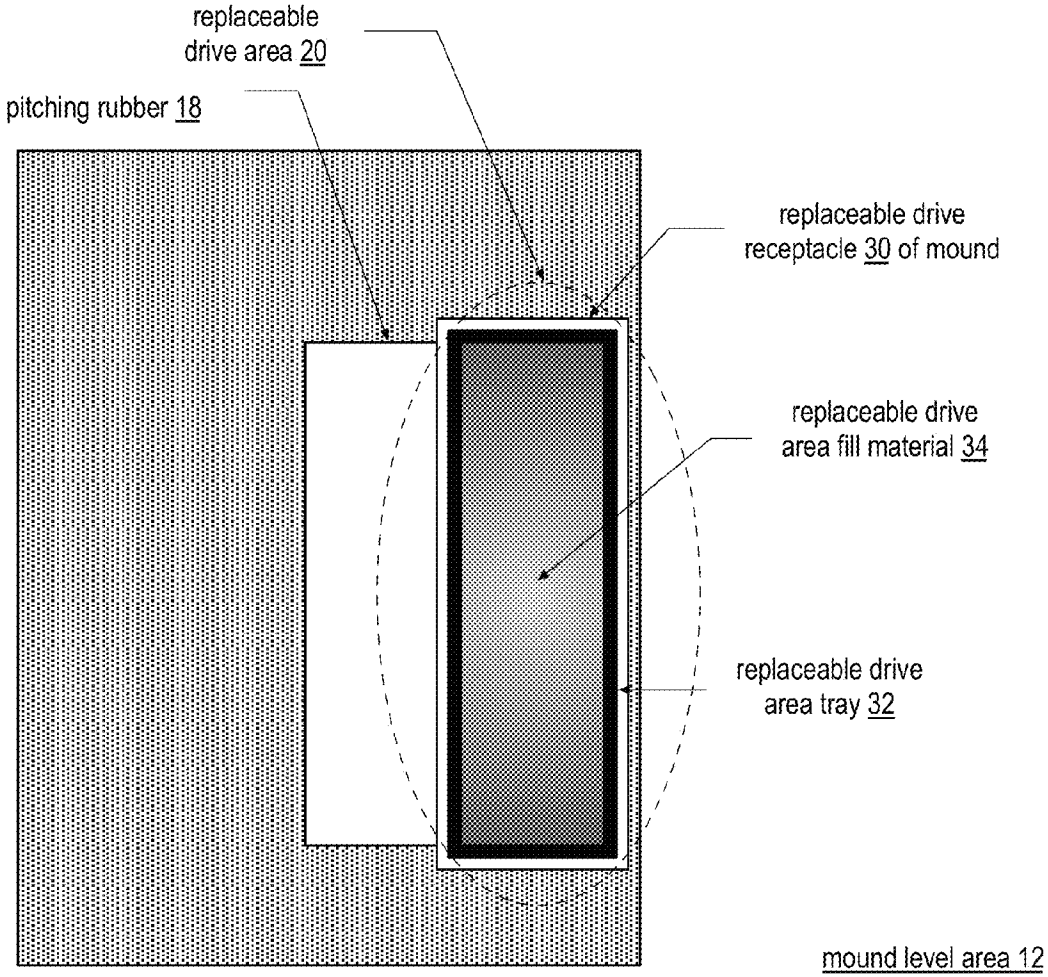
FIG. 6 is a top view diagram of another embodiment of the level area of a pitching mound in accordance with the present invention.

FIG. 6 is a top view diagram of another embodiment of the level area 12 that includes the pitching rubber 18 and the replaceable drive area 20. The replaceable drive area 20 includes a replaceable drive area tray 32 and a replaceable drive receptacle 30. The replaceable drive area tray 32 is filled with a replaceable drive area fill material 34. The replaceable drive receptacle 30 is positioned on the level area 121 to abut the pitching rubber 18 on the home plate side of the rubber. The length of the replaceable drive area 20 is about the same length as the pitching rubber (e.g., 24-30 inches) or slightly longer.

Figure 7:
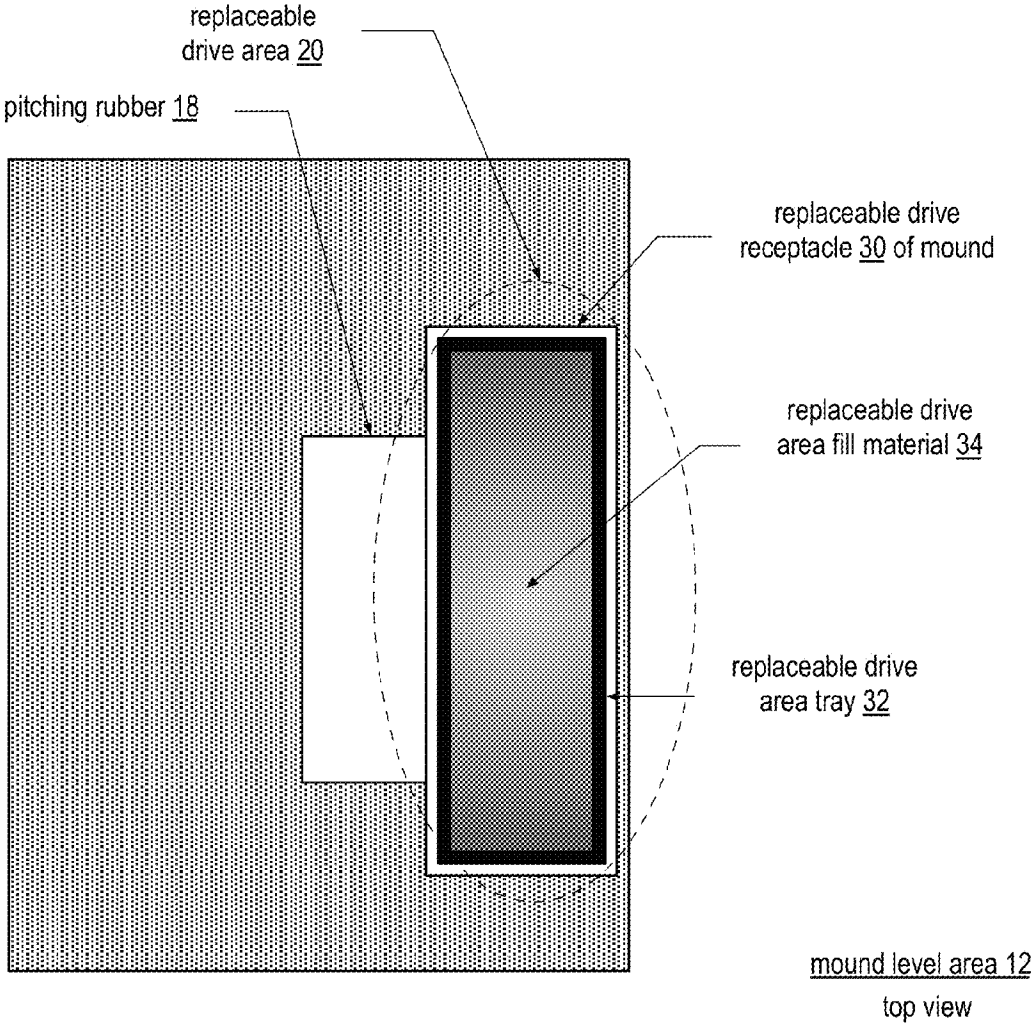
FIG. 7 is a top view diagram of another embodiment of the level area of a pitching mound in accordance with the present invention.

FIG. 7 is a top view diagram of another embodiment of the level area 12 that includes the pitching rubber 18 and the replaceable drive area 20. The replaceable drive area 20 includes a replaceable drive area tray 32 and a replaceable drive receptacle 30. The replaceable drive area tray 32 is filled with a replaceable drive area fill material 34. The replaceable drive receptacle 30 is positioned on the level area 121 to abut the pitching rubber 18 on the home plate side of the rubber. The length of the replaceable drive area 20 is about 10 to 12 inches longer at each than that of the pitching rubber (e.g., the replaceable drive area is 44-48 inches long).

Figure 8:
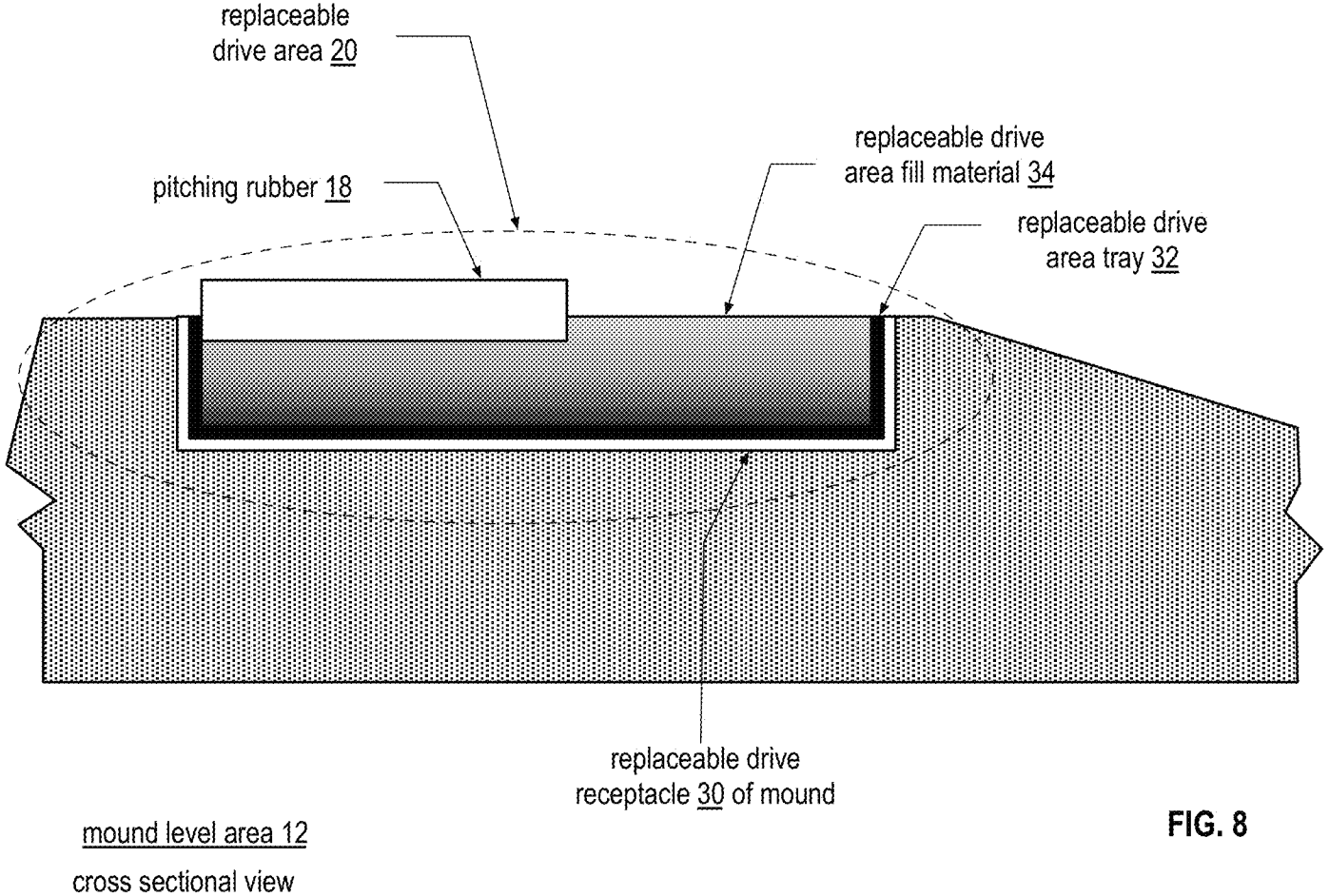
FIG. 8 is a cross sectional side view diagram of another embodiment of the level area of a pitching mound in accordance with the present invention.

FIG. 8 is a cross sectional side view diagram of another embodiment of the level area 12 that includes the replaceable drive area 20. The replaceable drive area 20 includes the pitching rubber 18, a replaceable drive area tray 32 and a replaceable drive receptacle 30. The replaceable drive area tray 32 is filled with a replaceable drive area fill material 34, which may be dirt, clay, a quick dry material, a composite material, rubber composite, and/or a combination thereof. Note that the pitcher rubber 18 may be fixed to the receptacle 30, may be integrated into the receptacle, may extend to the bottom of the tray, and/or be secured to the receptacle 30. Further note that the width and length of the pitching rubber 18 are defined by rules, but its depth is not. As such, the depth may be equal to that of the receptacle 30 or a fraction thereof.

In this embodiment, the replaceable drive area tray 32 and the replaceable drive receptacle 30 have a rectangular cross sectional shape. The inner dimensions of the replaceable drive receptacle 30 are of sufficient size to receive the replaceable drive area tray 32 and, via a pressure fit, securely hold the replaceable drive area tray 32 in place. The replaceable drive receptacle 30 may include guides, ridges, and/or other aligning mechanisms to align with corresponding guides, ridges, and/or aligning mechanisms of the replaceable drive area tray 32. Note that the replaceable drive area tray 32 may have a depth of 3 to 6 inches. Further note that, as an alternative to a pressure fit, the receptacle drive area 20 may include a securing mechanism as will be described with reference to one or more subsequent figures.

Figure 9:
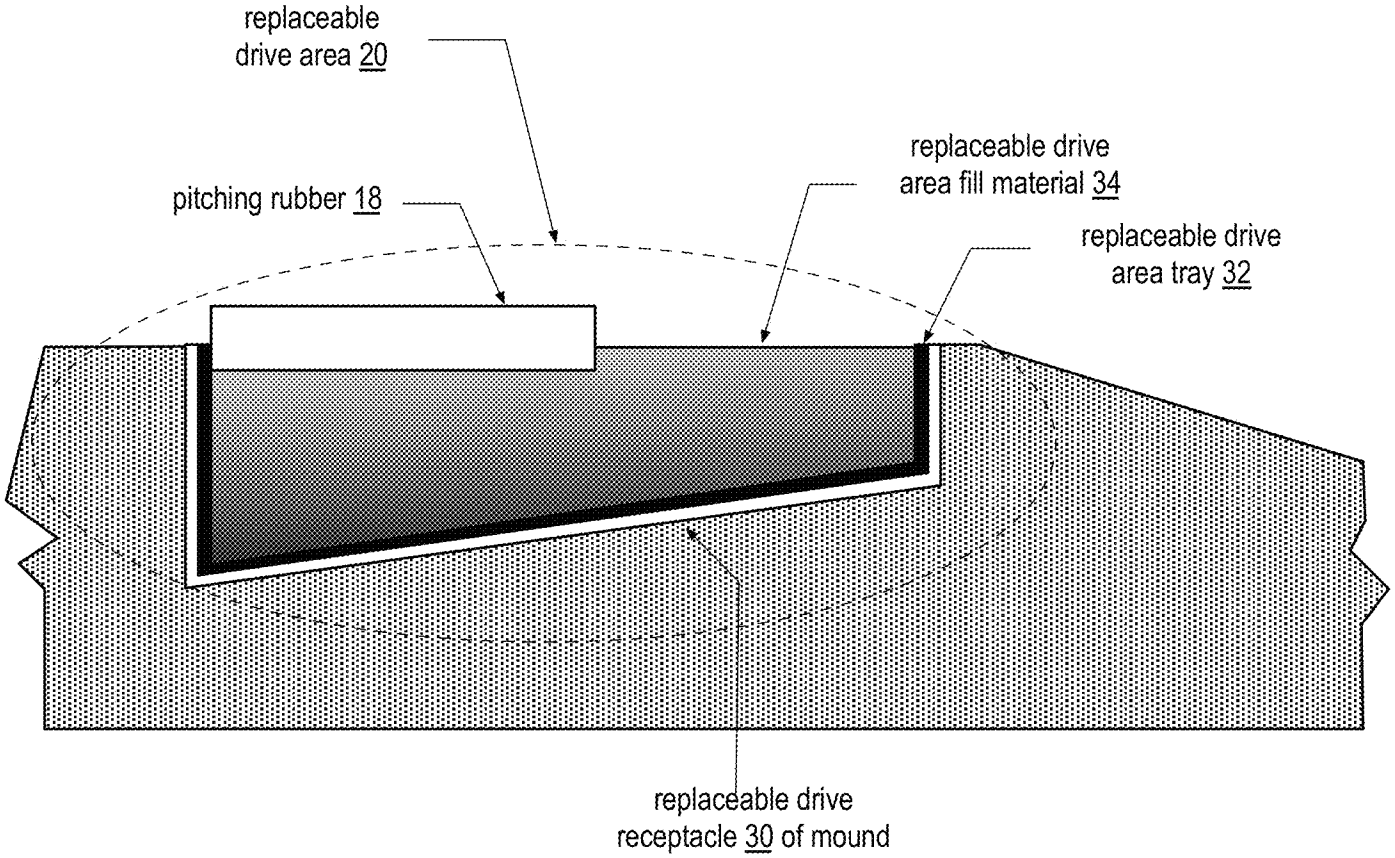
FIG. 9 is a cross sectional side view diagram of another embodiment of the level area of a pitching mound in accordance with the present invention.

FIG. 9 is a cross sectional side view diagram of another embodiment of the level area 12 that includes the replaceable drive area 20. The replaceable drive area 20 includes the pitching rubber 18, a replaceable drive area tray 32 and a replaceable drive receptacle 30. The replaceable drive area tray 32 is filled with a replaceable drive area fill material 34.

In this embodiment, the replaceable drive area tray 32 and the replaceable drive receptacle 30 have an imbalanced rectangular cross sectional shape, where one side is longer than the other. The inner dimensions of the replaceable drive receptacle 30 are of sufficient size to receive the replaceable drive area tray 32 and, via a pressure fit, securely hold the replaceable drive area tray 32 in place. The replaceable drive receptacle 30 may include guides, ridges, and/or other aligning mechanisms to align with corresponding guides, ridges, and/or aligning mechanisms of the replaceable drive area tray 32. Note that the replaceable drive area tray 32 may have a depth of 3 to 6 inches at the front end and 6-9 inches at the back end. Further note that, as an alternative to a pressure fit, the receptacle drive area 20 may include a securing mechanism as will be described with reference to one or more subsequent figures.

Figure 10:
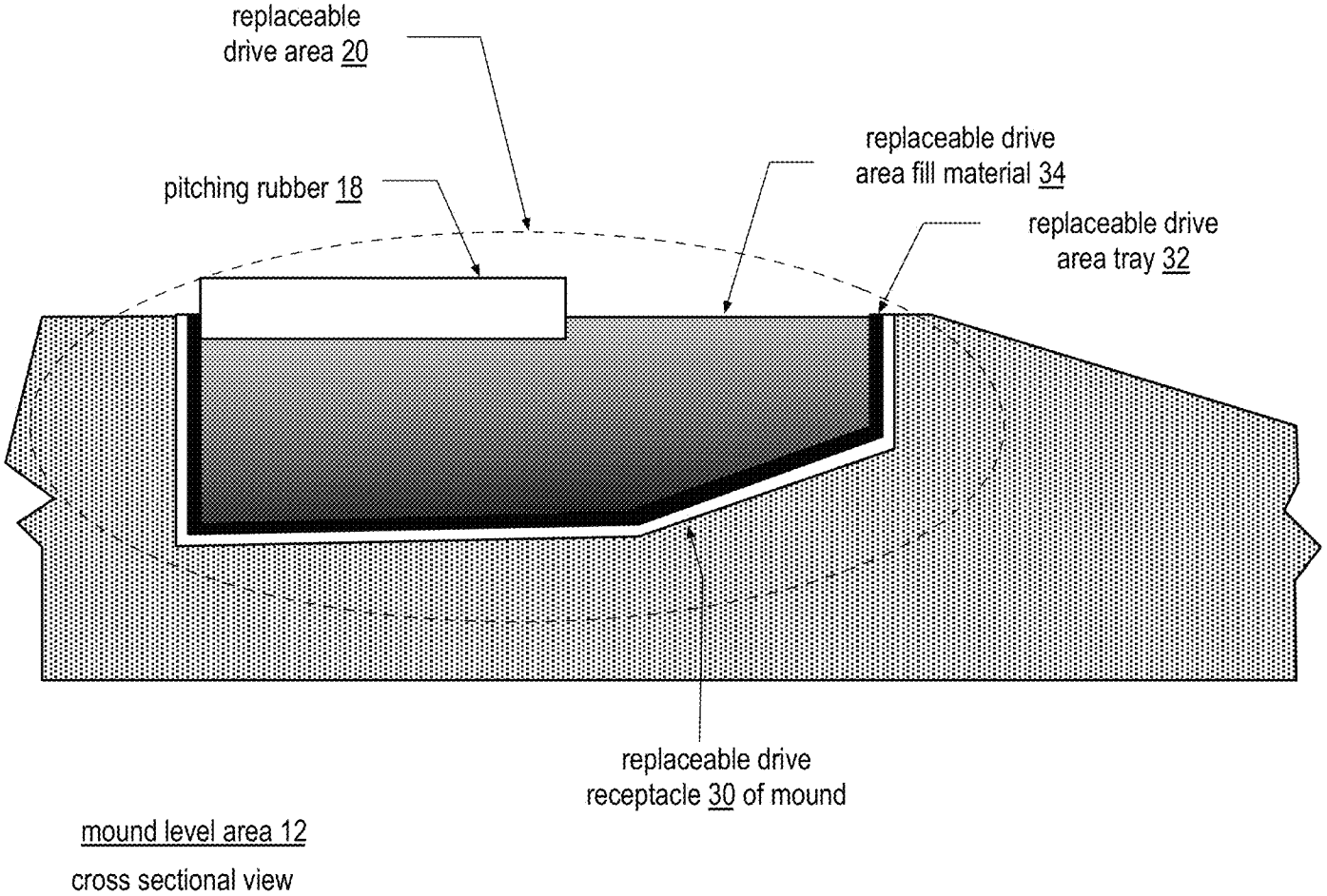
FIG. 10 is a cross sectional side view diagram of another embodiment of the level area of a pitching mound in accordance with the present invention.

FIG. 10 is a cross sectional side view diagram of another embodiment of the level area 12 that includes the replaceable drive area 20. The replaceable drive area 20 includes the pitching rubber 18, a replaceable drive area tray 32 and a replaceable drive receptacle 30. The replaceable drive area tray 32 is filled with a replaceable drive area fill material 34.

In this embodiment, the replaceable drive area tray 32 and the replaceable drive receptacle 30 have a partial rectangular cross sectional shape that includes an angled section. The inner dimensions of the replaceable drive receptacle 30 are of sufficient size to receive the replaceable drive area tray 32 and, via a pressure fit, securely hold the replaceable drive area tray 32 in place. The replaceable drive receptacle 30 may include guides, ridges, and/or other aligning mechanisms to align with corresponding guides, ridges, and/or aligning mechanisms of the replaceable drive area tray 32. Note that the replaceable drive area tray 32 may have a depth of 3 to 6 inches at the front end and depth of 6-9 inches at the back end. Further note that, as an alternative to a pressure fit, the receptacle drive area 20 may include a securing mechanism as will be described with reference to one or more subsequent figures.

Figure 11:
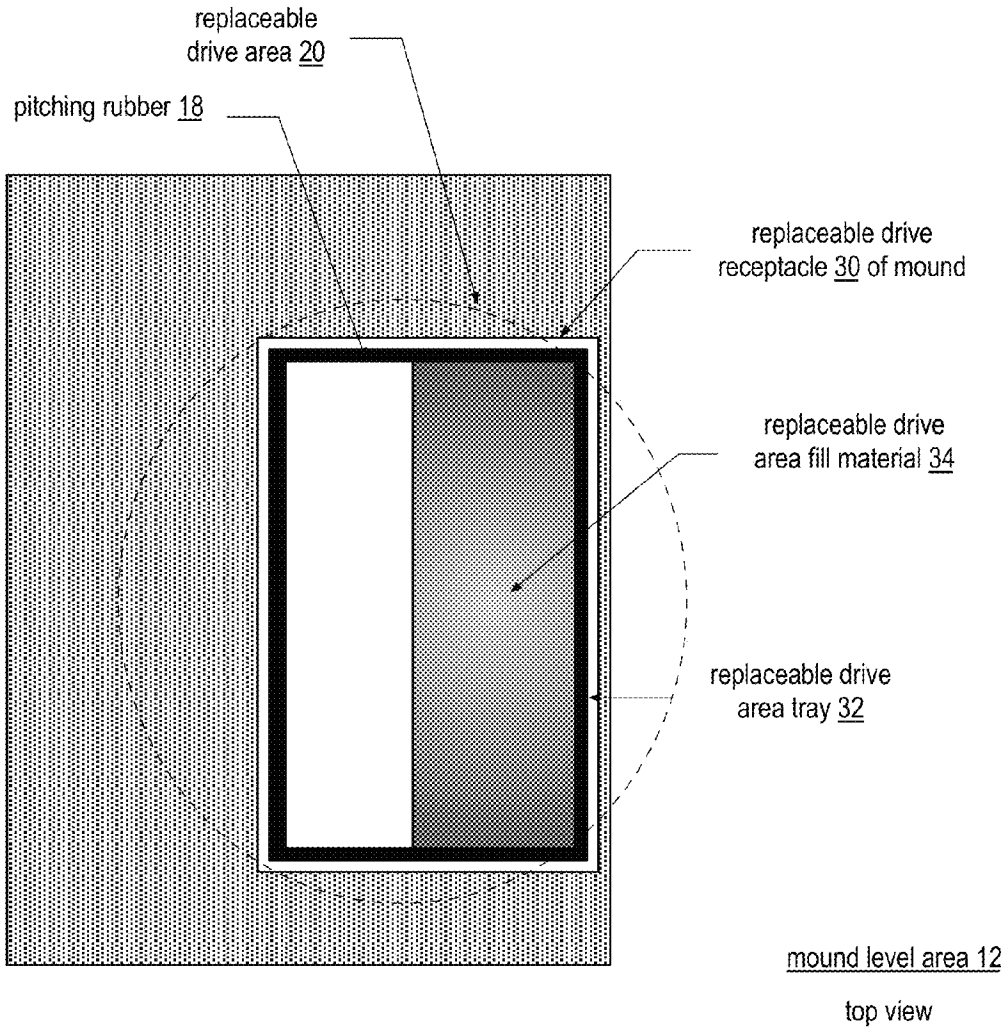
FIG. 11 is a top view diagram of another embodiment of the level area of a pitching mound in accordance with the present invention.

FIG. 11 is a top view diagram of another embodiment of the level area 12 that includes the replaceable drive area 20. The replaceable drive area 20 includes the pitching rubber 18, a replaceable drive area tray 32, and a replaceable drive receptacle 30. The replaceable drive area tray 32 is filled with a replaceable drive area fill material 34. The replaceable drive receptacle 30 is positioned on the level area 121 at the end closest to the home plate. The length of the replaceable drive area 20 is about the same length as the pitching rubber (e.g., 24-30 inches) or slightly longer.

Figure 12:
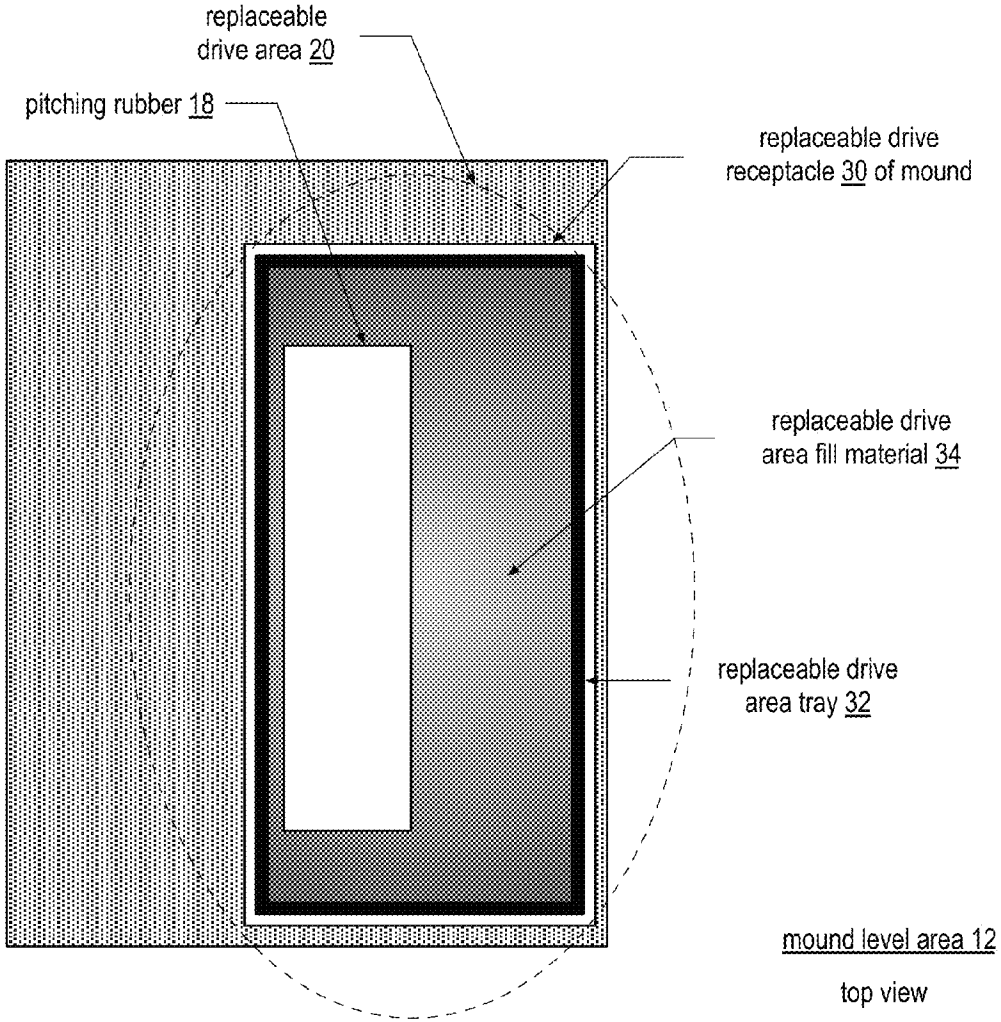
FIG. 12 is a top view diagram of another embodiment of level area of a pitching mound in accordance with the present invention.

FIG. 12 is a top view diagram of another embodiment of the level area 12 that includes the replaceable drive area 20. The replaceable drive area 20 includes the pitching rubber 18, a replaceable drive area tray 32, and a replaceable drive receptacle 30. The replaceable drive area tray 32 is filled with a replaceable drive area fill material 34. The replaceable drive receptacle 30 is positioned on the level area 121 at the end closest to the home plate. The length of the replaceable drive area 20 is about 10 to 12 inches longer at each than that of the pitching rubber (e.g., the replaceable drive area is 44-48 inches long).

Figure 13:
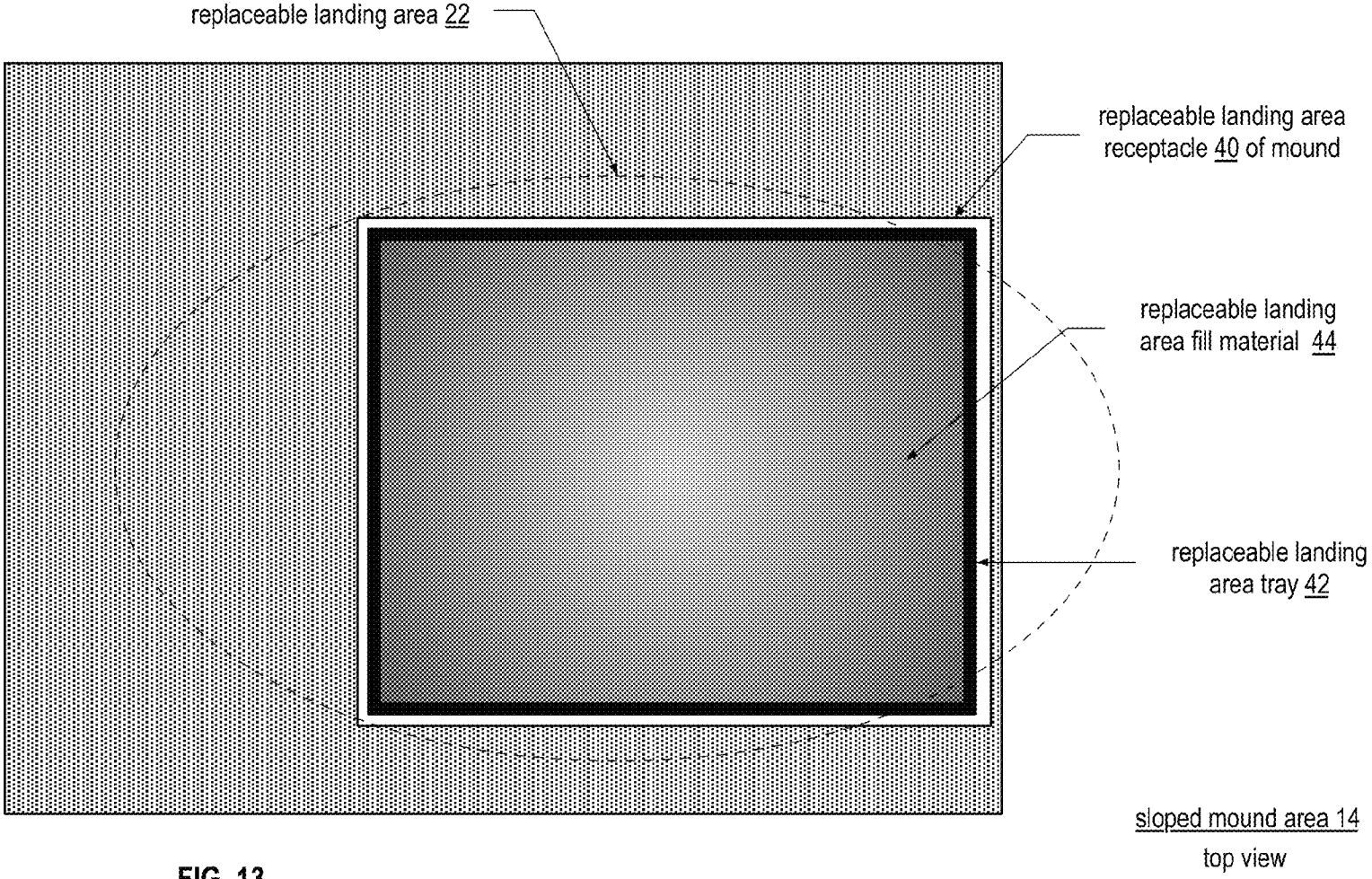
FIG. 13 is a top view diagram of an embodiment of the sloped area of a pitching mound in accordance with the present invention.

FIG. 13 is a top view diagram of an embodiment of the sloped area 14 that includes the replaceable landing area 22. The replaceable landing area 22 includes a replaceable landing receptacle 40 and a replaceable landing area tray 42. The replaceable landing area tray 42 is filled with a replaceable drive area fill material 44, which may be dirt, clay, a quick dry material, a composite material, rubber composite, and/or a combination thereof.

Figure 14:
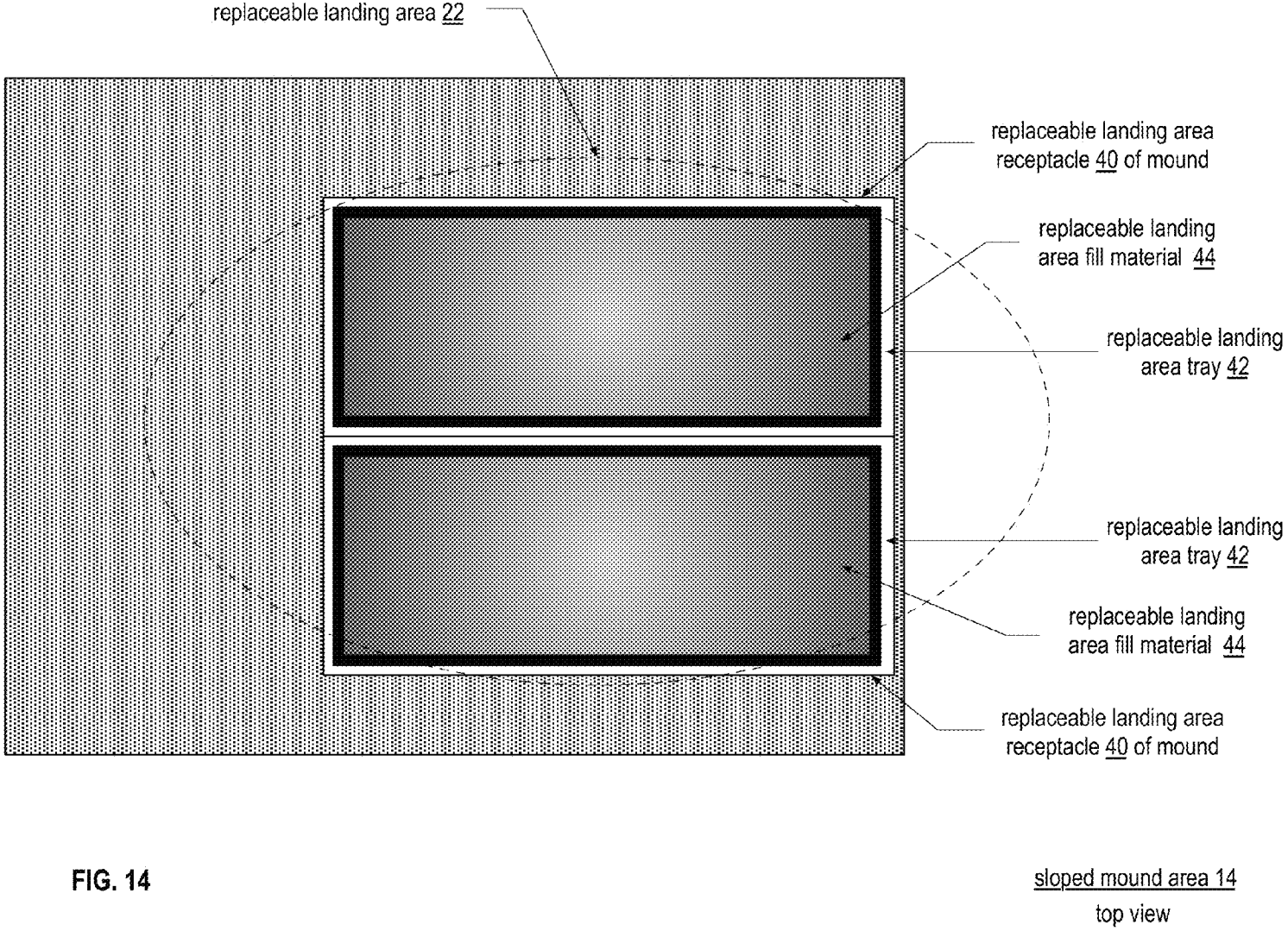
FIG. 14 is a top view diagram of another embodiment of the sloped area of a pitching mound in accordance with the present invention.

FIG. 14 is a top view diagram of another embodiment of the sloped area 14 that includes the replaceable landing area 22. The replaceable landing area 22 includes a plurality of replaceable landing receptacles 40 and a plurality of replaceable landing area trays 42 (two of each shown, but could be more than two). Each of the replaceable landing area trays 42 is filled with a replaceable drive area fill material 44, which may be dirt, clay, a quick dry material, a composite material, rubber composite, and/or a combination thereof.

Figure 15:
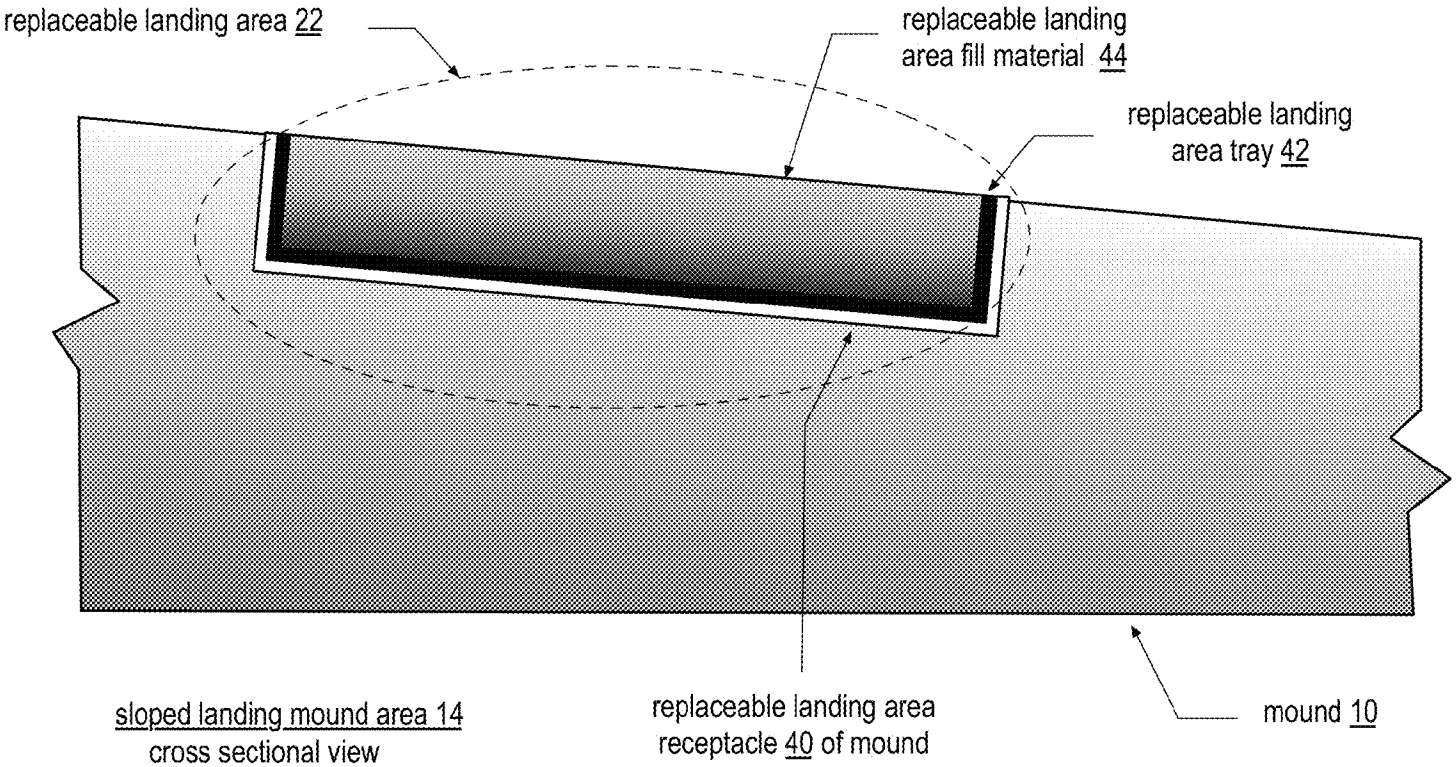
FIG. 15 is a cross sectional side view diagram of another embodiment of the sloped area of a pitching mound in accordance with the present invention.

FIG. 15 is a cross sectional side view diagram of another embodiment of the sloped area 14 that includes the replaceable landing area 22. The replaceable landing area 22 includes one or more replaceable landing receptacles 40 and one or more replaceable landing area trays 42. Each of the replaceable landing area tray 42 is filled with a replaceable drive area fill material 44.

In this embodiment, each of the replaceable landing area trays 42 and each of the replaceable landing receptacles 40 have a rectangular cross sectional shape. The inner dimensions of a replaceable landing receptacle 40 are of sufficient size to receive a corresponding replaceable landing area tray 42 and, via a pressure fit, securely hold the replaceable landing area tray 42 in place. Each of the replaceable landing receptacles 40 may include guides, ridges, and/or other aligning mechanisms to align with corresponding guides, ridges, and/or aligning mechanisms of the corresponding replaceable landing area tray 42. Note that each of the replaceable landing area trays 42 may have a depth of 3 to 6 inches. Further note that, as an alternative to a pressure fit, the receptacle landing area 22 may include a securing mechanism as will be described with reference to one or more subsequent figures.

Figure 16:
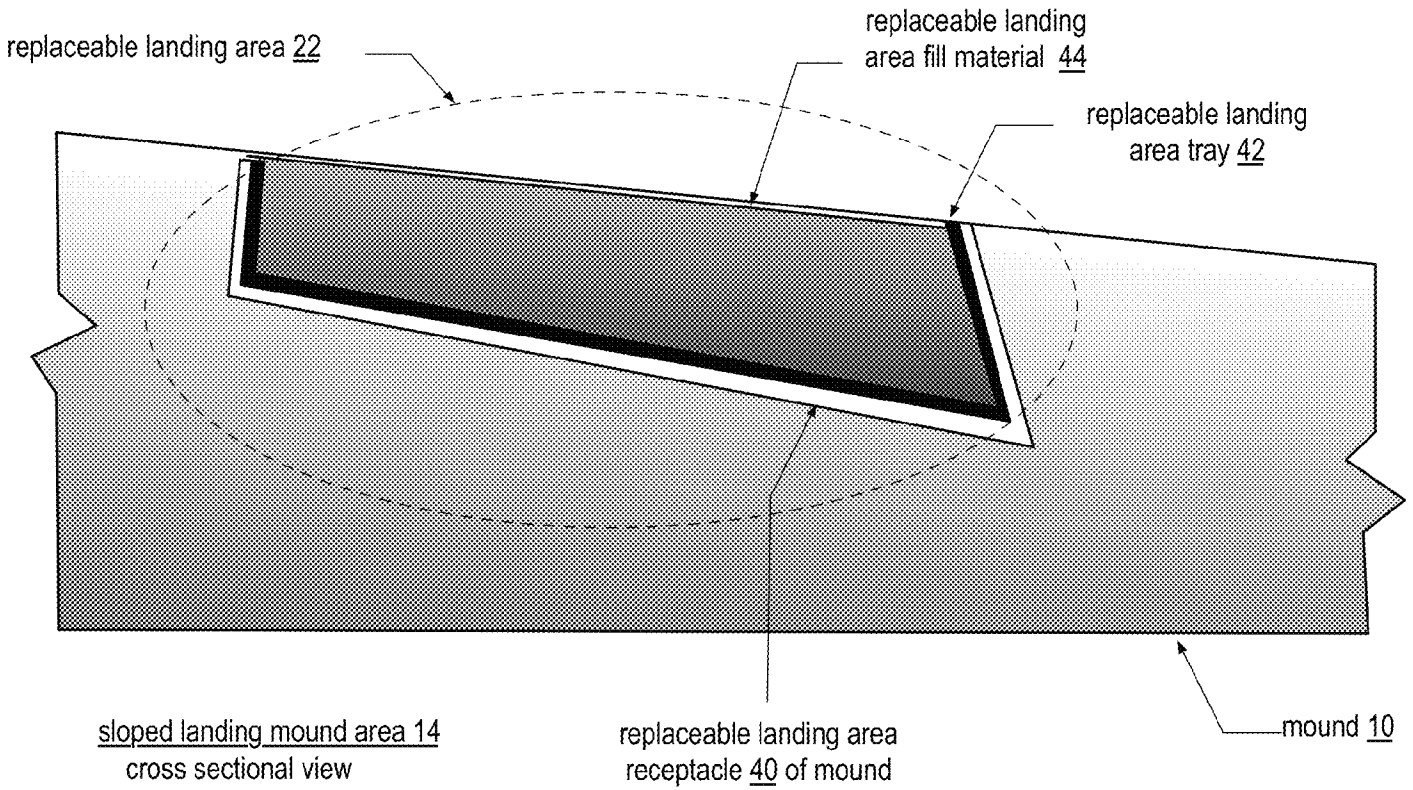
FIG. 16 is a cross sectional side view diagram of another embodiment of the sloped area of a pitching mound in accordance with the present invention.

FIG. 16 is a cross sectional side view diagram of another embodiment of the sloped area 14 that includes the replaceable landing area 22. The replaceable landing area 22 includes one or more replaceable landing receptacles 40 and one or more replaceable landing area trays 42. Each of the replaceable landing area trays 42 is filled with a replaceable drive area fill material 44.

In this embodiment, each of the replaceable landing area trays 42 and each of the replaceable landing receptacles 40 have an angular rectangular cross sectional shape where one side is longer than the other side. The inner dimensions of a replaceable landing receptacle 40 are of sufficient size to receive a corresponding replaceable landing area tray 42 and, via a pressure fit, securely hold the replaceable landing area tray 42 in place. Each of the replaceable landing receptacles 40 may include guides, ridges, and/or other aligning mechanisms to align with corresponding guides, ridges, and/or aligning mechanisms of the corresponding replaceable landing area tray 42. Note that each of the replaceable landing area trays 42 may have a depth of 3 to 6 inches at the back end to 6-9 inches at the front end. Further note that, as an alternative to a pressure fit, the receptacle landing area 22 may include a securing mechanism as will be described with reference to one or more subsequent figures.

Figure 17:
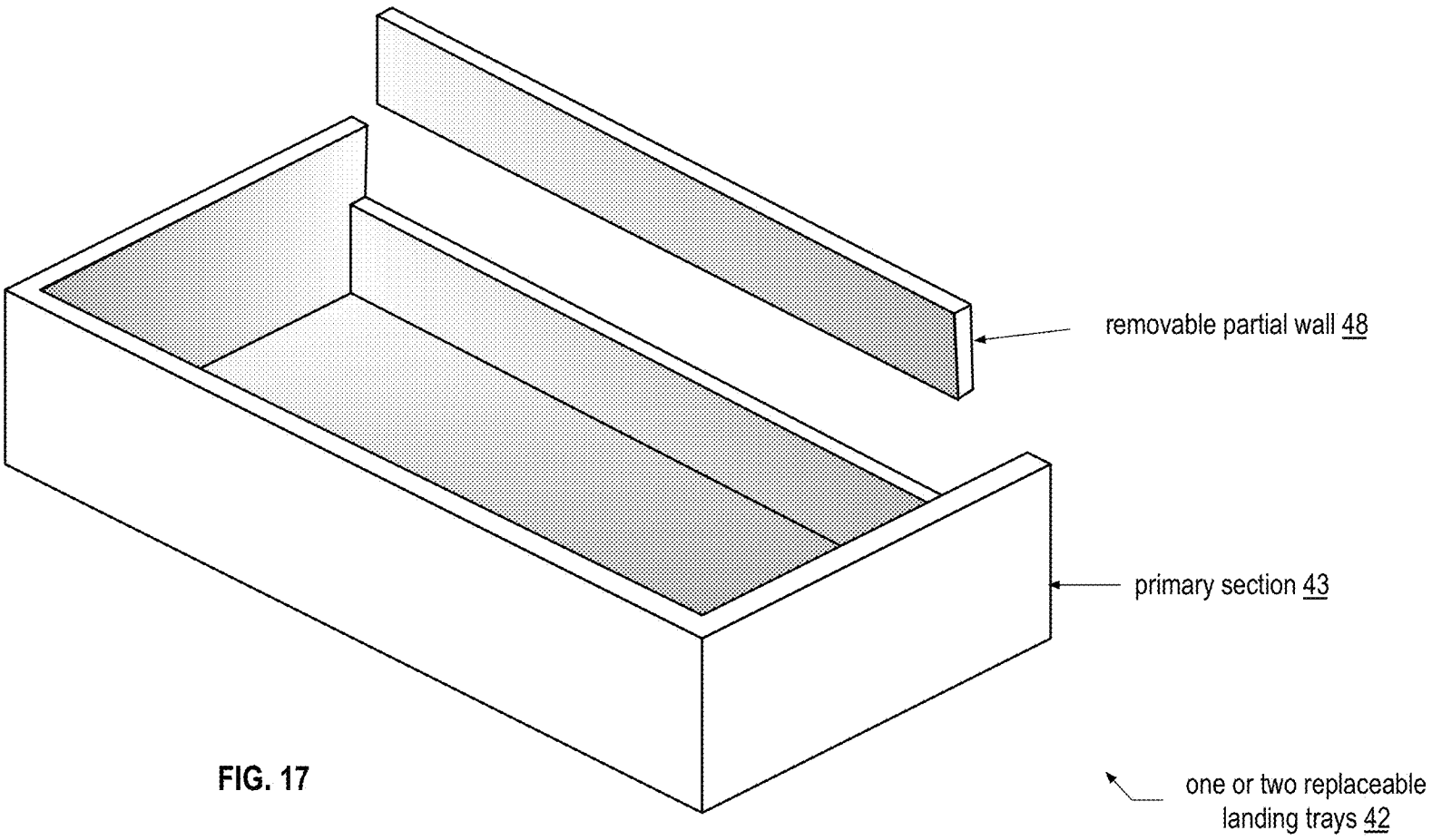
FIG. 17 is an isometric view diagram of an embodiment of a replaceable tray for the sloped area of a pitching mound in accordance with the present invention.

FIG. 17 is an isometric view diagram of an embodiment of one of a plurality of replaceable trays 42 for the sloped area 14. The replaceable tray 42 includes a primary section 42 and a removable partial wall 48. When installed in the corresponding landing area receptacles 40, the partial wall 48 may be removed, thus eliminating a pitcher landing on the wall. In some instances, the grounds crew may need to add a little mound material 44 after the partial wall is removed to make the area of consistent density and of a consistent surface. Note that for the replaceable areas discussed herein, mound material may be added and tamped down around the edges of the replaceable trays to substantially eliminate delineation of the tray from the remainder of the mound 10.

Figure 18:
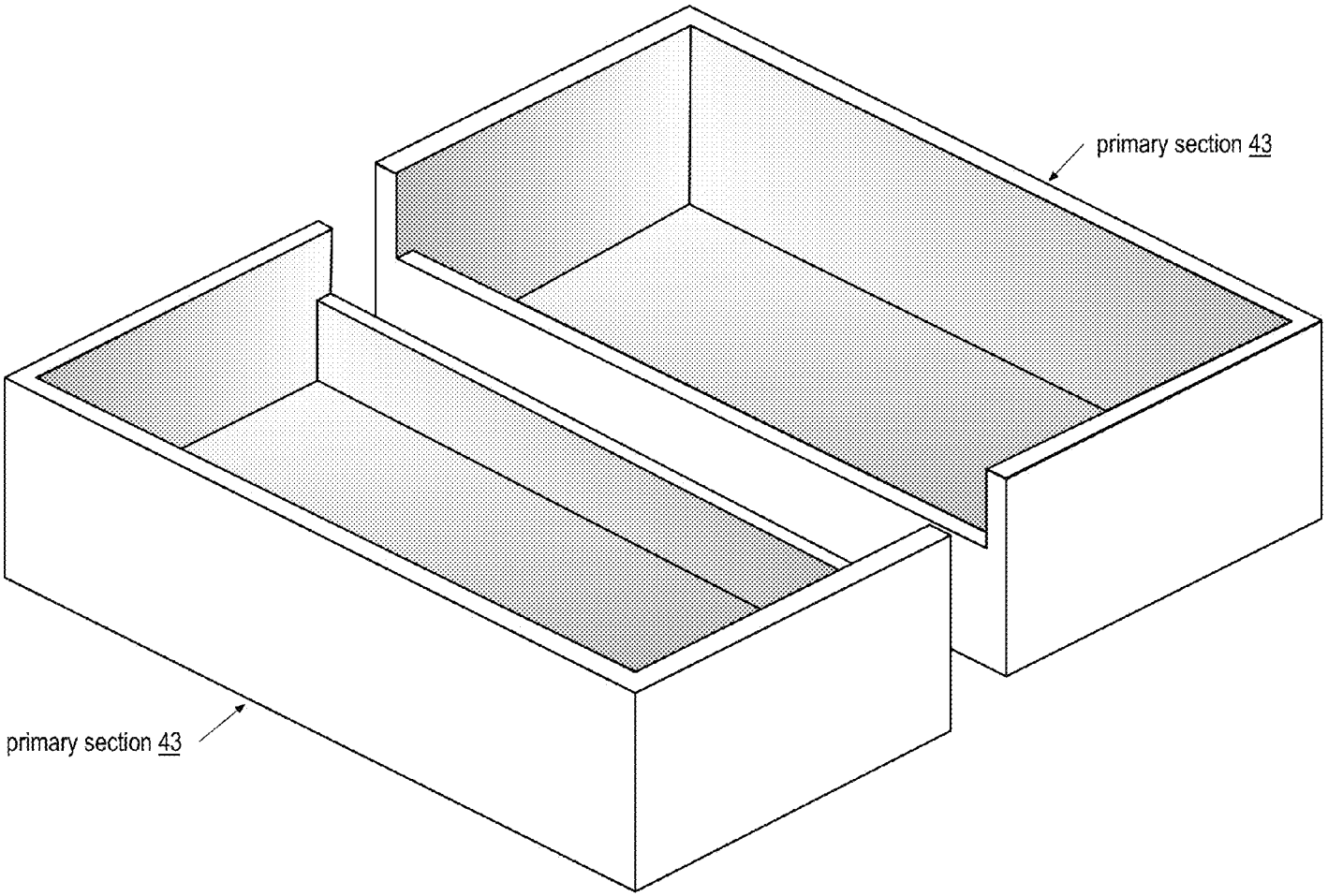
FIG. 18 is an isometric view diagram of another embodiment of a replaceable tray for the sloped area of a pitching mound in accordance with the present invention.

FIG. 18 is an isometric view diagram of another embodiment of the primary sections 43 of two replaceable trays 42 of the sloped area 14 with the partial wall 48 removed. In this embodiment, when the primary sections 43 are installed in the corresponding receptacles 40, the center of the replaceable landing is free of walls of the trays 42.

Figure 19:
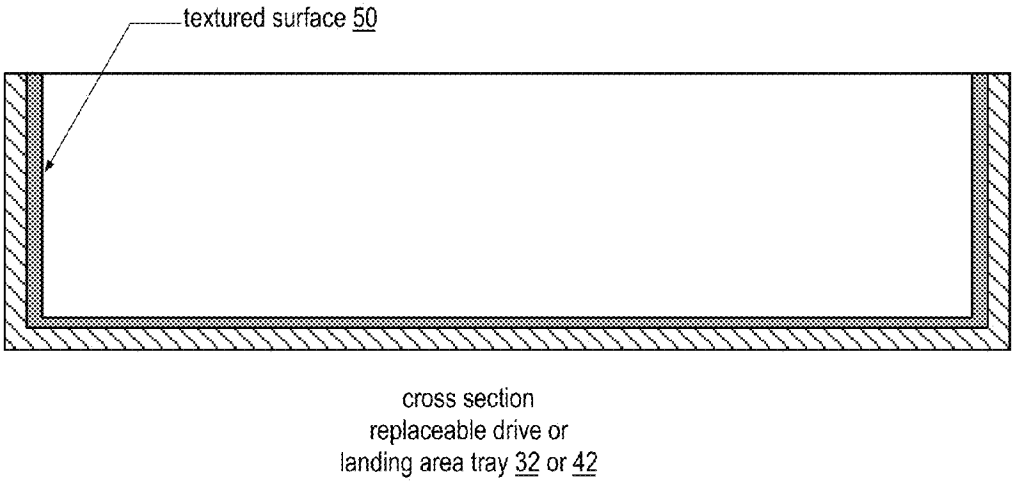
FIG. 19 is a cross sectional side view diagram of an embodiment of a replaceable tray for the sloped area or the level area of a pitching mound in accordance with the present invention.

FIG. 19 is a cross sectional side view diagram of an embodiment of a replaceable tray 32 or 42 for the sloped area 14 or the level area 12. The tray 32 or 42 may be comprised of plastic, wood, fiberglass, rubber, carbon fiber, aluminum, and/or other material that may be shaped into a tray. To reduce shifting of the mound fill material 34 or 44 as a result of the force applied by the pitcher, the inside walls of the tray 32 or 42 may include a textured surface 50 (e.g., a series of bumps, a series of dimples, a rough surface, a varying thickness, an adhesive, etc., and/or a combination thereof). The textured surface 50 may be fabricated into the tray 32 or 42 (e.g., molded into tray) or added to the tray (e.g., sprayed on and/or etched off).

Figure 20:
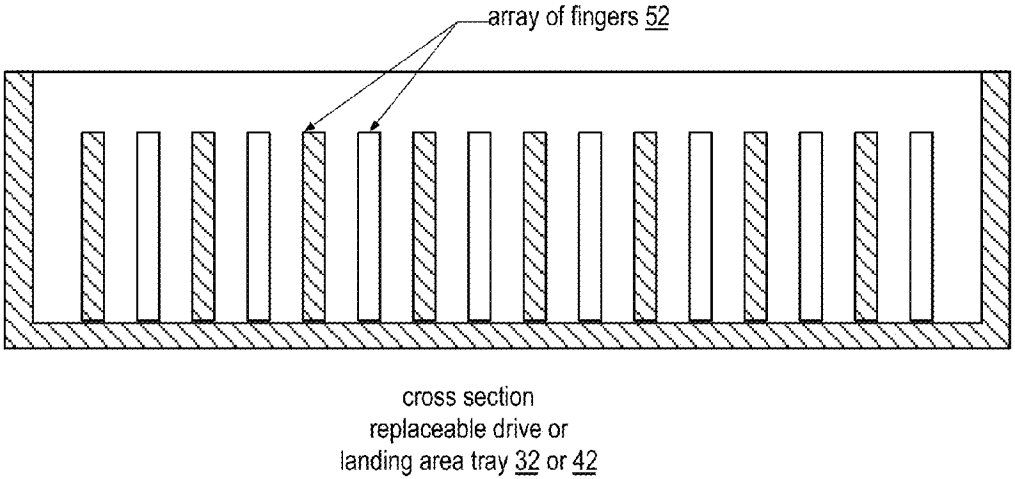
FIG. 20 is a cross sectional side view diagram of another embodiment of a replaceable tray for the sloped area or the level area of a pitching mound in accordance with the present invention.

FIG. 20 is a cross sectional side view diagram of another embodiment of a replaceable tray 32 or 42 for the sloped area 14 or the level area 12. The tray 32 or 42 may be comprised of plastic, wood, fiberglass, rubber, carbon fiber, aluminum, and/or other material that may be shaped into a tray. To reduce shifting of the mound fill material 34 or 44 as a result of the force applied by the pitcher, the tray 32 or 42 includes an array of fingers 52. The fingers 52 may be of the same material and/or of a different material than that of the tray 32 or 42. From finger to finger, the length, width, and shape may vary. For example, one finger is of the same material as the tray, has a length that is 1 inch less than the depth of the tray, has a width of ⅛ inch, and a cylinder shape and a second finger is of a different material, has a length that is 1.5 inches less than the depth of the tray, has width of ¼ inch, and has a cross-sectional star shape. The fingers 52 may fabricated into the tray (e.g., molded into the tray) or may be subsequently added to the tray (e.g., secured to the tray).

Figure 21:
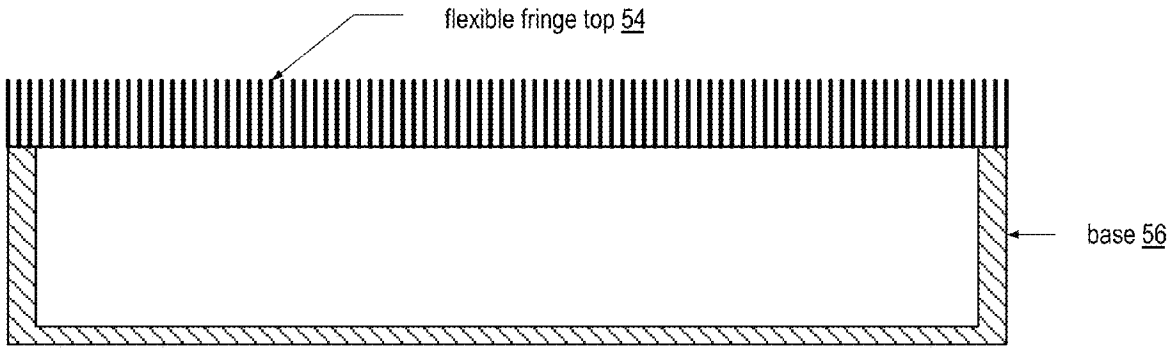
FIG. 21 is a cross sectional side view diagram of an embodiment of a replaceable tray for the sloped area or the level area of a pitching mound in accordance with the present invention.

FIG. 21 is a cross sectional side view diagram of an embodiment of a replaceable tray 32 or 42 for the sloped area 14 or the level area 12. The replaceable tray 32 or 42 includes a base 56 and a flexible finger top 54. The base 56 may be comprised of plastic, wood, fiberglass, rubber, carbon fiber, aluminum, and/or other material that may be shaped into a base 56 for the tray 32 or 42. The flexible fringe top 54 may include one or more rows of fingers (three rows shown, but could be more or less), a thin flexible wall, or other readily compressible shaped material. The fingers, walls, etc., are comprised of a flexible material (e.g., rubber, plastic, etc.) that allows for movement of the mound fill material and/or minimizes interference to spike impact (e.g., the pitcher's drive foot pushing off the mound and/or the pitcher's landing foot hitting the landing area). The length of the fingers, wall, etc., may be ½ inch to a couple of inches depending on the type of mound fill material being used (e.g., the more displaceable the material, the longer the fingers should be). Note that the fingers, walls, etc., (individually or collectively) may be replaceable such that as they are worn down, they can be replaced.

Figure 22:
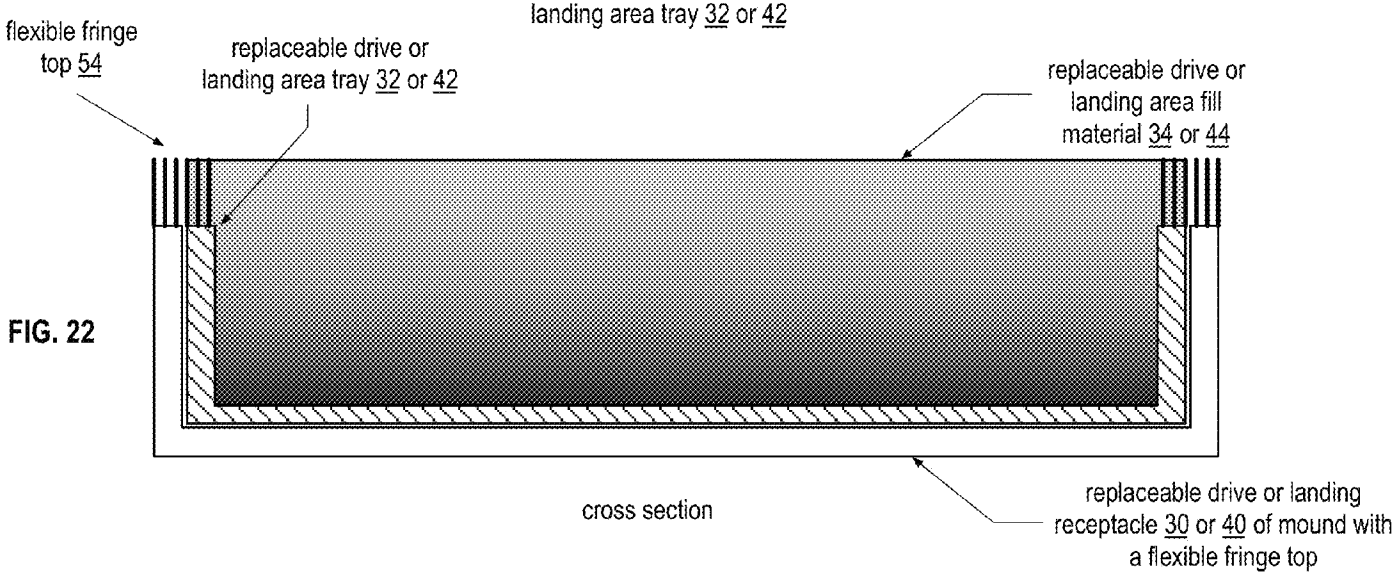
FIG. 22 is a cross sectional side view diagram of an embodiment of a replaceable tray and receptacle for the sloped area or the level area of a pitching mound in accordance with the present invention.

FIG. 22 is a cross sectional side view diagram of an embodiment of a replaceable tray 32 or 42 and receptacle 30 or 40 for the sloped area 14 or the level area 12. Each of the tray 32 or 42 and receptacle 30 or 40 includes a flexible fringe top 54 at their respective outer edges. The flexible fringe top 54 for the tray and receptacle may be implemented as discussed with reference to FIG. 21. When the tray is replaced with a new tray (i.e., a tray with freshly packed mound fill material), mound fill material may be added to the perimeter of the tray and tamped down. Alternatively, the perimeter of the new tray may have a slight ridge of extra mound fill material such that, after installation into the receptacle, the extra mound fill material may be tamped down to fill in between the flexible fringe tops 54 of the tray and receptacle.

Figure 23:
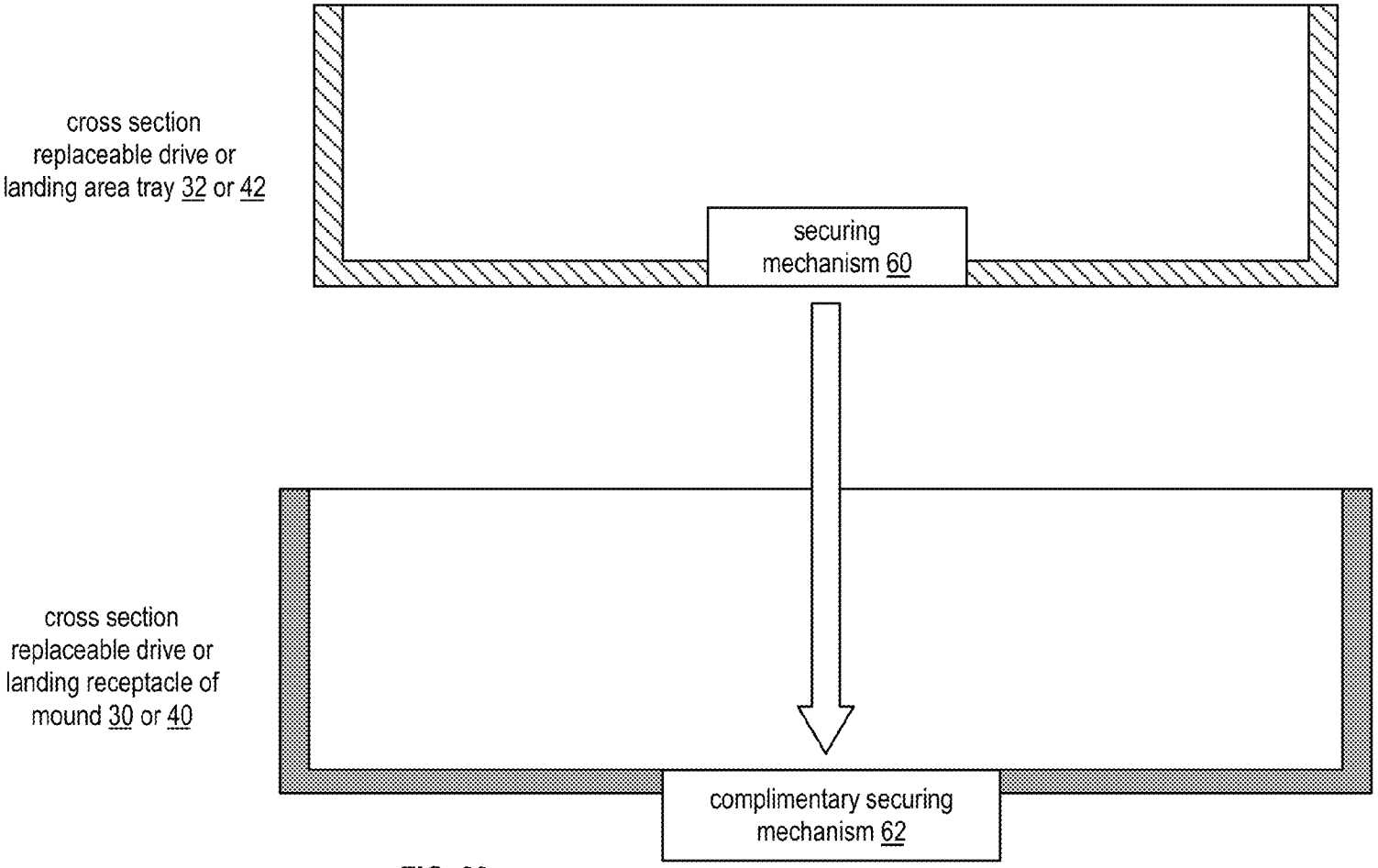
FIG. 23 is a cross sectional side view diagram of an embodiment of securing a replaceable tray to a receptacle for the sloped area or the level area of a pitching mound in accordance with the present invention.

FIG. 23 is a cross sectional side view diagram of an embodiment of securing a replaceable tray 32 or 42 to a receptacle 30 or 40 for the sloped area 14 or the level area 12. The tray 32 or 42 includes a securing mechanism 60 and the receptacle 30 or 40 includes a complimentary securing mechanism 62. The securing of the tray 32 or 42 to the receptacle 30 or 40 may be done in a variety of ways. For example, the securing mechanism 60 includes screws and/or bolts and the complimentary securing mechanism 62 includes nuts, threaded holes, etc., to receive the screws and/or bolts.

In another example, the securing mechanism 60 includes one or more guided clips and the complementary securing mechanism 62 includes a corresponding receptacle for the guided clips. In yet another example, the securing mechanism 60 includes an electromagnetic circuit and the complementary securing mechanism 62 includes a magnetic plate and/or a complementary magnetic circuit. In a further example, the securing mechanism 60 includes a latch and the complementary securing mechanism 62 includes a latch receptacle. Other examples, and/or furtherance of these examples, are discussed with reference to one or more subsequent figures.

Figure 24:
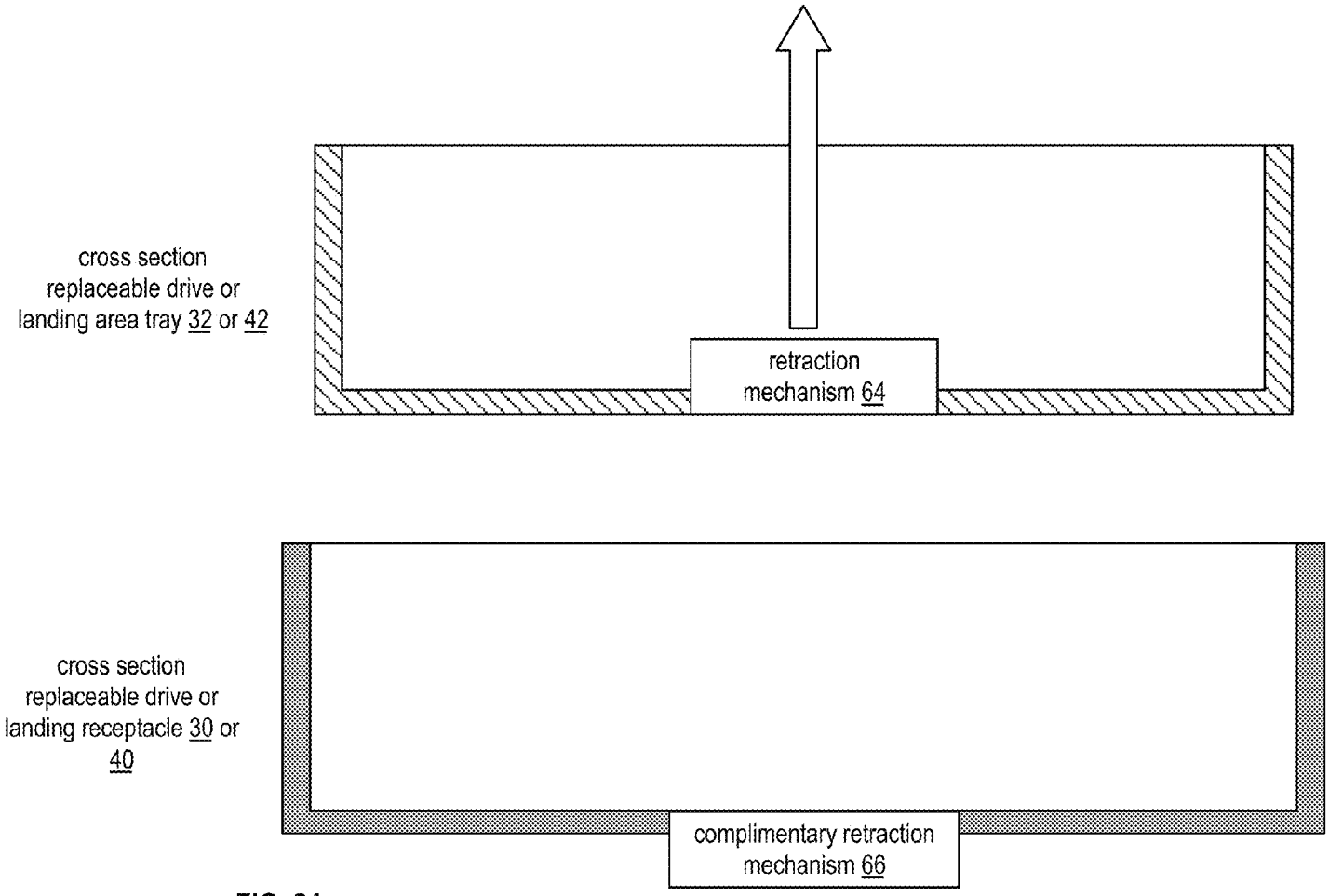
FIG. 24 is a cross sectional side view diagram of an embodiment of retracting a replaceable tray from a receptacle for the sloped area or the level area of a pitching mound in accordance with the present invention.

FIG. 24 is a cross sectional side view diagram of an embodiment of retracting a replaceable tray 32 or 42 from a receptacle 30 or 40 for the sloped area 14 or the level area 12. The tray 32 or 42 includes a retraction mechanism 64 and the receptacle 30 or 40 may include a complimentary retraction mechanism 66. The retraction of the tray 32 or 42 to the receptacle 30 or 40 may be done in a variety of ways. For example, retraction mechanism 64 may be hooks, or other structure, that an extraction tool can grasp to extract the tray 32 or 42 from the receptacle 30 or 40. As another example, a lubricant may be used to facilitate extraction. As yet another example, the tray and/or the receptacle may include ball bearings to facilitate installation and extraction. Other examples, and/or furtherance of this example, are discussed with reference to one or more subsequent figures.

Figure 25:
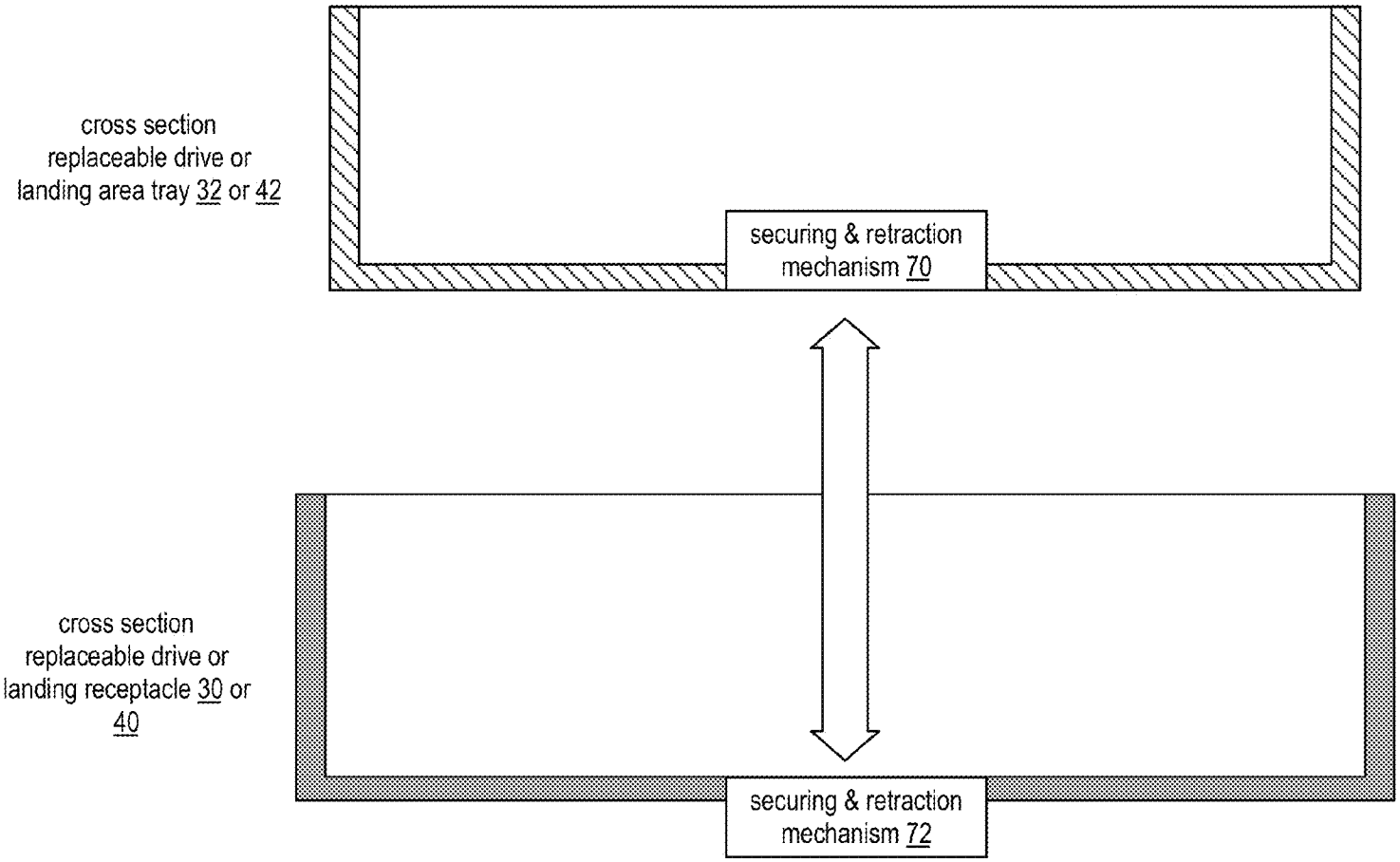
FIG. 25 is a cross sectional side view diagram of an embodiment of securing and retracting a replaceable tray to/from a receptacle for the sloped area or the level area of a pitching mound in accordance with the present invention.

FIG. 25 is a cross sectional side view diagram of an embodiment of securing and retracting a replaceable tray 32 or 42 to/from a receptacle 30 or 40 for the sloped area 14 or the level area 12. The tray 32 or 42 includes a securing and retraction mechanism 70 and the receptacle 30 or 40 includes a complimentary securing and retraction mechanism 72. The securing and retraction of the tray 32 or 42 to the receptacle 30 or 40 may be done in a variety of ways as previously discussed and/or as will be discussed with reference to one or more subsequent figures.

Figure 26:
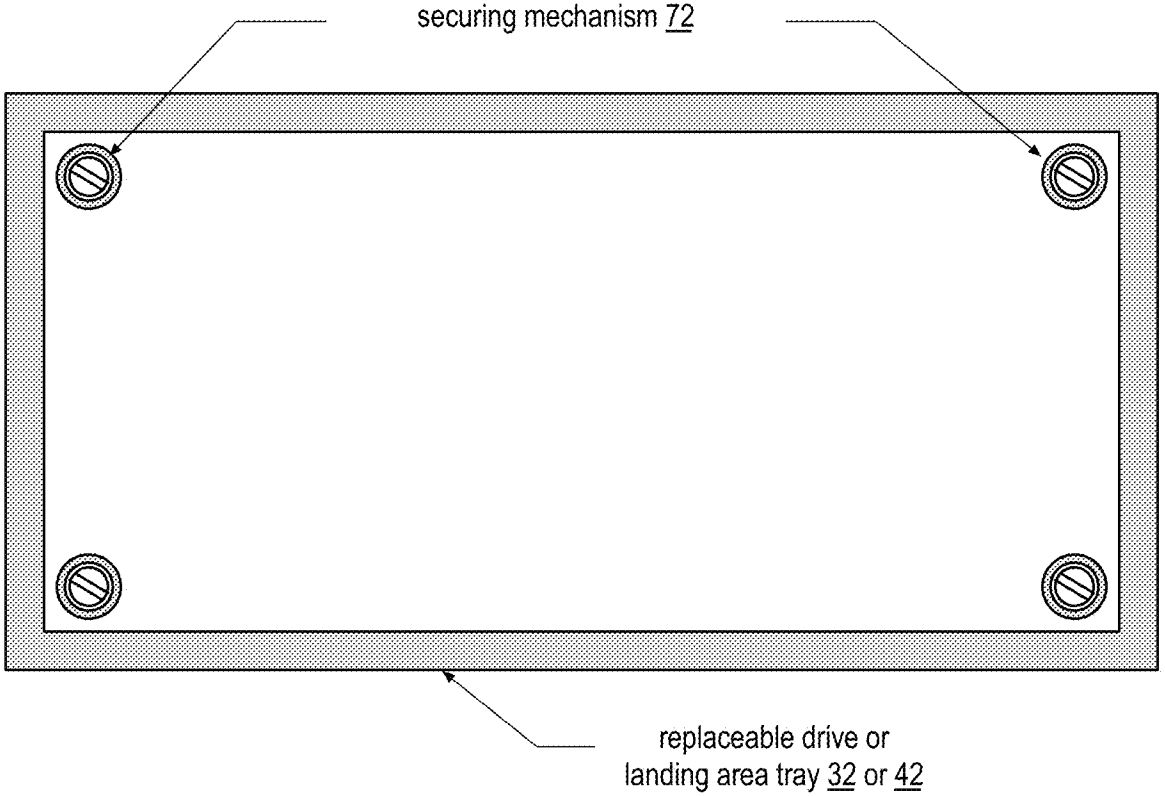
FIG. 26 is a top view diagram of an embodiment of a replaceable tray with a securing mechanism for the sloped area or the level area of a pitching mound in accordance with the present invention.

FIG. 26 is a top view diagram of an embodiment of a replaceable tray 32 or 42 with a securing mechanism 72. In this embodiment, the tray 32 or 42 includes a hollow tube for a screw or bolt in each of the corners. Note that the tray may include more or less securing mechanisms 72. Further note that the securing mechanisms 72 may be positioned within the tray to provide minimum interference during use.

Figure 27:
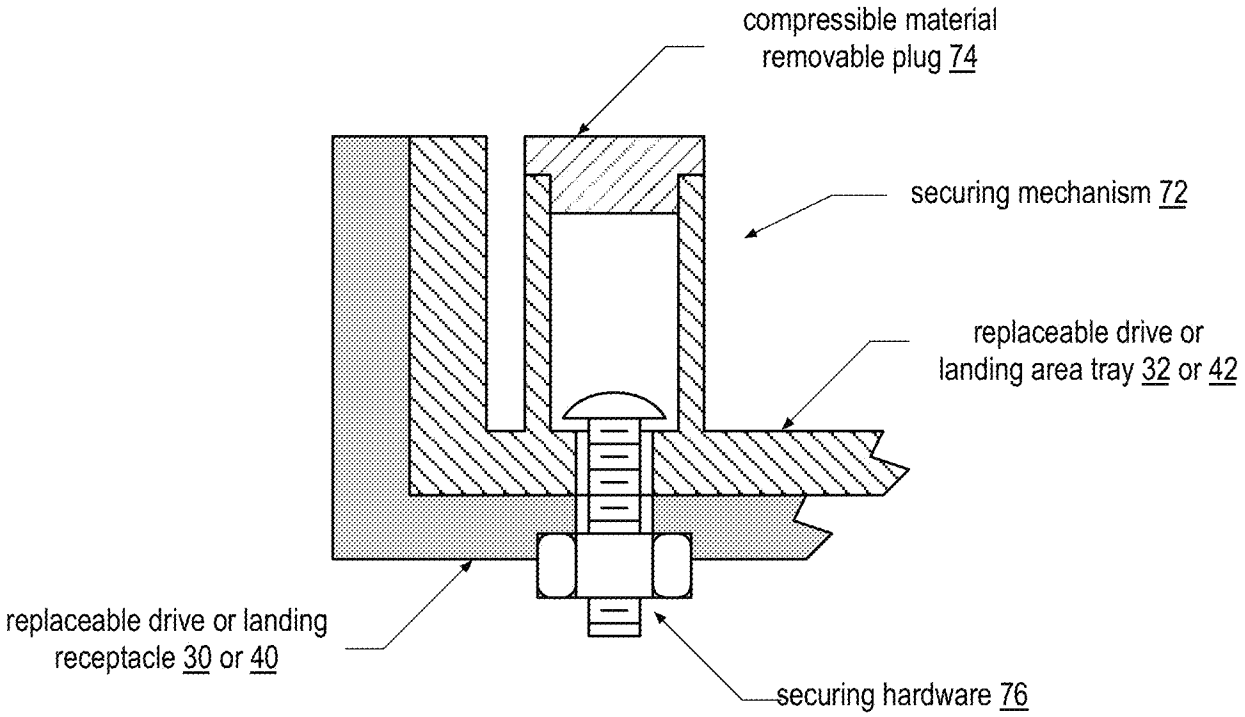
FIG. 27 is a cross sectional side view diagram of an embodiment of a securing mechanism for a replaceable tray and receptacle of the sloped area or of the level area of a pitching mound in accordance with the present invention.

FIG. 27 is a cross sectional side view diagram of an embodiment of a securing mechanism 72 for a replaceable tray 32 or 42 and a receptacle 30 or 40. In this embodiment, the securing mechanism 72 includes securing hardware 76, a hollow tube as part of the tray 32 or 42, and an embedded nut or threaded hole in the receptacle 30 or 40.

As an example, a screw or bolt passes through the tube of the tray 32 or 42 and engages the nut or threaded hole in the receptacle 30 or 40. When tightened, the screw or bolt, via the nut or threaded hole, secures the tray 32 or 42 to the receptacle 30 or 40. Note that the length of the tube is less than the height of the tray 32 or 42 such that it is below the surface of the mound fill material. In this instance, the securing mechanism 72 may further include a plug 74 to cap the tube. The plug 74 may be of a compressible material such that, if exposed through the surface of the mound fill material, it has minimal adverse affect on the use of the mound. As an alternative to a nut and bolt, the securing hardware 76 may be a cam lock, a key lock, and/or any other type of hardware that secures one surface to another.

Figure 28:
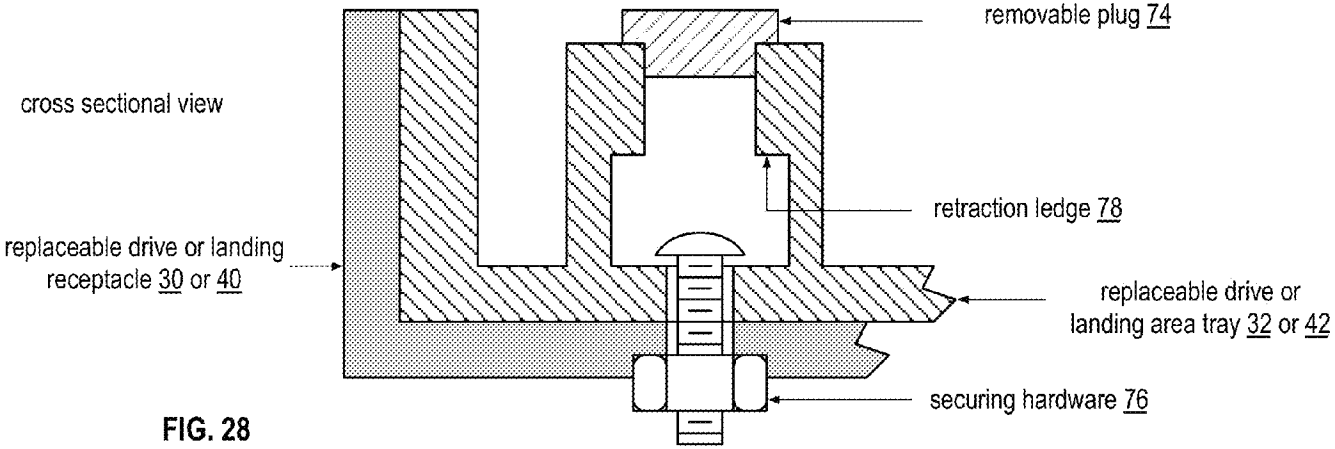
FIG. 28 is a cross sectional side view diagram of an embodiment of a securing mechanism and a retraction mechanism for a replaceable tray and receptacle of the sloped area or of the level area of a pitching mound in accordance with the present invention.

FIG. 28 is a cross sectional side view diagram of an embodiment of a securing mechanism 72 for a replaceable tray 32 or 42 and a receptacle 30 or 40. In this embodiment, the securing mechanism 72 includes securing hardware 76, a hollow tube as part of the tray 32 or 42, and an embedded nut or threaded hole in the receptacle 30 or 40. The hollow tube includes a retraction ledge 78. The securing hardware 76 secures the tray to the receptacle as discussed in FIG. 27.

Figure 29:
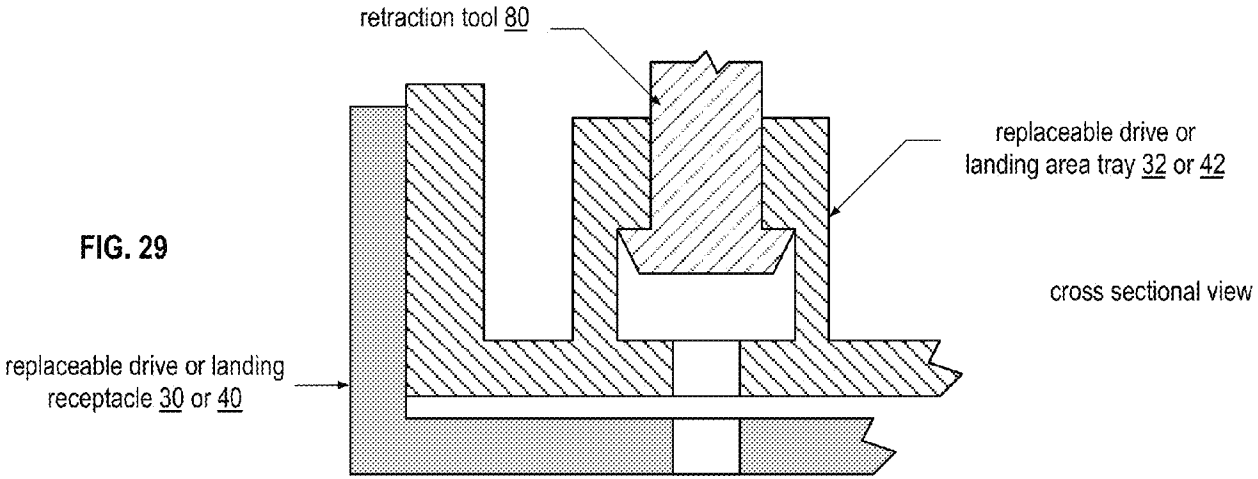
FIG. 29 is a cross sectional side view diagram of another embodiment of a securing mechanism and a retraction mechanism for a replaceable tray and receptacle of the sloped area or of the level area of a pitching mound in accordance with the present invention.

FIG. 29 is a cross sectional side view diagram of another embodiment of a securing mechanism 72 for a replaceable tray 32 or 42 and a receptacle 30 or 40. In this embodiment, the securing mechanism 72 includes securing hardware 76, a hollow tube as part of the tray 32 or 42, and an embedded nut or threaded hole in the receptacle 30 or 40. In this diagram, the securing hardware 76 has been removed and a retraction tool 80 has been inserted into the hollow tube to engage the retraction ledge 78. The retraction tool 80 may include a spring-loaded tip that expands to engage the retraction ledge once the tool is inserted a sufficient distance. Alternatively, the tip of the retraction tool may be automated to engage the retraction ledge, may be a cable pull mechanism to engage the retraction ledge, etc.

Figure 30:
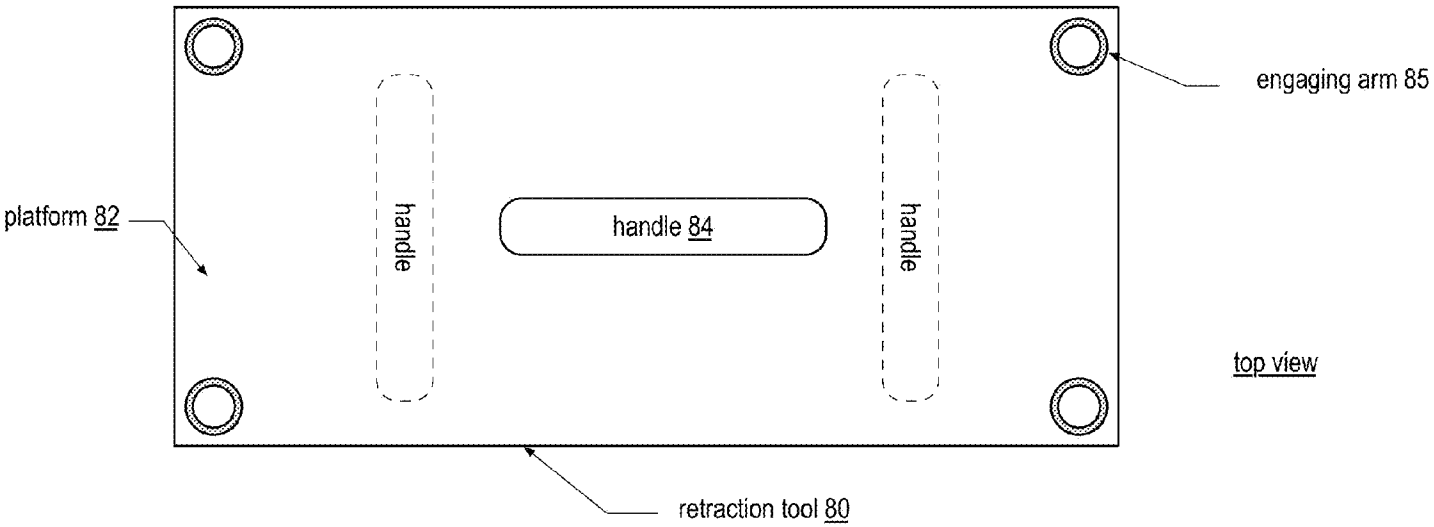
FIG. 30 is a top view diagram of an embodiment of a retraction tool in accordance with the present invention.

FIG. 30 is a top view diagram of an embodiment of a retraction tool 80 that includes a platform 82, a handle 84, and engaging arms 85. The engaging arms 85 are secured to the platform 82 in one of a variety of ways (e.g., screwed, welded, glued, fabricated into, etc.) and are positioned to align with the hollow tubes of the tray 32 or 42. The handle 84, which may include multiple handles, is also secured to the platform 82.

Figure 31:
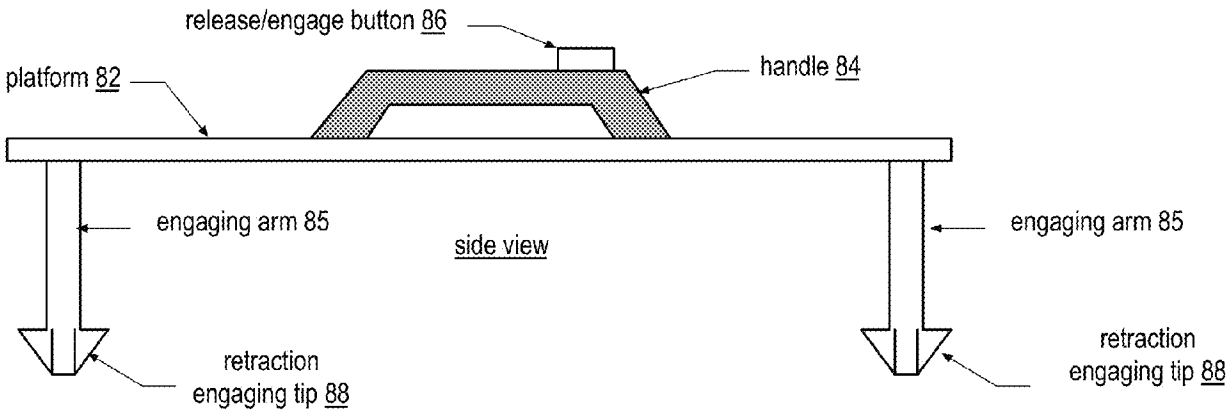
FIG. 31 is a side view diagram of an embodiment of a retraction tool in accordance with the present invention.

FIG. 31 is a side view diagram of an embodiment of a retraction tool 80 that includes a platform 82, a handle 84, and engaging arms 85. Each of the engaging arms 85 include an engaging tip 88, which may be spring loaded, hydraulic, motorized, a cable pull mechanism, etc. The handle 84 includes a release/engage button 86, which, when activated, retracts the engaging tips 88 and, when deactivated, extends the engaging tips, or vise versa. As such, when the engaging tips 88 are retracted, they readily pass through the hollow tubes of the tray. When the engaging tips are extended, they engage the retraction ledge in the hollow tubes to facilitate extraction of the tray from the receptacle.

Figure 32:
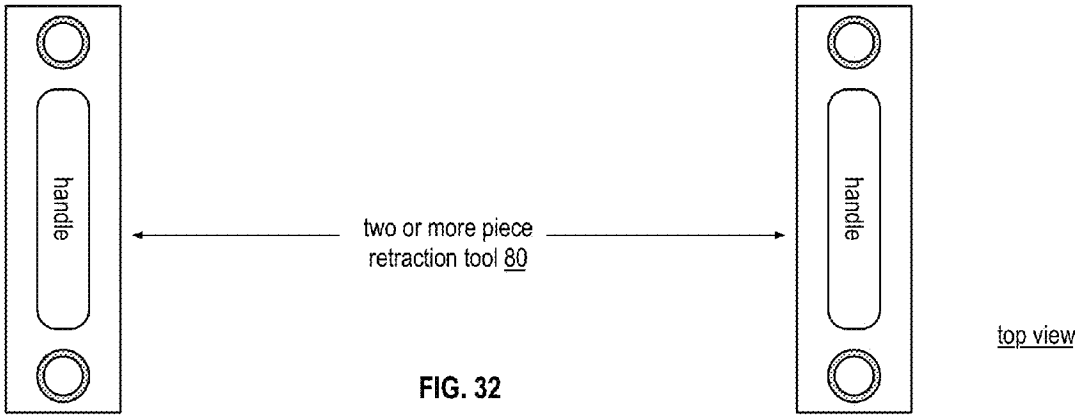
FIG. 32 is a top view diagram of another embodiment of a retraction tool in accordance with the present invention.
Figure 33:
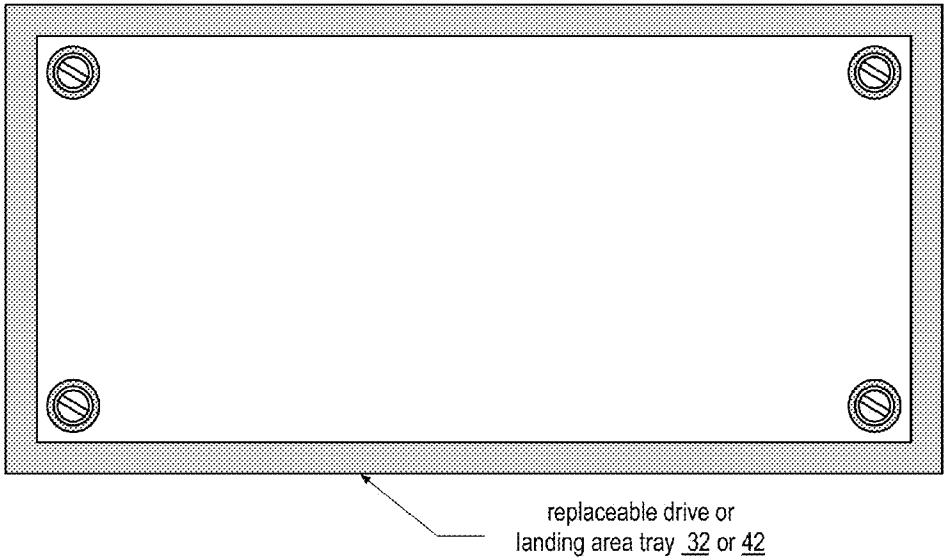
FIG. 33 is a cross sectional side view diagram of an embodiment of a replaceable tray with a securing mechanism for the sloped area or the level area of a pitching mound in accordance with the present invention.

FIG. 32 is a top view diagram of another embodiment of a retraction tool 80 that includes multiple sections (two shown, but could include more). Each section includes a handle and one or more engaging arms and each handle includes a release/engage button 86 to facilitate extraction of the tray from the receptacle. FIG. 33 is a repeat of FIG. 26, but is included with FIG. 32 to illustrate aligning the engaging arms with the hollow tubes of the tray 32 or 42.

Figure 34:
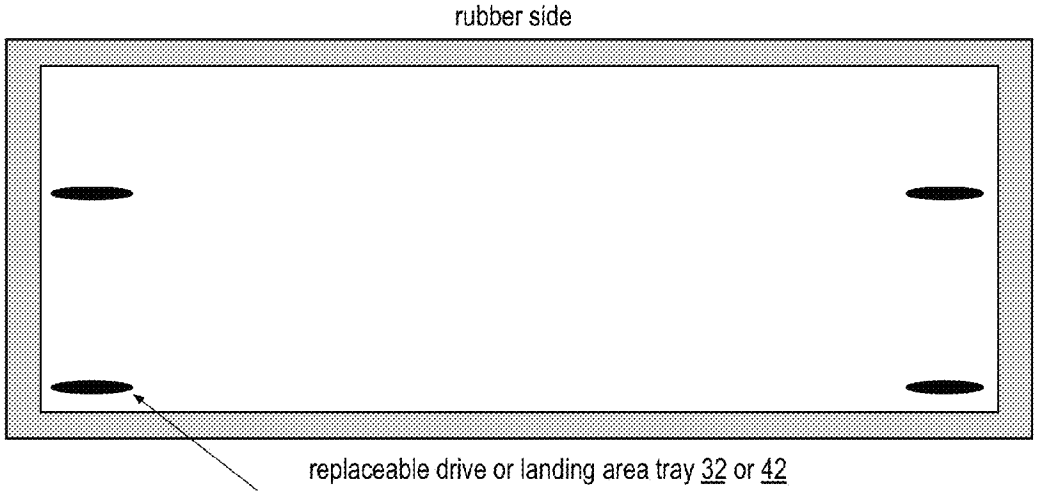
FIG. 34 is a top view diagram of another embodiment of a replaceable tray with a retraction mechanism for the sloped area or the level area of a pitching mound in accordance with the present invention.

FIG. 34 is a top view diagram of another embodiment of a replaceable tray 32 or 42 with a retraction mechanism. In this embodiment, the retraction mechanism includes a plurality of eyehooks 90, or the like. The eyehooks 90 are positioned at the perimeter of the tray 32 or 42 as to minimize interference with normal use of the mound. While four eyehooks 90 are shown, a tray may include more or less than four eyehooks 90.

Figure 35:
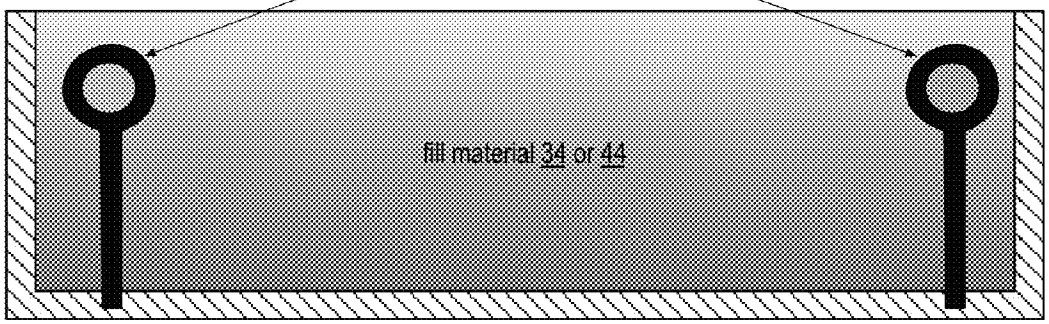
FIG. 35 is a cross sectional side view diagram of another embodiment of a replaceable tray with a retraction mechanism for the sloped area or the level area of a pitching mound in accordance with the present invention.

FIG. 35 is a cross sectional side view diagram of another embodiment of a replaceable tray 32 or 42 with eyehooks 90, or the like, as the retraction mechanism. In this diagram, the eyehooks 90 are secured to the base of the tray 32 or 42 (e.g., screwed, welded, glued, fabricated into the tray, etc.). The eyehooks 90 are positioned below the surface of the fill material 34 or 44.

When the tray 32 or 42 is to be replaced, the fill material 34 or 44 is dug out to expose the eye part of the eyehooks 90. With an extraction tool, the eyehooks are engaged and the tray is extracted. Note that the eye part of the eyehooks 90 may be angled to facilitate access.

In a further embodiment, a chain, cord, string, etc., may be connected between two of the eyehooks 90 and buried below the surface of the fill material 34 or 44. When the tray 32 or 42 is to be replaced, the fill material is dug out to expose the chain, cord, string, etc., which is used to extract the tray.

Figure 36:
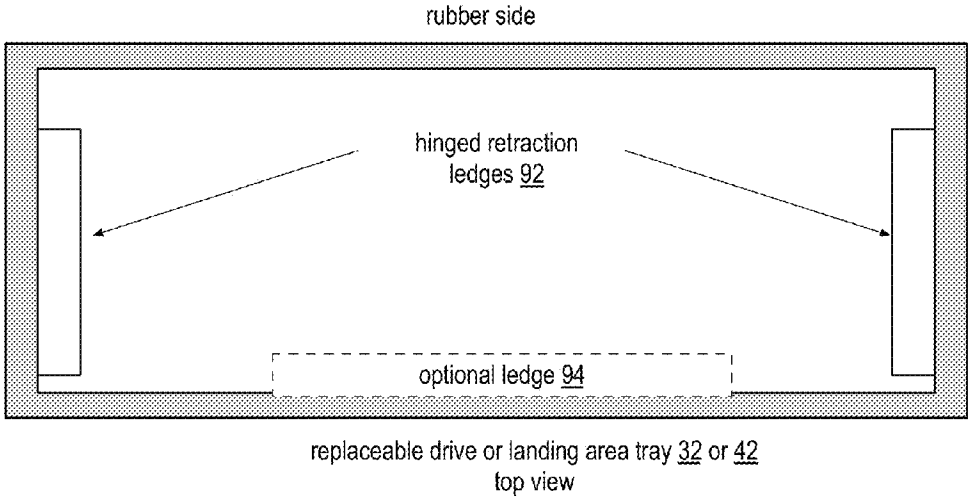
FIG. 36 is a top view diagram of another embodiment of a replaceable tray with a retraction mechanism for the sloped area or the level area of a pitching mound in accordance with the present invention.

FIG. 36 is a top view diagram of another embodiment of a replaceable tray 32 or 42 with a retraction mechanism. In this embodiment, the retraction mechanism includes one or more hinged retraction ledges 92 and 94. The ledges 92-94 are positioned in corners to minimize interference with normal use of the mound. Further, the ledges may encircle the inner circumference of the tray 32 or 42 or a portion thereof. With the ledges being hinged, they are placed in the down position (as shown) during normal use of the tray.

As an alternative to hinged ledges, the ledges may be fixed. For example, the ledges 92-94 may be at approximately a 90-degree angle with respect to the slides of the tray. The ledges may be made of the same material as the tray or of a different material and may be secured to the tray via welding, hardware, glue, etc.

Figure 37:
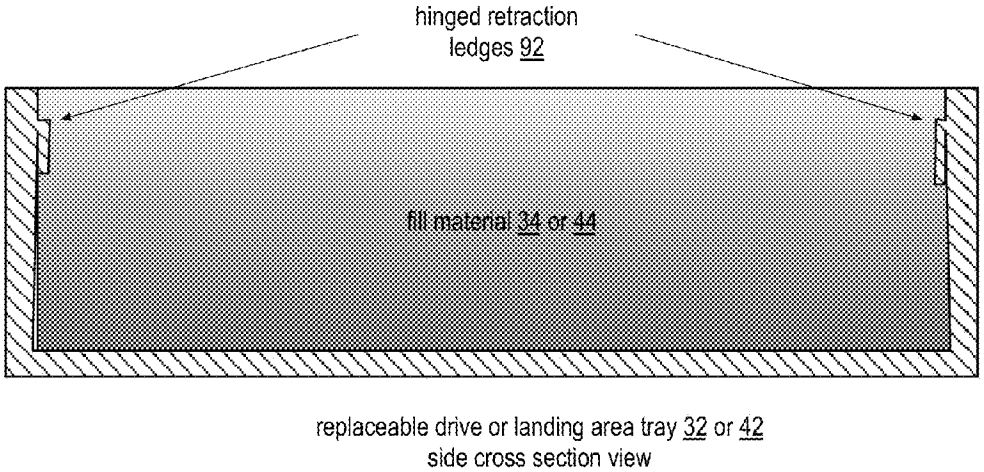
FIG. 37 is a cross sectional side view diagram of another embodiment of a replaceable tray with a retraction mechanism for the sloped area or the level area of a pitching mound in accordance with the present invention.

FIG. 37 is a cross sectional side view diagram of another embodiment of a replaceable tray 32 or 42 with ledges 92-94 as the retraction mechanism. In this view, the ledges 92-94 are shown in the down position and are below the surface of the fill material 34 or 44 (e.g., ¼ to 1 inch below the surface). Being relatively close to the surface of the fill material allows for easy access when the tray is to be removed.

Figure 38:
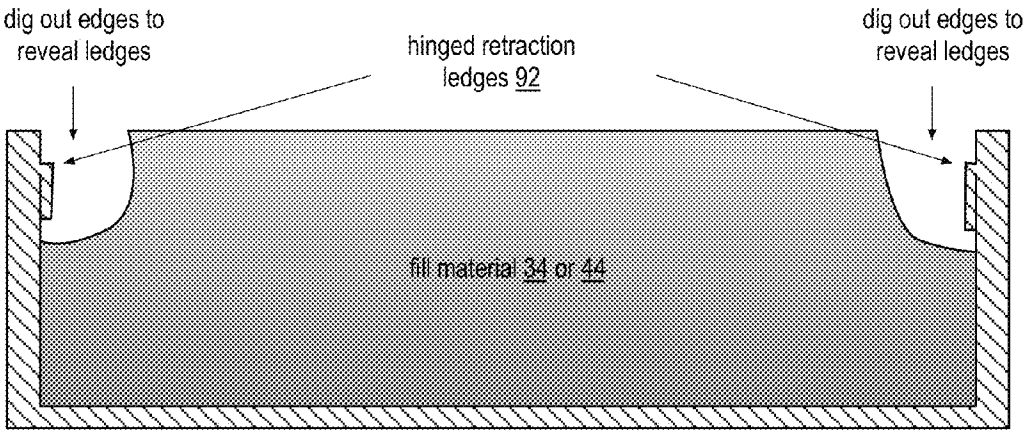
FIG. 38 is a cross sectional side view diagram of another embodiment of a replaceable tray with a retraction mechanism for the sloped area or the level area of a pitching mound in accordance with the present invention.
Figure 39:
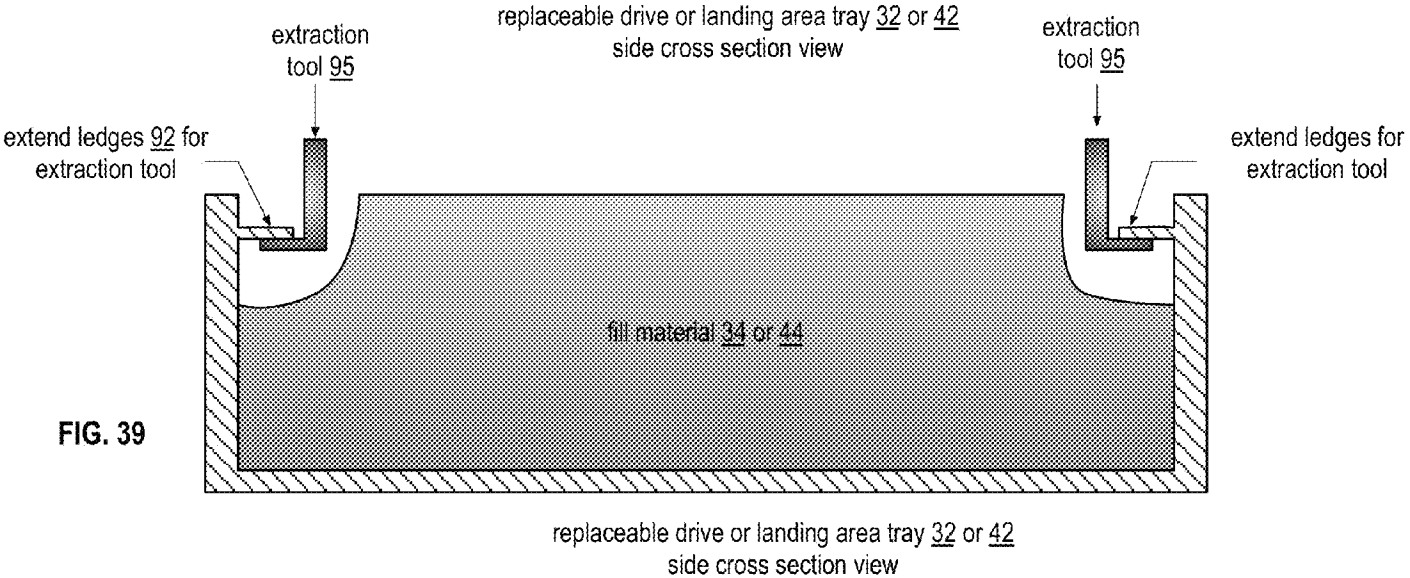
FIG. 39 is a cross sectional side view diagram of another embodiment of a replaceable tray with a retraction mechanism and retraction tool for the sloped area or the level area of a pitching mound in accordance with the present invention.

FIGS. 38 and 39 are cross sectional side view diagrams of example of extraction a replaceable tray 32 or 42 that includes ledges 92-94 as the retraction mechanism. When the tray is to be removed, the fill material 34 or 44 around the ledges 92-94 is dug out to reveal the ledges 92 as shown in FIG. 38. Once the fill material is dug out, the hinged ledges are extended to an approximate 90-degree angle from the sides of the tray. With the ledges 92 extended, an extraction tool 95 engages the ledges to facilitate extraction of the tray.

Figure 40:
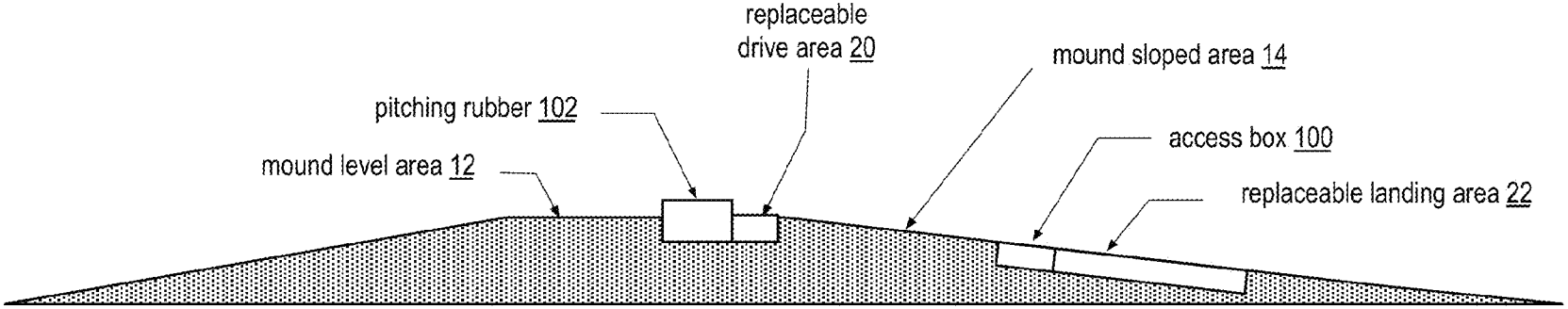
FIG. 40 is a side view diagram of another embodiment of a pitching mound in accordance with the present invention.

FIG. 40 is a side view diagram of another embodiment of a pitching mound 10 that includes a level area 12, a sloped area 14, a surrounding area 16, a pitching rubber 102, a replaceable drive area 20, a replaceable landing area 22, and an access box 100. The pitching mound 10 is positioned on a baseball field and has dimensions per baseball rules as previously discussed.

The level area 12 includes a pitching rubber 102 and a replaceable drive area 20. The replaceable drive area 20 may reside in front of the pitching rubber 102 or it may include the pitching rubber 102. In addition, the replaceable drive area 20 includes a replaceable drive tray 32 and a drive area receptacle 30. The pitching rubber 102 includes an open for housing mechanisms to enable securing and/or retracting the replaceable drive tray 32 to/from the drive area receptacle 40.

The sloped area 14 includes a replaceable landing area 22 and an access box 100. The replaceable landing area 22 is positioned within the sloped area 14 to accommodate the landing foot of most pitchers. In general, the replaceable landing area 22 includes a replaceable tray 42 and a landing area receptacle 44. The landing area receptacle is embedded or fixed within the sloped area 14 of the pitching mound and is of a size to securely receive the replaceable landing tray. The access box 100 includes an open for housing mechanisms to enable securing and/or retracting the replaceable landing tray 42 to/from the landing area receptacle 40. Note that the lid 104 of the access box 100 may of material comparable to the fill material 44 (e.g., a composite material, a tray filled with fill material, etc.) or it may be below the surface of the sloped area 14. Further note that the lid 104 may be secured to the base 106 using hardware, a press fit, etc., to allow for easy access yet securing the lid 104 to the base 106.

Figure 41:
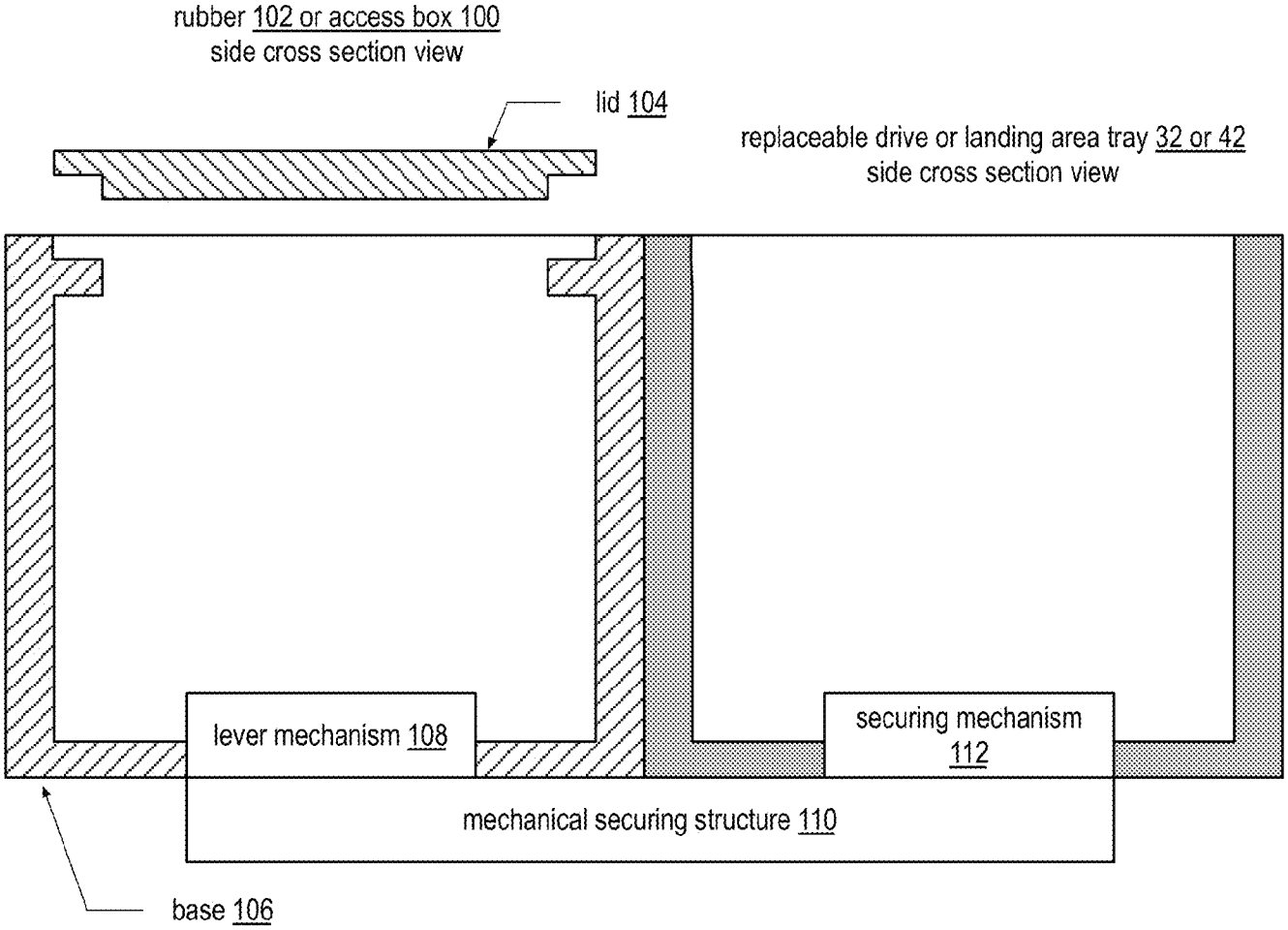
FIG. 41 is a cross sectional side view diagram of an embodiment of a securing mechanism for a replaceable tray with a rubber or access box for the sloped area or the level area of a pitching mound in accordance with the present invention.

FIG. 41 is a cross sectional side view diagram of an embodiment of a securing mechanism for a replaceable tray 32 or 42 with a rubber 102 or an access box 100. In this embodiment, the rubber 102 or access box 100 includes a base 106 (e.g., a rectangular box shape) and a lid 104. The rubber 102 or the access box 100 is juxtaposed to the tray 32 or 42.

The rubber 102 or the access box 100 includes a lever mechanism 108 of the securing mechanism (e.g., a lever, a handle, a latch, a key lock, etc.). The tray 32 or 42 includes a securing mechanism 112 (e.g., a latch, an electromagnetic circuit, a lock, a deadbolt, etc.). A mechanical securing structure 110, which may reside in the receptacle 30 or 40 or within the rubber 102, the access box 100, and/or the tray 32 or 42, couples the level mechanism 108 to the securing mechanism 112.

Figure 42:
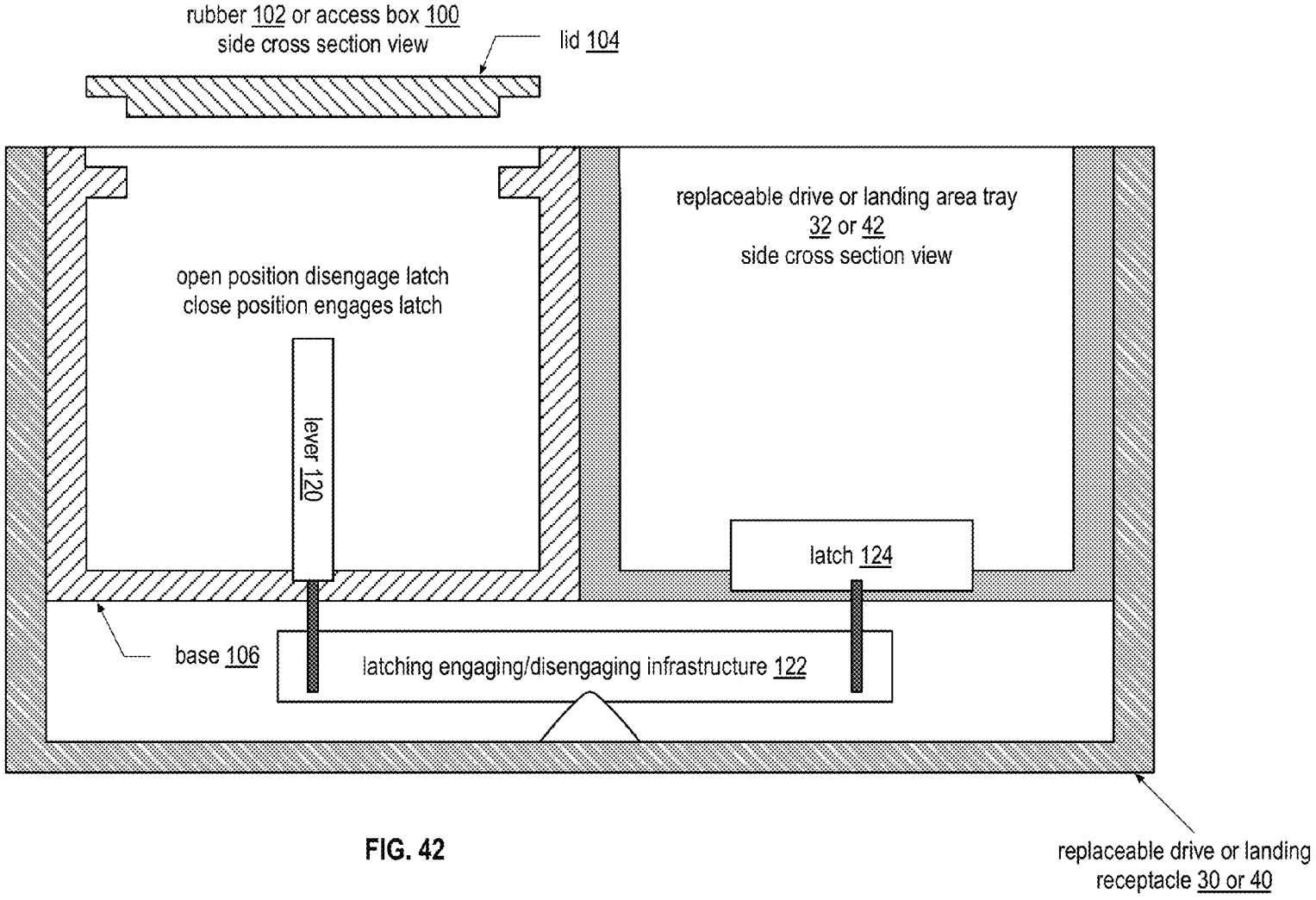
FIG. 42 is a cross sectional side view diagram of another embodiment of a securing mechanism for a replaceable tray with a rubber or access box for the sloped area or the level area of a pitching mound in accordance with the present invention.

FIG. 42 is a cross sectional side view diagram of another embodiment of a securing mechanism for a receptacle 30 or 40 and a replaceable tray 32 or 42 with a rubber 102 or an access box 100. The rubber 102 or access box 100 includes a base 106 (e.g., a rectangular box shape) and a lid 104 and is juxtaposed to the tray 32 or 42.

The rubber 102 or the access box 100 includes a lever 120, which engages a latching engaging/disengaging infrastructure 122 of the receptacle 30 or 40. The tray 32 or 42 includes a latch 124 (e.g., spring latch, a slam latch, a cam lock latch, a Norfolk latch, a Suffolk latch, a crossbar latch, a cabin hook latch, a bolt lock latch, a compression latch, etc.).

In an example of operation, with the lid 104 removed, the lever 120 is accessible and may be placed in a first position (e.g., up, open, etc.) to disengage the latch 124 from the latch engaging/disengaging infrastructure 122. When the lever 120 is in a second position (e.g., down, closed, etc.), the latch 124 is engaged by the latch engaging/disengaging infrastructure 122. Note that the latch engaging/disengaging infrastructure 122 is dependent upon the type of latch used for latch 124. For example, if the latch 124 is a spring latch, the latch engaging/disengaging infrastructure 122 will include a corresponding receptacle.

In an alternate implementation, the latch engaging/disengaging infrastructure 122 includes a latch and the latch 124 of the tray includes a corresponding latch receptacle. For instance, the latch engaging/disengaging infrastructure 122 may include a spring latch at its end corresponding to the tray and the latch 124 includes the corresponding receptacle.

Figure 43:
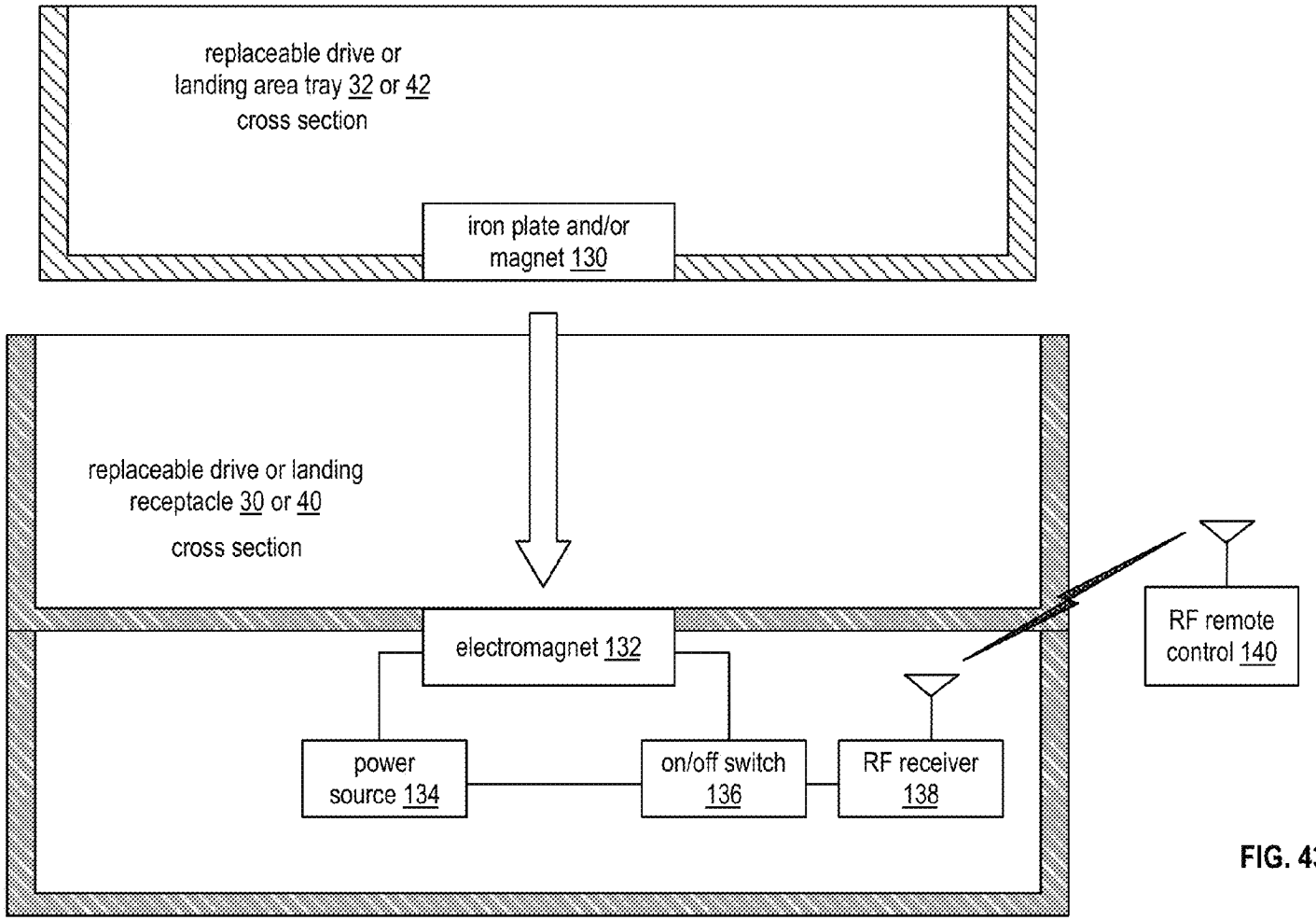
FIG. 43 is a cross sectional side view diagram of another embodiment of a securing mechanism for a replaceable tray and a receptacle for the sloped area or the level area of a pitching mound in accordance with the present invention.

FIG. 43 is a cross sectional side view diagram of another embodiment of a securing mechanism for a receptacle 30 or 40 and a replaceable tray 32 or 42. The receptacle 30 or 40 includes a remote controlled electromagnetic circuit and the replaceable tray 32 or 42 includes one or more iron plates and/or magnets 130. The electromagnetic circuit includes a power source 134 (e.g., AC or DC source (e.g., a battery)), an on/off switch, an electromagnet 132, and a radio frequency (RF) receiver 138.

In an example of operation, when the tray 32 or 42 is to be replaced, the RF remote control module 140 sends an RF signal to the RF receiver 138 to turn off the on/off switch 136. With the switch 136 off, current is not flowing through the electromagnet 132 and, as such, it does not produce a magnetic field. With the magnetic field "disengaged", the magnetic coupling of the iron plate or magnet 130 to the electromagnet 132 is substantially reduced making it relatively easy to remove the tray 32 or 42 from the receptacle 30 or 40.

When a tray 32 or 42 is installed in the receptacle 30 or 40, the RF remote control 140 sends another signal to turn on the on/off switch 136. With the switch 136 on, the power source 134 provides a current to the electromagnet 132, which generates a magnetic field. With the magnetic field "engaged", the magnetic coupling of the iron plate or magnet 130 to the electromagnet 132 is substantial enough to secure the tray 32 or 42 to the receptacle 30 or 40.

As an alternate embodiment, the power source 134 and the on/off switch 136 may be in the rubber 102 and the RF remote control 140 may be omitted. In this alternative embodiment, with the lid 104 removed, a person manually toggles on the on/off switch 136 to "engage" and "disengage" the magnetic field. In addition, with the power source 134 (e.g., one or more batteries) in the rubber 102, the power source is readily changeable.

Figure 44:
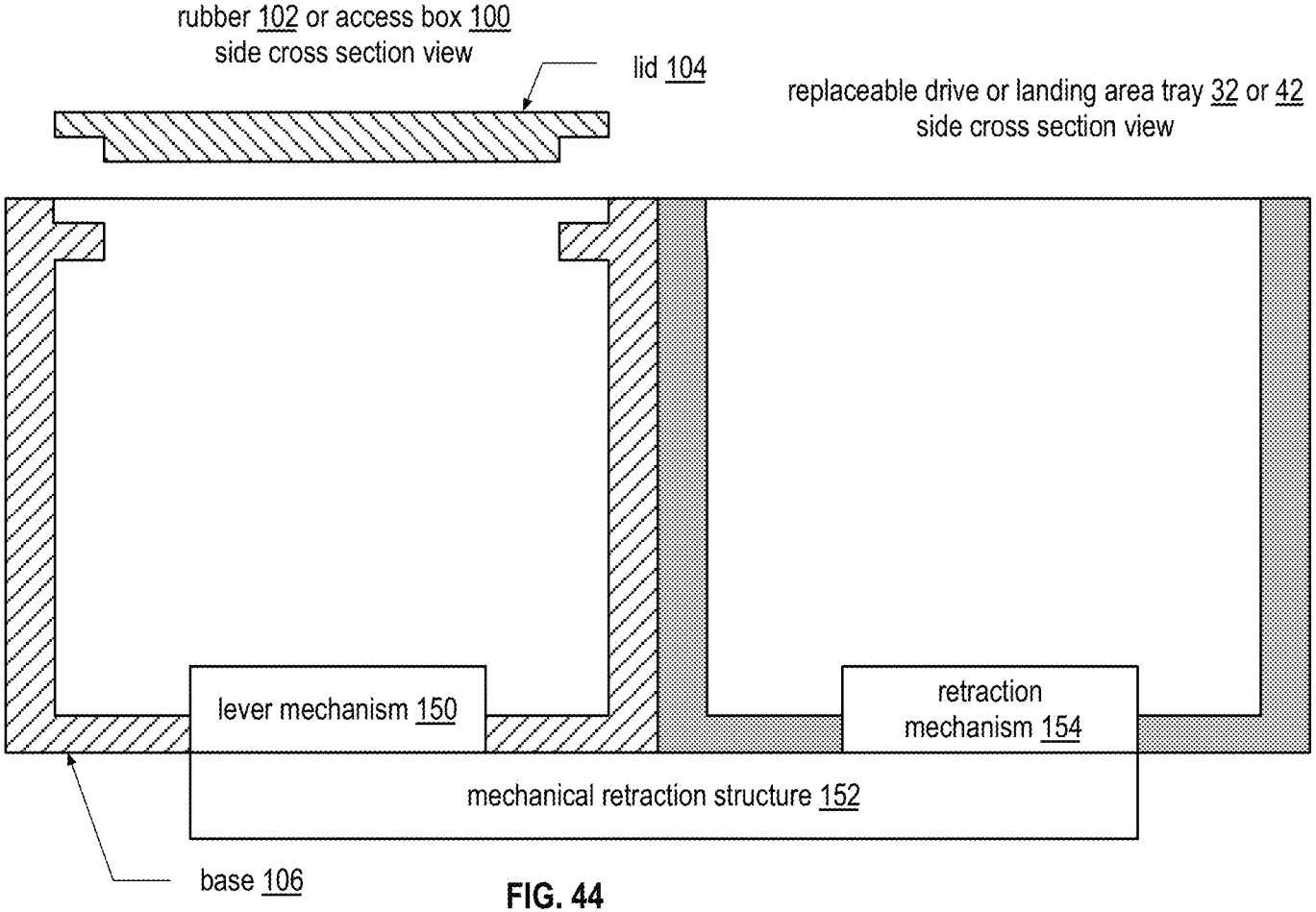
FIG. 44 is a cross sectional side view diagram of an embodiment of a retraction mechanism for a replaceable tray with a rubber or access box for the sloped area or the level area of a pitching mound in accordance with the present invention.

FIG. 44 is a cross sectional side view diagram of an embodiment of a retraction mechanism for a replaceable tray 32 or 42 with a rubber 102 or an access box 100. In this embodiment, the rubber 102 or access box 100 includes a base 106 (e.g., a rectangular box shape) and a lid 104. The rubber 102 or the access box 100 is juxtaposed to the tray 32 or 42.

The rubber 102 or the access box 100 includes a lever mechanism 150 of the retraction mechanism (e.g., a lever, a handle, a latch, a key lock, etc.). The tray 32 or 42 includes a retraction mechanism 154 (e.g., a plate, a spring, etc.). A mechanical retraction structure 154, which may reside in the receptacle 30 or 40 or within the rubber 102, the access box 100, and/or the tray 32 or 42, couples the level mechanism 150 to the retraction mechanism 154.

In an example of operation, when the level mechanism 150 is activated to retract the tray 32 or 42, it applies a force to the mechanical retraction structure 152. The applied force on the mechanical retraction structure 152 causes the retraction mechanism 154 to facilitate the retraction of the tray 32 or 42 making it relatively easy to extract the tray. For example, if the retraction mechanism 154 is a spring, when the tray is securely installed in the receptacle, the spring is compressed. When the force is applied to the mechanical retraction structure 152, the mechanical retraction structure 152 causes the spring to decompress, which pushes the tray away from the receptacle.

Figure 45:
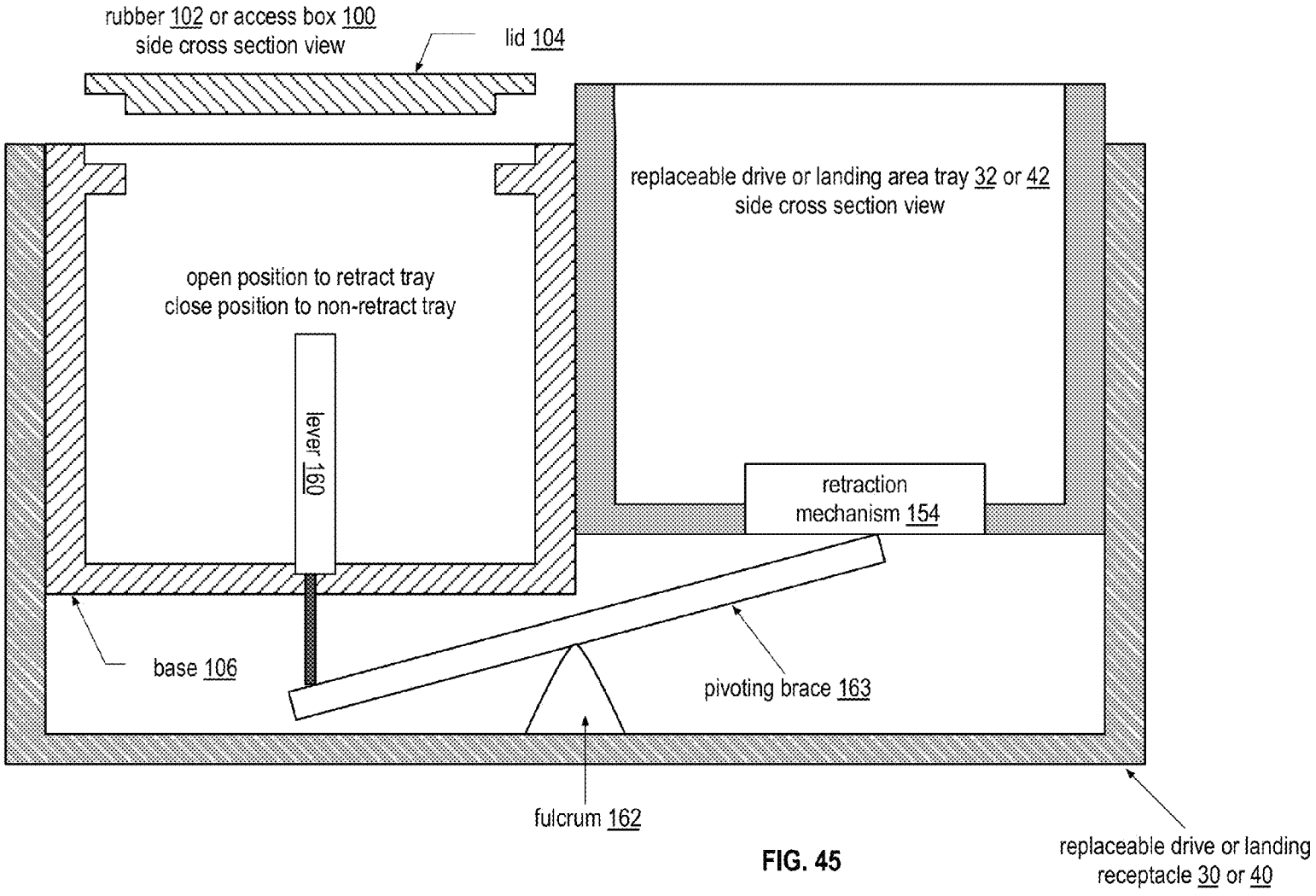
FIG. 45 is a cross sectional side view diagram of another embodiment of a retraction mechanism for a replaceable tray and a receptacle for the sloped area or the level area of a pitching mound in accordance with the present invention.

FIG. 45 is a cross sectional side view diagram of another embodiment of a retraction mechanism for a replaceable tray 32 or 42 and a receptacle 30 or 40. The rubber 102 or access box 100 includes a base 106, a lid 104, and a lever 160. The tray 32 or 42 includes the retraction mechanism 154 (e.g., a plate, a spring, etc.). The mechanical retraction structure 154 in the receptacle includes a fulcrum 162 and a pivoting brace 163.

In an example of operation, when the lever 160 is engaged to retract the tray, the lever 160 applies a force to one end of the pivoting brace 163. The pivoting brace 163 pivots with respect to the fulcrum 162 to apply a force on the retraction mechanism 154 (e.g., a plate, a mating receptacle for the pivoting brace, etc.). The force on the retraction mechanism 154 pushes the tray 32 or 42 away from the receptacle 30 or 40 thereby facilitating extraction of the tray.

The force applied to the pivoting brace 163 and to the retraction mechanism 154 are dependent on the length of the pivoting brace 163 and its position on the fulcrum 162. For instance, if the pivoting brace 163 is centered on the fulcrum 162, the force applied to the retraction mechanism 154 will be about the same as the force applied on to the pivoting brace 163. Various lever schemes and/or pulley schemes may be used to adjust the ratio of force applied to and applied by the pivoting brace 163. Note that the retraction mechanism 154 may further include springs to assist in the retraction of the tray.

Figure 46:
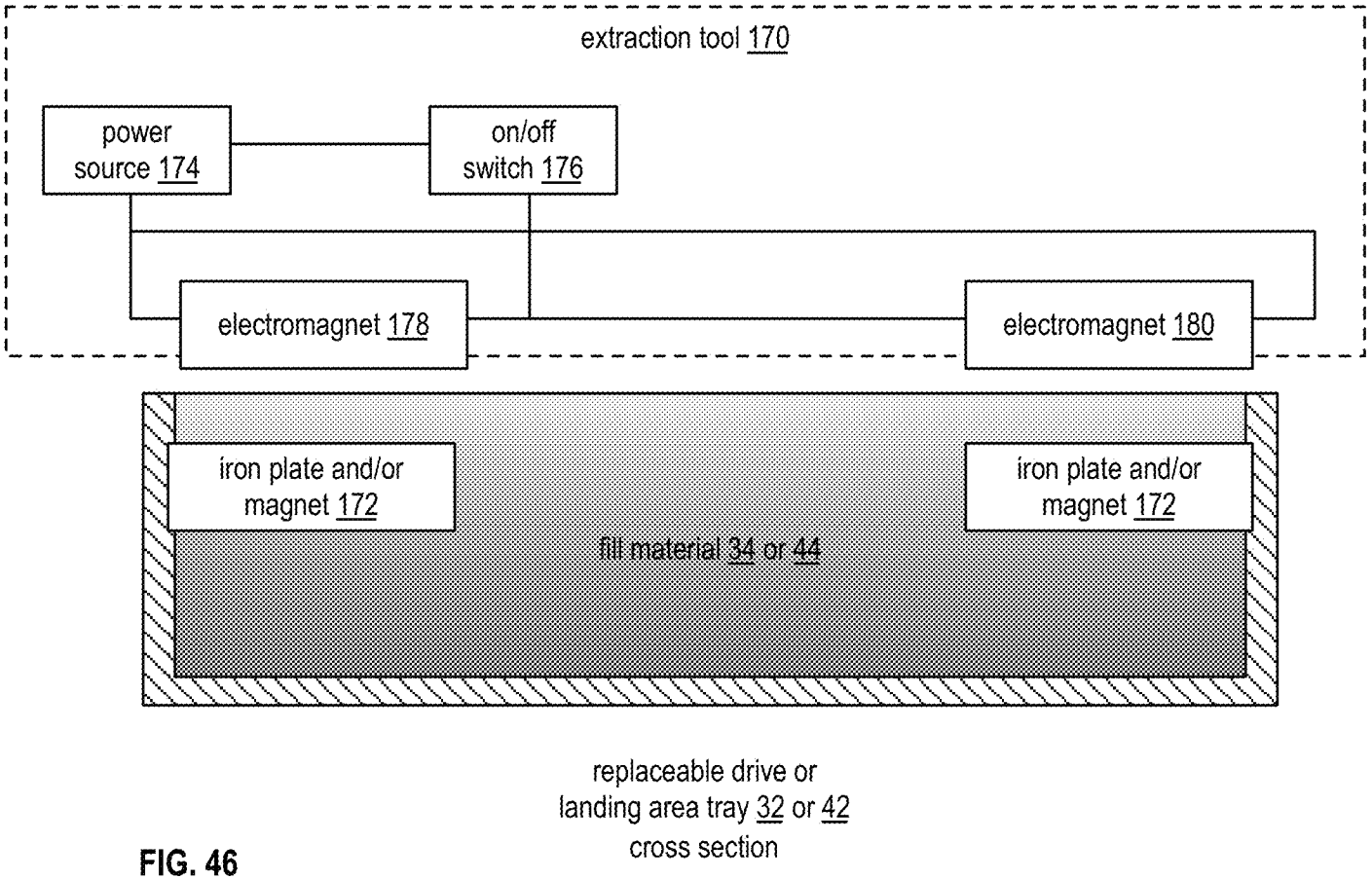
FIG. 46 is a cross sectional side view diagram of another embodiment of a retraction mechanism for a replaceable tray and receptacle for the sloped area or the level area of a pitching mound in accordance with the present invention.

FIG. 46 is a cross sectional side view diagram of another embodiment of a retraction mechanism for a replaceable tray 32 or 42 that includes an extraction tool 170. The tray 32 or 42 includes one or more iron plates and/or magnets 172 below the surface of the fill material 34 or 44. The extraction tool 170 includes a power source 174 (e.g., AC or DC), an on/off switch 176, and one or more electromagnets 178-180.

In an example of operation, when the tray 32 or 42 is to be extracted from the receptacle, the extraction tool 170 is placed proximal to the tray. Once in position, the on/off switch 176 is turned on, which causes a current to flow through the electromagnets 178-180 to create a magnetic field. With the magnetic field "engaged", the magnetic coupling of the iron plates and/or magnets 172 to the electromagnets 178-180 is substantial enough to secure the tray 32 or 42 to the extraction tool 170.

When the tray 32 or 42 has been removed, the switch 176 is turned off, thereby "disengaging" the magnetic field. With the magnetic field disengage, the magnetic coupling of the iron plates and/or magnets 172 to the electromagnets 178-180 is substantially reduced making it relatively easy to disconnect the tray 32 or 42 from the extraction tool 170. Note that the iron plates and/or magnets may be integrated into sides and/or base of the tray 32 or 42.

Figure 47:
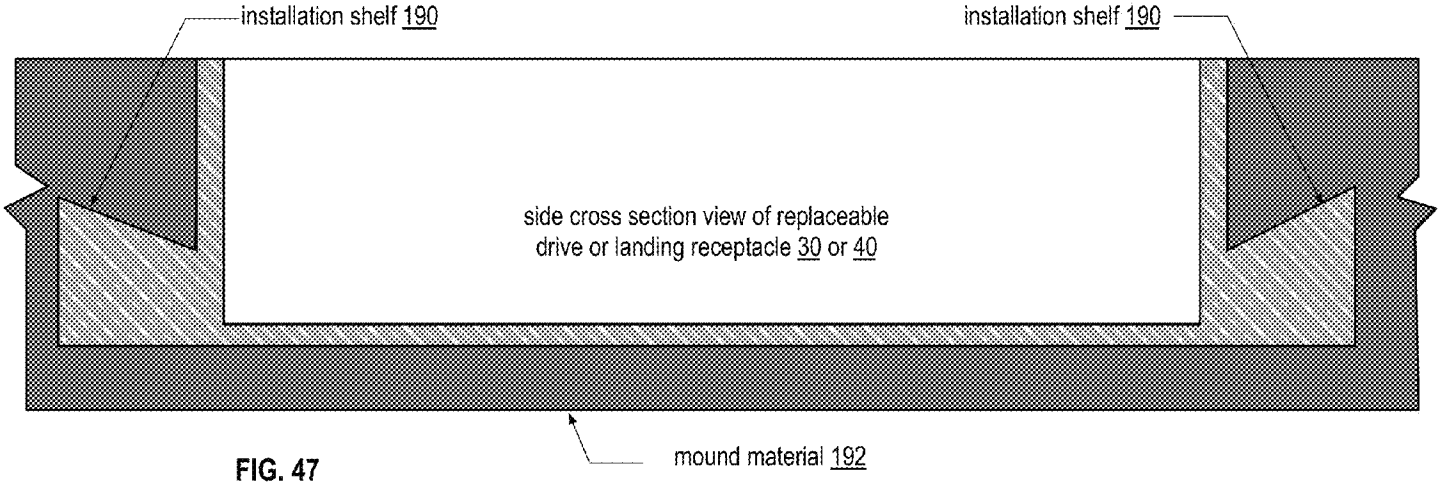
FIG. 47 is a cross sectional side view diagram of an embodiment of a receptacle for the sloped area or the level area of a pitching mound in accordance with the present invention.

FIG. 47 is a cross sectional side view diagram of an embodiment of a receptacle 30 or 40 that includes an installation shelf 190. The installation shelf may fully encircle the circumference of the receptacle 30 or 40, may partially encircle the circumference of the receptacle 30 or 40, or may be separate shelves on each side of the receptacle 30 or 40. The installation shelf 190 has an angular shape as shown.

To install the receptacle 30 or 40 into the mound 10, a hole is dug into the mound that is slightly bigger than the receptacle 30 or 40. With hole dug, the receptacle 30 or 40 is placed in the hole and the outer perimeter of the receptacle 30 or 40 is filled with mound material 192 (e.g., clay, dirt, a moisture absorbent material, a composite material, etc., and/or a combination thereof). In addition to, or in the alternative, the receptacle may be cemented into the mound, with the top portion being covered with the fill material. In this manner, the installation shelf 190 securely holds the receptacle 30 or 40 in a desired position on the mound 10.

Figure 48:
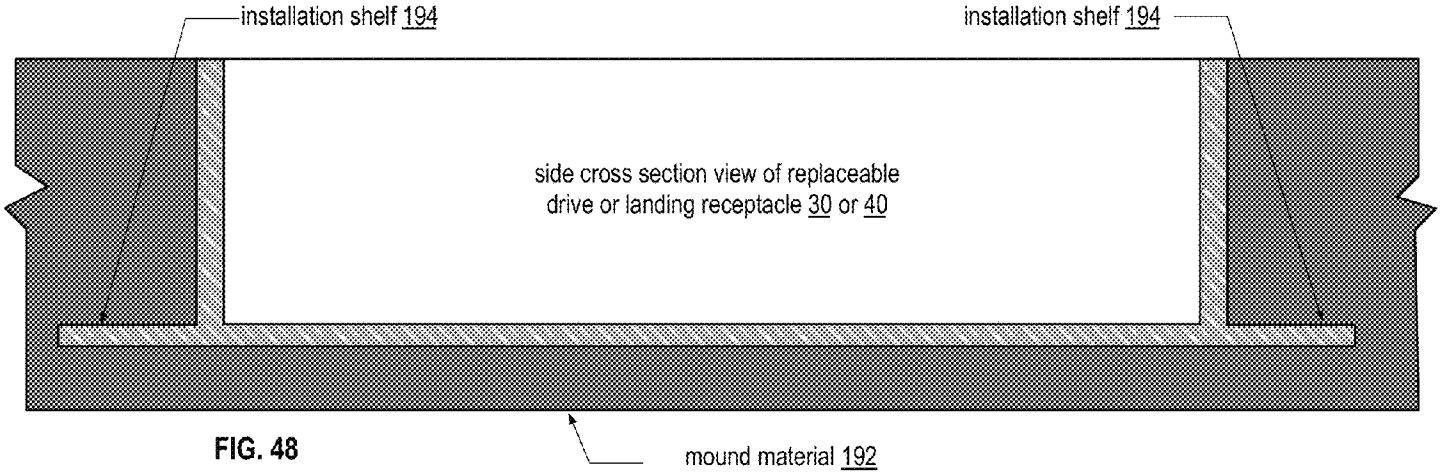
FIG. 48 is a cross sectional side view diagram of another embodiment of a receptacle for the sloped area or the level area of a pitching mound in accordance with the present invention.

FIG. 48 is a cross sectional side view diagram of another embodiment of a receptacle 30 or 40 that includes an installation shelf 190. The installation shelf may fully encircle the circumference of the receptacle 30 or 40, may partially encircle the circumference of the receptacle 30 or 40, or may be separate shelves on each side of the receptacle 30 or 40. The installation shelf 190 has a planar shape at the base of the receptacle as shown. Installation of the receptacle is as previously discussed with reference to FIG. 47.

Figure 49:
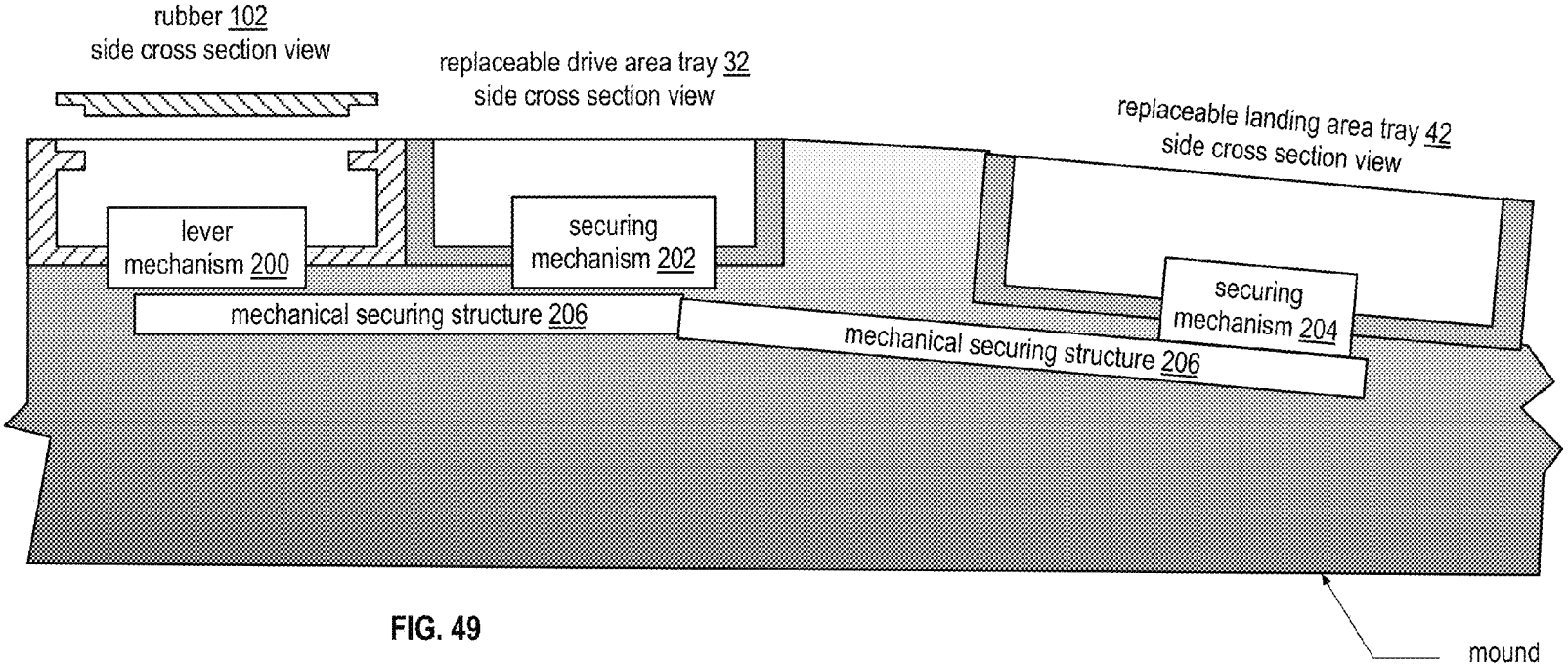
FIG. 49 is a cross sectional side view diagram of another embodiment of a securing mechanism for a replaceable tray and a receptacle for the sloped area and the level area of a pitching mound in accordance with the present invention.

FIG. 49 is a cross sectional side view diagram of another embodiment of a securing mechanism for a replaceable tray 32 or 42 and a receptacle 30 or 40. The securing mechanism includes a level mechanism 200 in the rubber 102, a first securing mechanism 202 in the drive area tray 32, a second securing mechanism 204 in the landing area tray 42, and a mechanical securing structure 206.

In an example of operation, the lever mechanism 200 (which may be embodied as previously discussed) engages or disengages the mechanical securing structure 206 (which may be embodied as previously discussed) to secure or unsecure the securing mechanisms 202 and 204 (which may be embodied as previously discussed). For example, with the lid 104 removed, the lever mechanism 200 is accessible and may be placed in a first position (e.g., up, open, etc.) to disengage latches of the securing mechanisms 202 and 204 from a latch engaging/disengaging infrastructure of the mechanical securing structure 206. When the lever mechanism 200 is in a second position (e.g., down, closed, etc.), the latches of the securing mechanisms 202 and 204 are engaged by the latch engaging/disengaging infrastructure of the mechanical securing structure 206.

Figure 50:
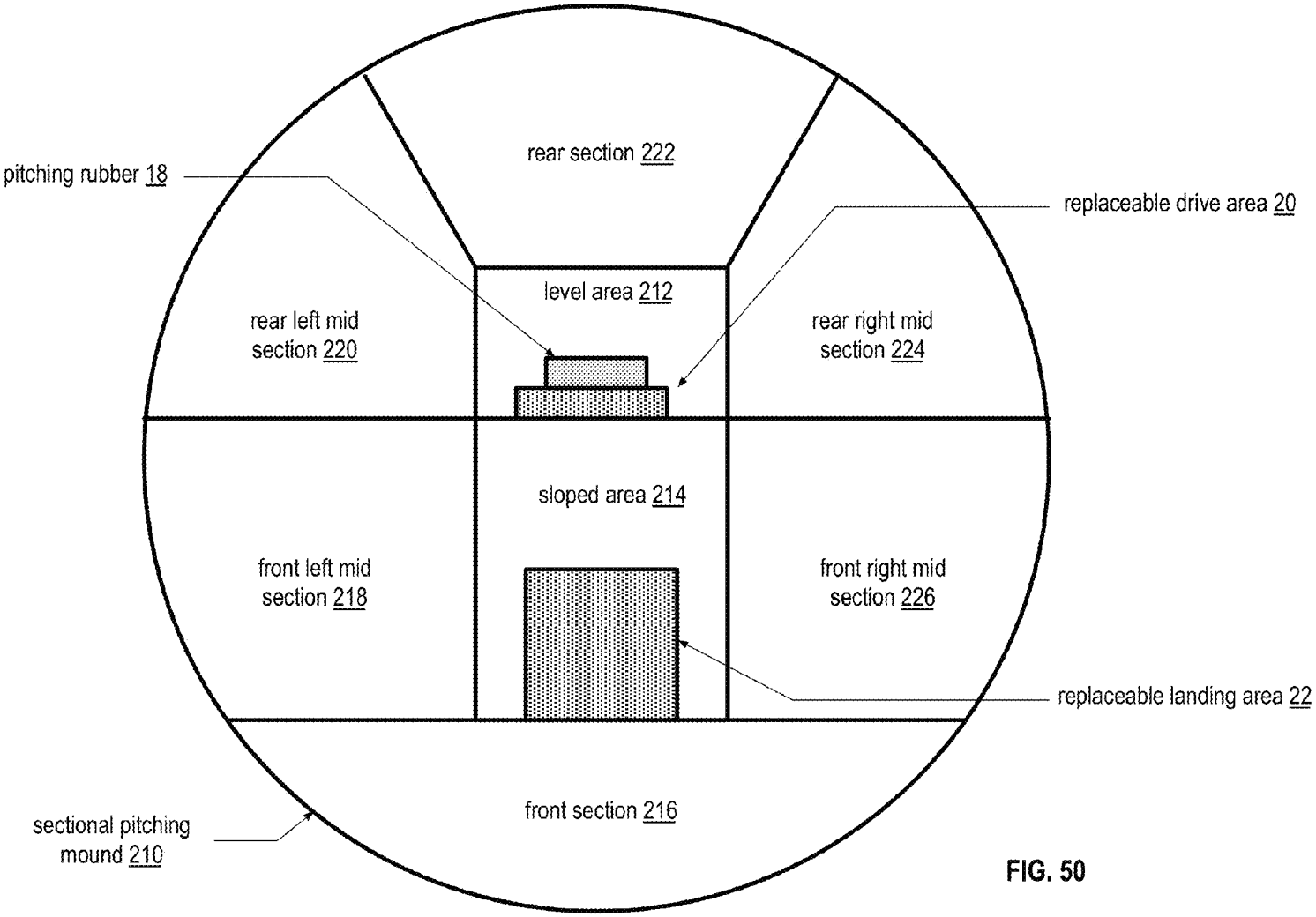
FIG. 50 is a top view diagram of an embodiment of a sectional pitching mound in accordance with the present invention.

FIG. 50 is a top view diagram of an embodiment of a sectional pitching mound 210 that includes a level area 212, a sloped area 214, and one or more surrounding areas 216-226. The level area 212 includes the pitching rubber 18 or 102 and the replaceable drive area 20; and the sloped area 214 includes the replaceable landing area 22 and may further includes the access box 100.

In the present figure, the surrounding areas includes a front section 216, a front left mid section 218, a rear left mid section 220, a rear section 222, a right rear mid section 224, and a right front mid section 226. The front left and right mid sections 218 and 226 have a side that aligns with the sloped area 214. The rear left and right mid sections 220 and 224 have a side that aligns with the level area 212.

Each of the surrounding areas 216-226 slopes from the level area 212 or from the sloped area 214 to ground level and may include a base and one or more trays to hold mound fill material. The surrounding areas 216-226, the level area 212, and the sloped area 214 connect to each other to form a unified mound that conforms to baseball rules (e.g., a diameter of 18 feet, a height of 10 inches, the level area is 34×60 inches, and the sloped area is 60×72 inches with a slope of 1 inch per foot). The connecting of the areas may be done by abutment, by track mechanisms, by hardware, etc. Note that there may be more or less surrounding areas based on ease of movement, ease of assembly, etc. Further note that once the mound 210 is assembled, it may be desirable to add and tamp mound fill material along the edges of the sections to better blend the sections together. With such a sectional mound 210, a mound that conforms to the baseball rules can be repeatedly created and recreated from baseball field to baseball field.

Figure 51:
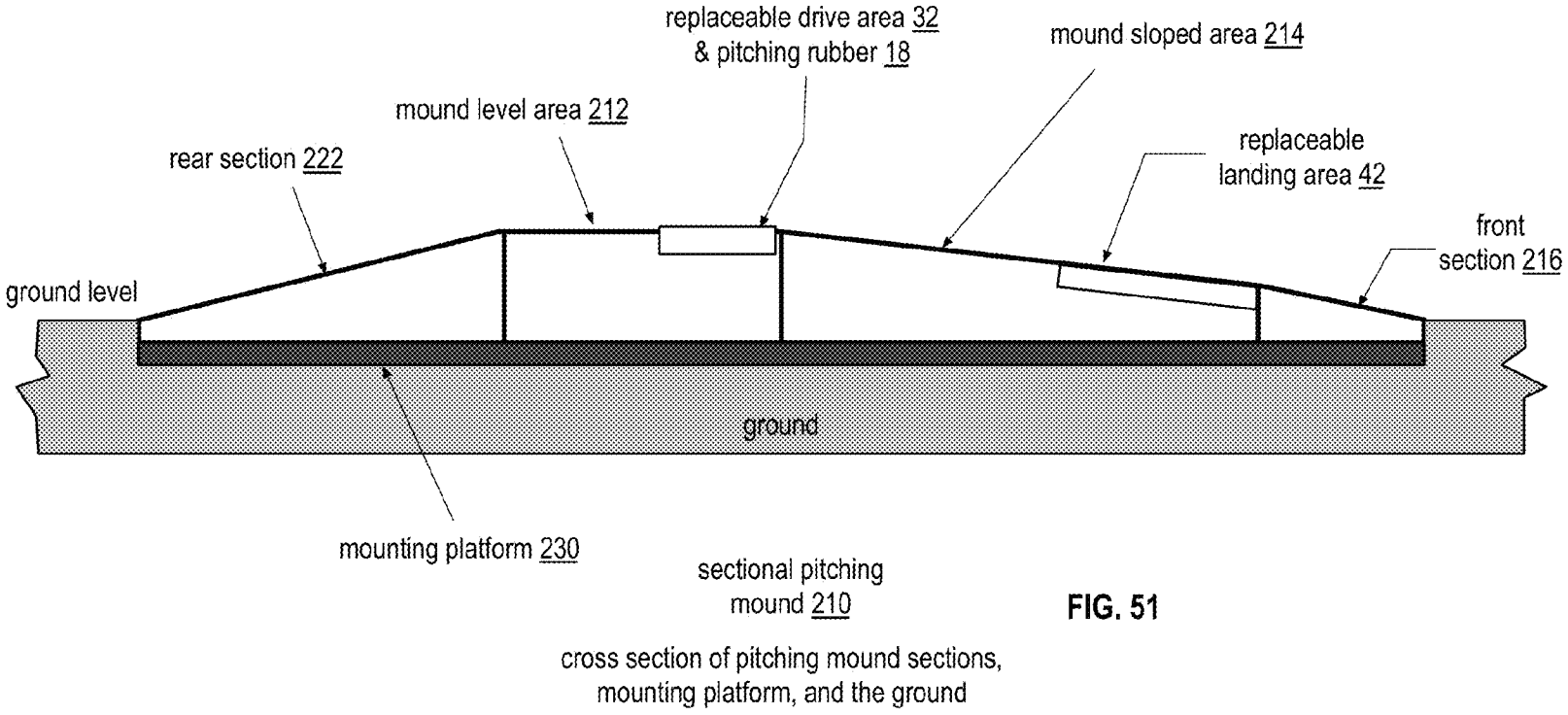
FIG. 51 is a cross sectional side view diagram of an embodiment of a sectional pitching mound in accordance with the present invention.

FIG. 51 is a cross sectional side view diagram of an embodiment of a sectional pitching mound 210 coupled to a mounting platform 230. The sectional pitching mound 210 includes the level area 212, the sloped area 214, and one or more surrounding areas 216-226. The level area 212 includes the pitching rubber 18 or 102 and the replaceable drive area 20; and the sloped area 214 includes the replaceable landing area 22 and may further includes the access box 100.

The mounting platform 230 includes a securing mechanism (e.g., mounting hardware, pins, dowels, clips, latches, etc.) and the sections 212-226 include complimentary securing mechanisms such that the sections 212-226 securely mate with the mounting platform 230. The mounting platform 230 may be 6-12 inches below ground level and may be comprised of a concrete slab, a series of concrete posts, metal, wood, plastic, fiberglass, and/or a combination thereof. If the mounting platform 230 is a contiguous piece, it may further include drainage holes.

The one or more surrounding sections 216-226 slope from the level area 212 and/or the sloped area 214 to ground level. The slope of the surround sections 216-226 may be a linear decline, curved decline, or spherical decline. Note that, from surrounding section to surrounding section 216-226, the slope may be the same or different.

As an alternative to using a mounting platform 230, each of the sections 212-226 includes one or more mounting posts to secure the section into the ground. For example, the mounting posts may be stakes that are driven into the ground to secure the section to the ground. In addition, the sections have interlocking structures (e.g., tongue and groove, clips, latches, pins, dowels, hardware, etc.) to secure the sections together. Without the mounting platform 230, it may still be desirable to dig out a hole to place the sections of the mound to further add stability to the mound 210.

Figure 52:
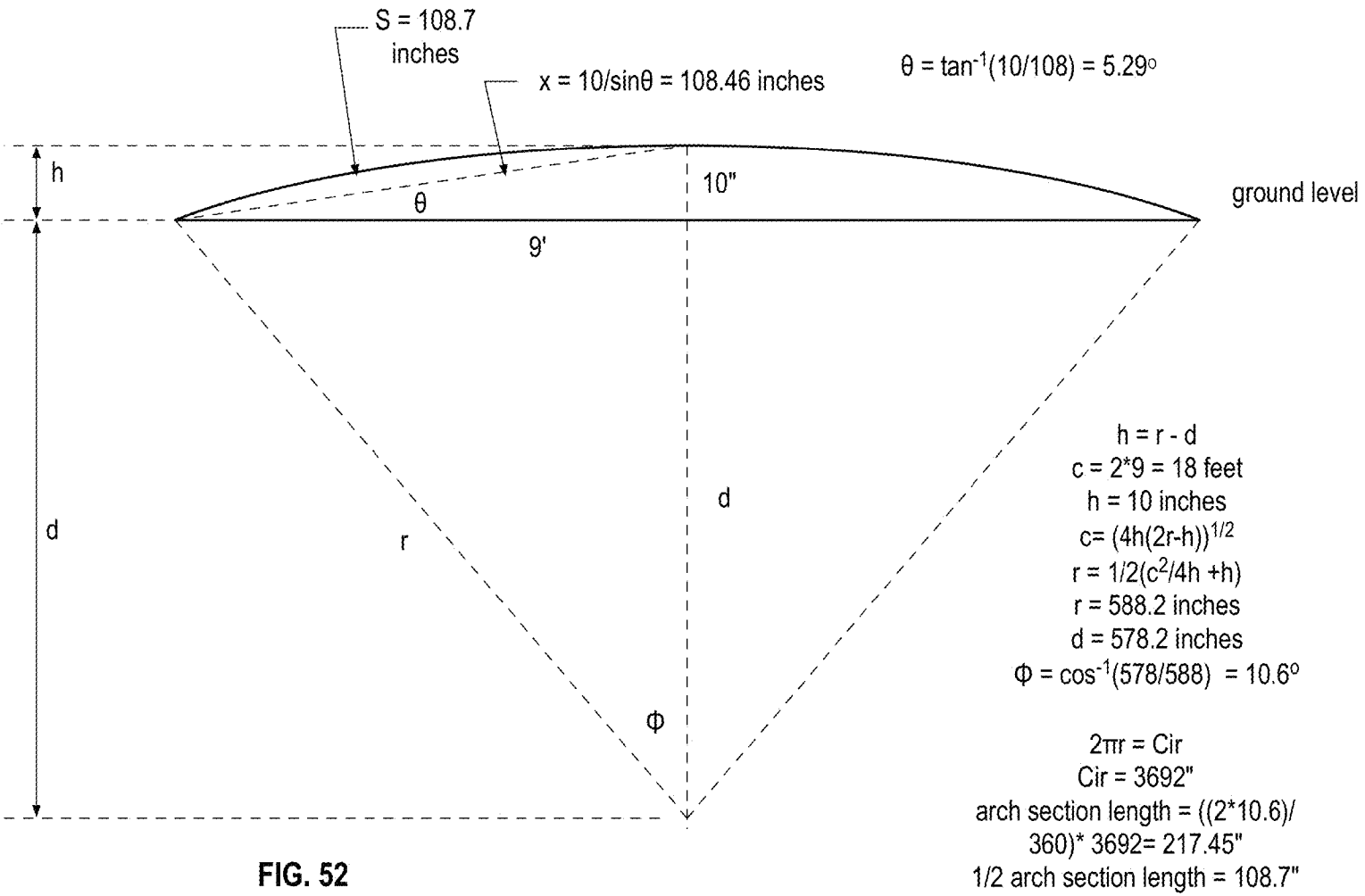
FIG. 52 is another cross sectional side view diagram of a sectional pitching mound in accordance with the present invention.

FIG. 52 is another cross sectional side view diagram of a sectional pitching mound 210 illustrating the slope of the surrounding sections 216. As shown, at the level area 212, the mound is ten inches above ground level. Assuming a circular shape (in two dimensions), the radius of the mound 210 is represented by "r", which equals d+10. Further, since the diameter of mound 210 is eighteen feet, it is given that from the center of the mound to an edge is nine feet.

Following the mathematics shown in the figure, the radius of the circle is calculated to be 588.2 inches based on the height of ten inches and the 18-foot diameter of the mound to be 588.2 inches. From this, the arch section represented by S can be calculated, which equals 108.7 inches. As such the slope for the surrounding sections, if using a spherical shape, is based on a radius of 588.2 inches and a section length S of 108.7 inches.

If a linear slope is used, the section x can be calculated using an inverse tangent function to find the angle θ, which equals 5.29 degrees. With the angle determined, a sin function may be used to determine x, which equals 108.46 inches. Given that the section length using a spherical approach is approximately equal to the linear approach, the linear approach may be slightly easier to implement for the mound sections. Nevertheless, either approach may be used to slope the surround sections 216-226 to ground level.

Figure 53:
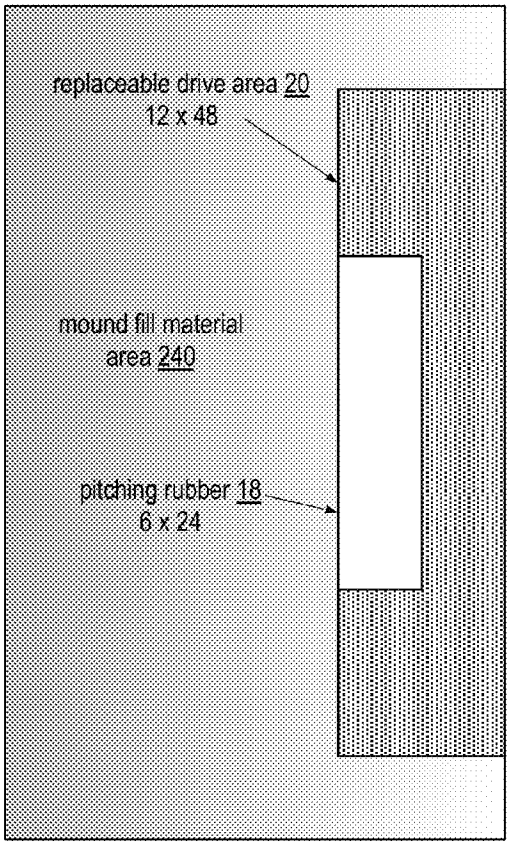
FIG. 53 is a top view diagram of an embodiment of a level area of a sectional pitching mound in accordance with the present invention.

FIG. 53 is a top view diagram of an embodiment of a level area 212 that includes the replaceable drive area 20, which may include the pitching rubber 18 or 102, and a mound fill material 240 (e.g., dirt, clay, a moisture absorbent material, a composite material, rubber, etc., and/or a combination thereof). The replaceable drive area 20 includes the replaceable drive tray 32, which mates to the drive area receptacle 30. The dimensions shown for replaceable drive area 20 may vary depending on a desired application.

Figure 54:
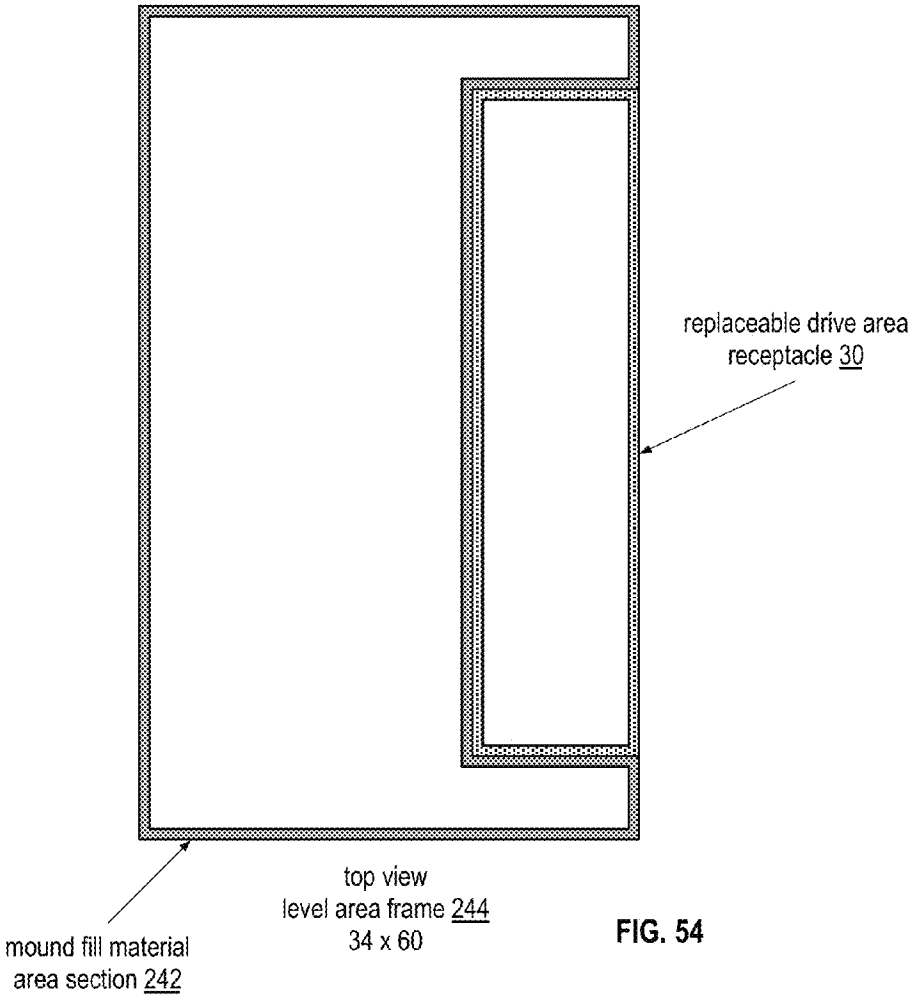
FIG. 54 is a top view diagram of an embodiment of a frame and/or receptacle of a level area of a sectional pitching mound in accordance with the present invention.

FIG. 54 is a top view diagram of an embodiment of the level area 212 without the mound fill material 240. The level area 212 includes, from a top view perspective, the replaceable drive area receptacle 30 and a mound fill material area section 240. The mound fill material section 242 may be implemented in a similar fashion as the tray 30 to securely hold the mound fill material 240 in place. Further, the mound fill section 242 may be removable to assist in the maintenance, remove, replacement, etc., of the sectional mound 210. Note that the receptacle 30 may be integrated into the mound fill section 242 or may be a separate piece.

Figure 55:
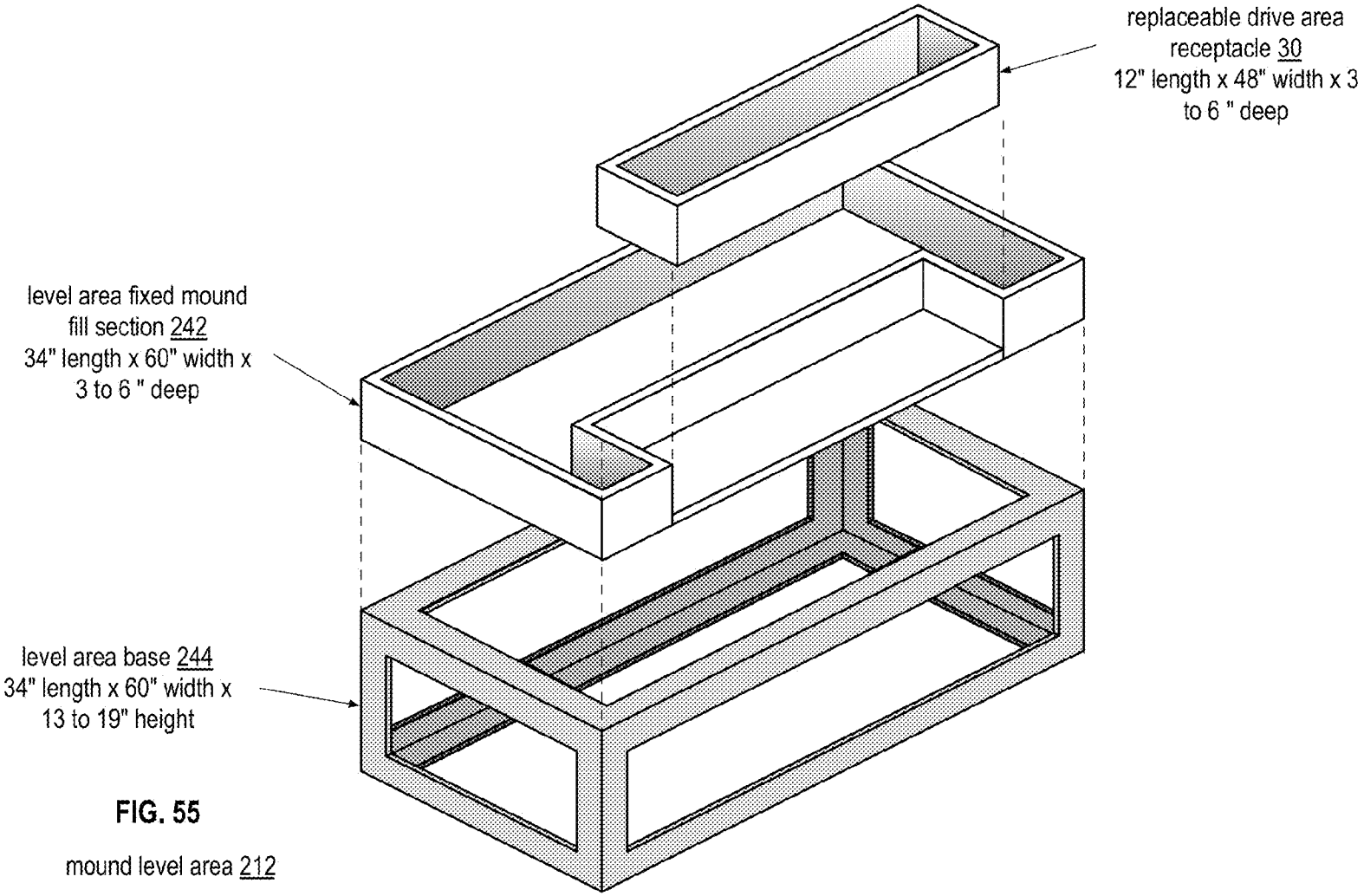
FIG. 55 is an isometric view diagram of an embodiment of a level area of a sectional pitching mound in accordance with the present invention.

FIG. 55 is an isometric view diagram of an embodiment of a level area 212 that includes a level area base 244, the level area mound fill section 242, and the drive area receptacle 30. The level area base 244 includes first securing mechanism (not shown) to secure the base 244 to the level area mound fill section 242 and second securing mechanism (not shown) to secure the base 244 to the mounting platform 230. The base 244 may further include an interlocking mechanism (not shown) to connect to adjacent sections of the sectional pitching mound 210. The securing mechanisms may be one or more of screws, nuts & bolts, latches, clips, pins, adhesives, press-fit, welding, etc., and the interlocking mechanism may include one or more of tongue & groove, a securing mechanism, aligning guides, etc.

The level area mound fill section 242 may be may be comprised of a rubber, fiberglass, plastic, carbon fiber, and/or another material that provides for some flexibility to minimize interference of use of the mound while securely holding the mound fill. Further, the level area mound fill section 242 may be fabricated in a similar manner as the replaceable tray 32 or 42 and/or the receptacle 30 or 40. For instance, the fill section 242 may include a textured interior surface, an array of fingers, and/or a flexible fringe top. In an example, the fill section 242 has dimensions of 34 inches long, 60 inches wide, and a height, or depth, of 3 to 6 inches. The fill section 242 also includes a notch for the drive area receptacle 30, which has dimensions of 12 inches long, 48 inches wide, and a height, or depth, of 3 to 6 inches. In another example, the drive area receptacle 30 is integrated into the fill section 242. Note that the fill section 242 may include a drainage feature (e.g., holes, a perforated bottom, etc.) to reduce collection of moisture.

The level area base 244 may be comprised of a metal (e.g., aluminum, steel, etc.), fiberglass, plastic, carbon fiber, and/or another material that provides a solid base. In an example that assumes the mounting platform 230 is 6 to 12 inches below ground level, the base 244 has dimensions of 34 inches long, 60 inches wide, and a height, or depth, of 13 to 19 inches depending on the depth of the fill section 242.

In an alternate embodiment, the level area 212 may omit the level area base 244 and, as such, the level area fill section 242 extends to the mounting platform 230. In this embodiment, the fill section 242 includes an appropriately sized ledge area to receive the drive area receptacle 30, which is secured into place using a securing mechanism. In addition, the fill section 242 includes a securing mechanism for securing to the mounting platform and may further include an interlocking mechanism for securing to other sections of the mound 210. In an example, the fill section 242 has dimensions of 34 inches long, 60 inches wide, and a height, or depth, of 16 to 22 inches, depending on the depth of the mounting platform 230. Note that the fill section 242 may also include a drainage feature to reduce collection of moisture.

Figure 56:
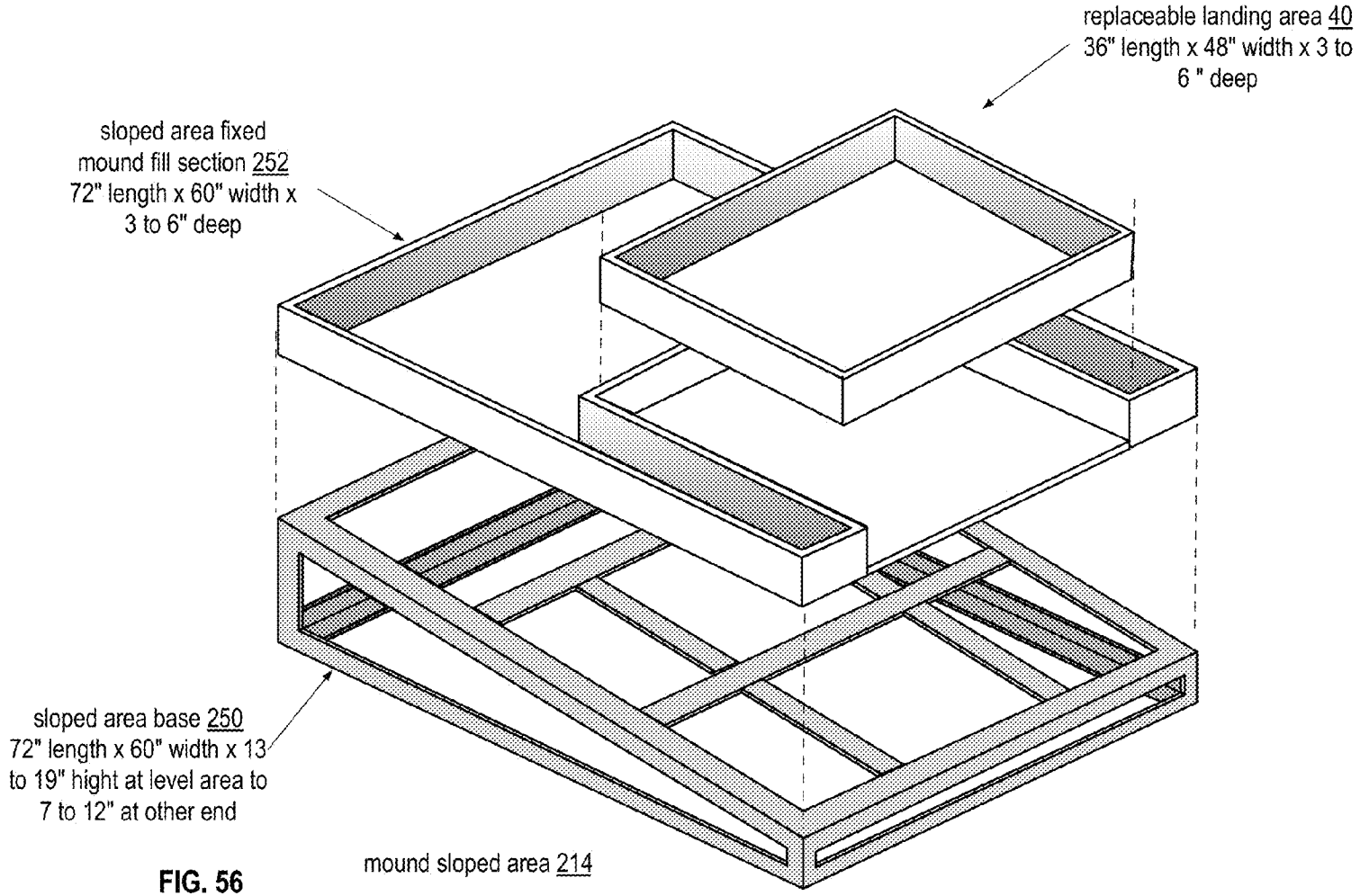
FIG. 56 is an isometric view diagram of an embodiment of a sloped area of a sectional pitching mound in accordance with the present invention.

FIG. 56 is an isometric view diagram of an embodiment of a sloped area 214 that includes a sloped area base 250, a sloped area mound fill section 252, and the landing area receptacle 40. The sloped area base 250 includes first securing mechanism (not shown) to secure the base 250 to the sloped area mound fill section 252 and second securing mechanism (not shown) to secure the base 250 to the mounting platform 230. The base 250 may further include an interlocking mechanism (not shown) to connect to adjacent sections of the sectional pitching mound 210. The securing mechanisms may be one or more of screws, nuts & bolts, latches, clips, pins, adhesives, press-fit, welding, etc., and the interlocking mechanism may include one or more of tongue & groove, a securing mechanism, aligning guides, etc.

The sloped area mound fill section 252 may be comprised of a rubber, fiberglass, plastic, carbon fiber, and/or another material that provides for some flexibility to minimize interference of use of the mound while securely holding the mound fill. Further, the sloped area mound fill section 252 may be fabricated in a similar manner as the replaceable tray 32 or 42 and/or the receptacle 30 or 40. For instance, the fill section 252 may include a textured interior surface, an array of fingers, and/or a flexible fringe top. In an example, the fill section 252 has dimensions of 72 inches long, 60 inches wide, and a height, or depth, of 3 to 6 inches. The fill section 252 also includes a notch for the landing area receptacle 40, which has dimensions of 36 inches long, 48 inches wide, and a height, or depth, of 3 to 6 inches. In another example, the landing area receptacle 40 is integrated into the fill section 252. Note that the fill section 252 may include a drainage feature (e.g., holes, a perforated bottom, etc.) to reduce collection of moisture.

The sloped area base 250 may be comprised of a metal (e.g., aluminum, steel, etc.), fiberglass, plastic, carbon fiber, and/or another material that provides a solid base. In an example that assumes the mounting platform 230 is 6 to 12 inches below ground level, the base 250 has dimensions of 72 inches long, 60 inches wide, and a height, or depth, of 13 to 19 inches at the end adjacent to the level area 212 and 7 to 12 inches at the other end, depending on the depth of the fill section 242.

In an alternate embodiment, the sloped area 214 may omit the sloped area base 250 and, as such, the sloped area fill section 252 extends to the mounting platform 230. In this embodiment, the fill section 252 includes an appropriately sized ledge area to receive the landing area receptacle 40, which is secured into place using a securing mechanism. In addition, the fill section 252 includes a securing mechanism for securing to the mounting platform 230 and may further include an interlocking mechanism for securing to other sections of the mound 210. In an example, the fill section 252 has dimensions of 72 inches long, 60 inches wide, and a height, or depth, of 16 to 22 inches at the end adjacent to the level area and 7 to 12 inches at the other end, depending on the depth of the mounting platform 230. Note that the fill section 252 may also include a drainage feature to reduce collection of moisture.

Figure 57:
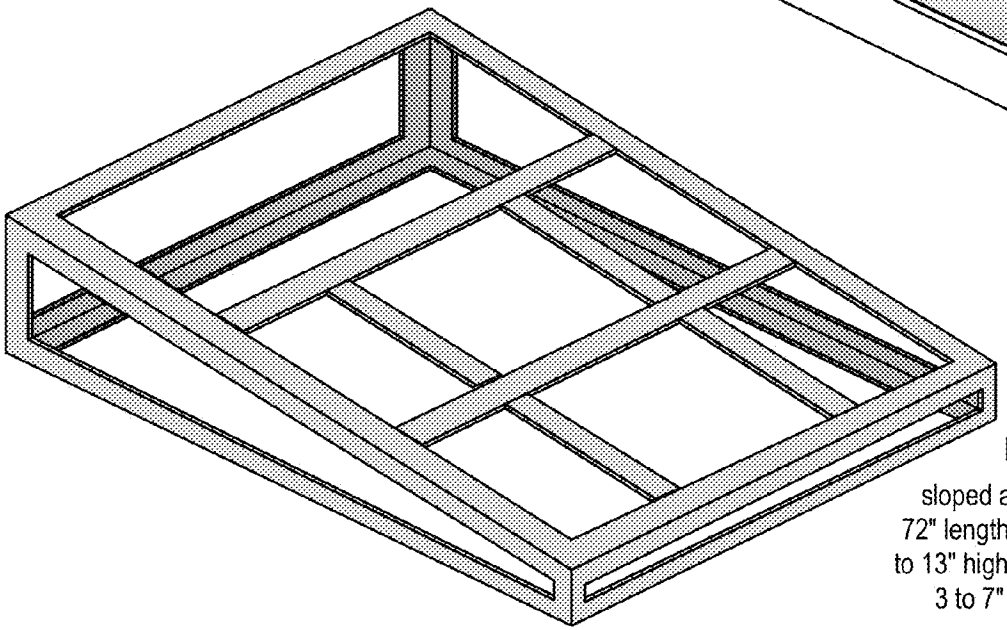
FIG. 57 is an isometric view diagram of an embodiment of a frame for a sloped area of a sectional pitching mound in accordance with the present invention.

FIG. 57 is an isometric view diagram of an embodiment of a base 250 for the sloped area 214. In this diagram, the base includes one possible structure to support the sloped area fill section 252 and the landing area receptacle 40. As shown, the base 250 may be constructed of L beams for the outer perimeter of the base and flat pieces to provide support and securing mechanism areas in the middle area of the base. In an alternate implementation, the base may a solid piece molded or fabricated from plastic, fiberglass, carbon fiber, or some other moldable material. In another alternate implementation, the base may include sheet metal (or the like) on the top of the base to provide a solid surface for mounting the fill section 252. Note that this implementation of the base 250 and/or its alternative implementations apply to any of the bases of the sectional pitching mound 210 and/or of the bullpen mounds, which are discussed in subsequent figures.

Figure 58:
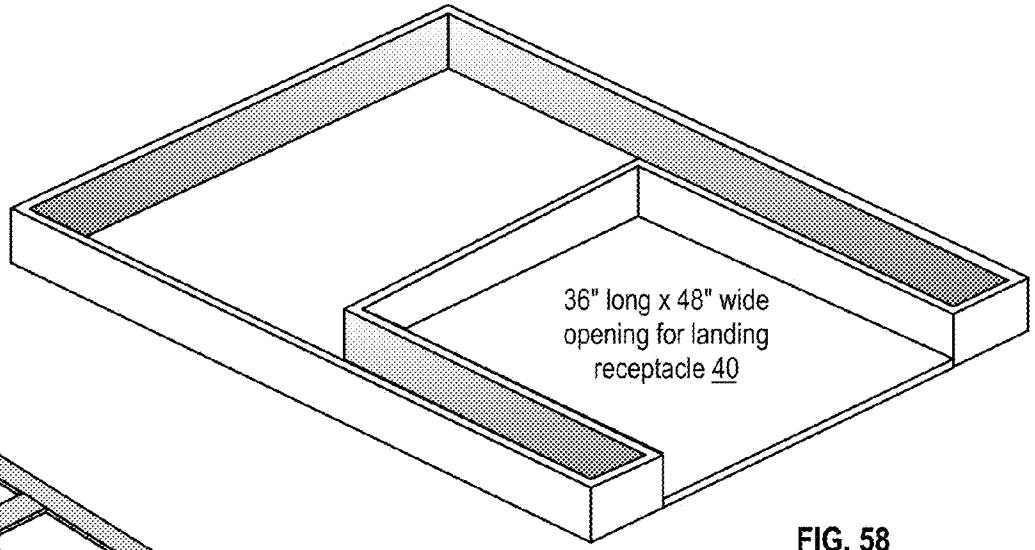
FIG. 58 is an isometric view diagram of an embodiment of a fill section for a sloped area of a sectional pitching mound in accordance with the present invention.

FIG. 58 is an isometric view diagram of an embodiment of a sloped area fill section 252. The fill section 252 may be implemented as previously discussed with reference to FIG. 57. In an alternate implementation, the opening for the landing receptacle 40 may be an opening and not include a base as shown. As such, the landing area receptacle 40 would mount directly to the base 250.

Figure 59:
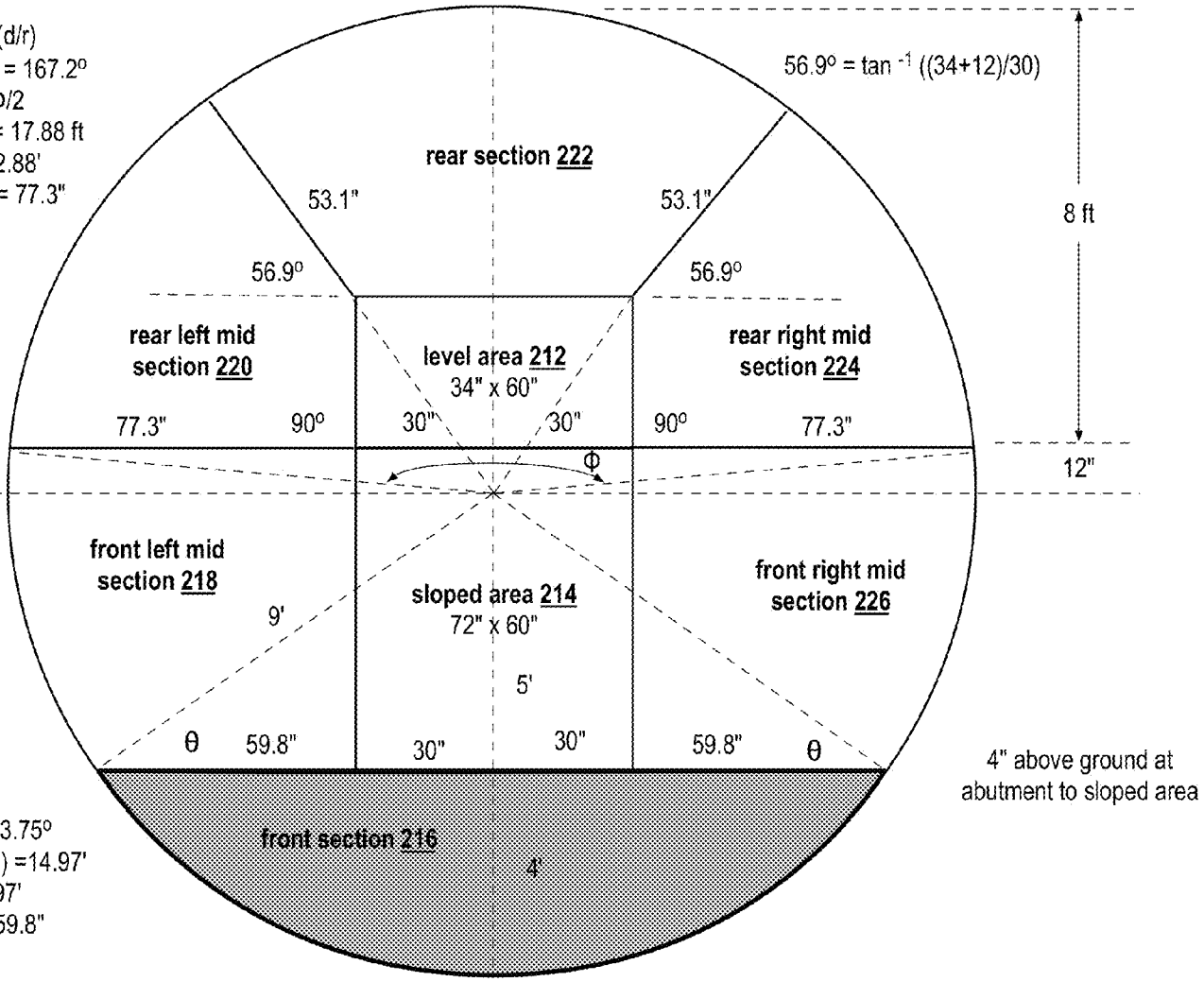
FIG. 59 is a top view diagram of an embodiment of a front section of a sectional pitching mound in accordance with the present invention.

FIG. 59 is a top view diagram of an embodiment of the surrounding sections 216-226 of the sectional pitching mound 210. For a mound that is in accordance with the MLB rules, the level area 212 is 12 inches back from the center of the mound. As such, the front end of the sloped area 214 ends 4 feet from the front edge of the mound 210. Further, since the level area 212 and the sloped area 214 are centered along the vertical centerline (based on the orientation of the drawing) of the mound 210, each area 212 and 214 extend 30 inches on each side of the vertical centerline. Note that the dimensions listed have a tolerance of +/−5%.

The front section 216 abuts to the sloped area 214 and extends to the perimeter of the mound 210. The slope of the front section 216 to the perimeter may be linear or spherical as discussed with reference to FIG. 52. From the top view, the front section 216 is a segment of the mound and has dimensions based on being a segment of a circle. For example, the length of the front section 216 from where it intersects the circumference of the circle is 14.97 feet. The distance from the abutment to the sloped area 214 to the front edge of the mound is 4 feet. The perimeter length of the front section 216, which has a sector angle of 112.5 degrees, is 17.65 feet (or 211.9 inches).

The front left mid section 218 abuts to the sloped area 214 as shown and extends to the perimeter of the mound 210. The slope of the front left mid section 218 to the perimeter may be linear or spherical as discussed with reference to FIG. 52. From the top view, the front left mid section 218 is a partial segment of the mound and has dimensions based on being a partial segment of a circle. For example, the length of the right edge of the front left mid section 218 is 6 feet (i.e., 72 inches), which corresponds to the length of the sloped area section. The bottom edge of the front left mid section 218 is 59.8 inches and its top edge is 77.3 inches (which is based on the calculations shown in the figure). The perimeter length of the front left mid section 218, which has a sector angle of 40.1 degrees, is 6.3 feet. The front right mid section 226 has similar dimensions in a mirror image.

The rear left mid section 220 abuts to the level area 212 as shown and extends to the perimeter of the mound 210. The slope of the rear left mid section 220 to the perimeter may be linear or spherical as discussed with reference to FIG. 52. From the top view, the rear left mid section 220 is a partial segment of the mound and has dimensions based on being a partial segment of a circle. For example, the length of the right edge of the rear left mid section 220 is 34 inches, which corresponds to the length of the level area 212. The bottom edge of the rear left mid section 220 is 77.3 inches. The upper edge of the rear left mid section 220 is at an angle of 56.9 degrees (based on a radial intersection of the corner of the level area 212) and has a length of 53.1 inches (which is based on the calculations shown in the figure). The perimeter length of the rear left mid section 220, which has a sector angle of 50.5 degrees, is 7.92 feet. The rear right mid section 224 has similar dimensions in a mirror image.

The rear section 222 abuts to the level area 212 and extends to the perimeter of the mound 210. The slope of the rear section 222 to the perimeter may be linear or spherical as discussed with reference to FIG. 52. From the top view, the rear section 222 is a partial segment of the mound and has dimensions based on being a partial segment of a circle. For example, the length of the bottom edge of the rear section 222 is 60 inches, which corresponds to the length of the level area 212. The sides of the rear section 222 are at an angle of 56.9 degrees (based on a radial intersection of the corner of the level area 212) and have a length of 53.1 inches. The perimeter length of the rear section 222, which has a sector angle of 66.2 degrees, is 10.4 feet.

Figure 60:
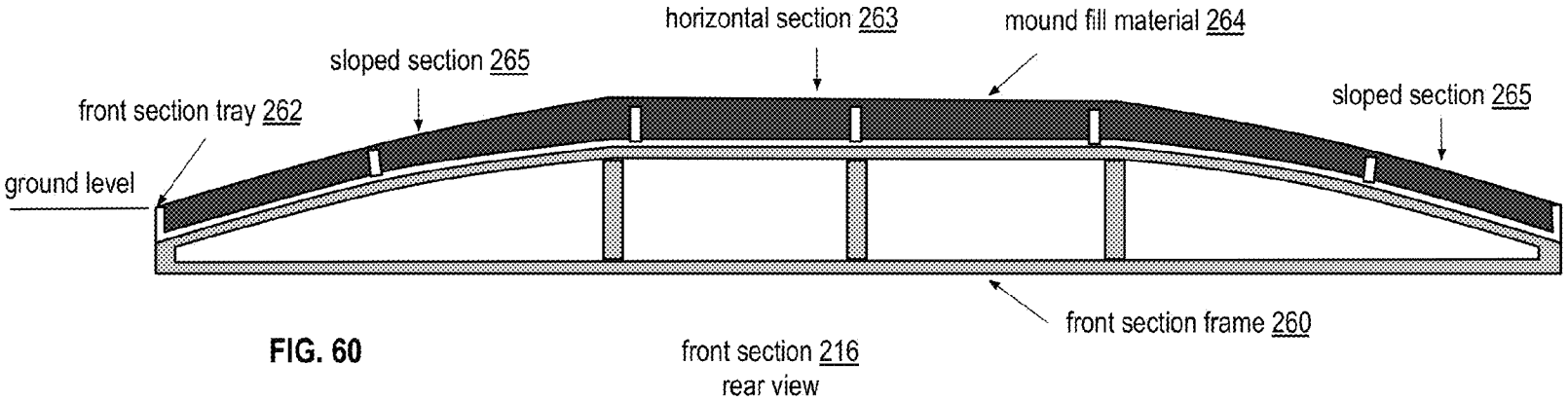
FIG. 60 is a cross sectional side view diagram of an embodiment of a front section of a sectional pitching mound in accordance with the present invention.
Figure 61:
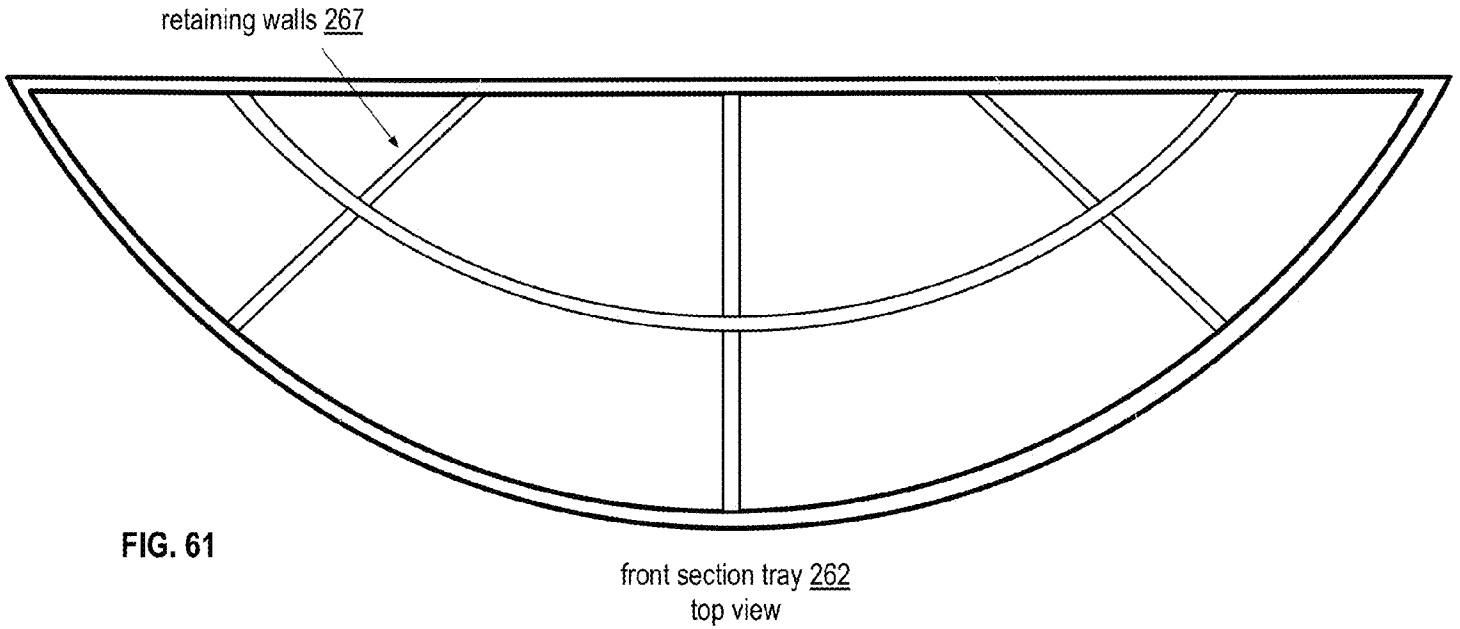
FIG. 61 is a top view diagram of an embodiment of a top portion of a front section of a sectional pitching mound in accordance with the present invention.

FIG. 60 is a cross sectional side view diagram and FIG. 61 is a top view diagram of an embodiment of the front section 216 that includes a front section frame 260, a front section tray 262, and mound fill material 264. The frame 260 includes first securing mechanism (not shown) to secure the frame 260 to the tray section 262 and second securing mechanism (not shown) to secure the frame 260 to the mounting platform 230. The frame 260 may further include an interlocking mechanism (not shown) to connect to adjacent sections of the sectional pitching mound 210. The securing mechanisms may be one or more of screws, nuts & bolts, latches, clips, pins, adhesives, press-fit, welding, etc., and the interlocking mechanism may include one or more of tongue & groove, a securing mechanism, aligning guides, etc.

The front section tray 262 may be may be comprised of a rubber, fiberglass, plastic, carbon fiber, and/or another material that provides for some flexibility to minimize interference of use of the mound while securely holding the mound fill. Further, the tray 262 may be fabricated in a similar manner as the replaceable tray 32 or 42 and/or the receptacle 30 or 40. For instance, the tray 262 may include a textured interior surface, an array of fingers, and/or a flexible fringe top. In an example, the tray 262 has top view dimensions as discussed with reference to FIG. 59.

From the front view, the tray 262 has a height, or depth, of 3 to 6 inches. Also from the front view perspective, the tray 262 has a 60-inch horizontal section 263 that corresponds to the abutment to the front edge of the sloped area 214 and two sloping sections 265 on either side of the horizontal section 263. As shown, the top edge of the tray 262 at the perimeter of the front section 216 is at ground level. Note that the tray 262 may include a drainage feature (e.g., holes, a perforated bottom, etc.) to reduce collection of moisture. Further note that the tray 262 may include retaining walls 267 to facilitate holding the mound fill material in place, where the top edges of the retaining walls 267 may include a flexible fringe as previously discussed. Still further note that the tray 262 may omit one or more of the walls that abuts to the sloped section 214, the left front mid section 218 and the right front mid section 226.

The frame 260 may be comprised of a metal (e.g., aluminum, steel, etc.), fiberglass, plastic, carbon fiber, and/or another material that provides a solid base. In an example that assumes the mounting platform 230 is 12 inches below ground level, the frame 260 has a height at its perimeter of 6 to 9 inches depending on the depth of the tray 262. The slope of the frame 260 from the perimeter to the horizontal section 263 is as discussed with reference FIG. 52. The height of the frame at the horizontal section is 10 to 13 inches.

In an alternate embodiment, the front section 216 may omit the frame 260 and, as such, the front section tray 262 would extend to the mounting platform 230. In this embodiment, the tray 262 includes a securing mechanism for securing to the mounting platform and may further include an interlocking mechanism for securing to other sections of the mound 210. In an example, the tray has dimensions of corresponding to the combination of the tray 262 and the frame 260. Note that the tray 262 may also include a drainage feature to reduce collection of moisture.

Figure 62:
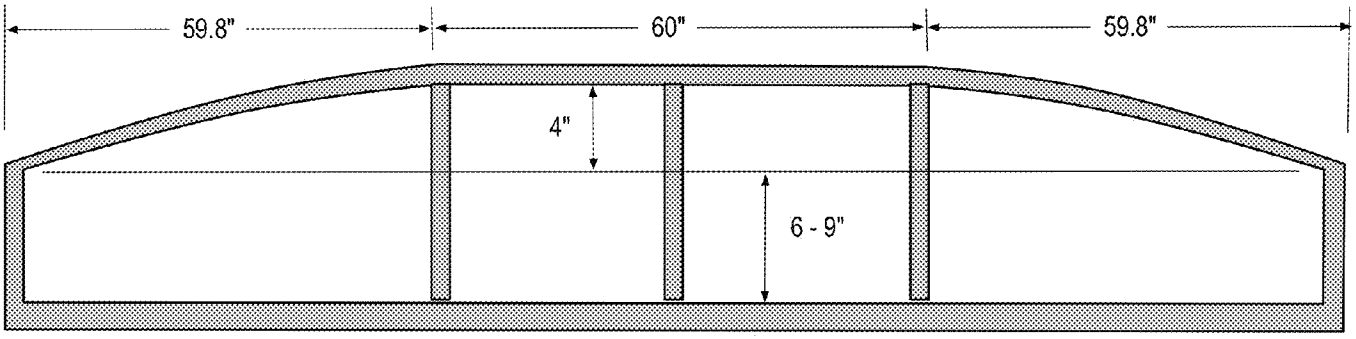
FIG. 62 is a cross sectional side view diagram of an embodiment of a frame for a front section of a sectional pitching mound in accordance with the present invention.
Figure 63:
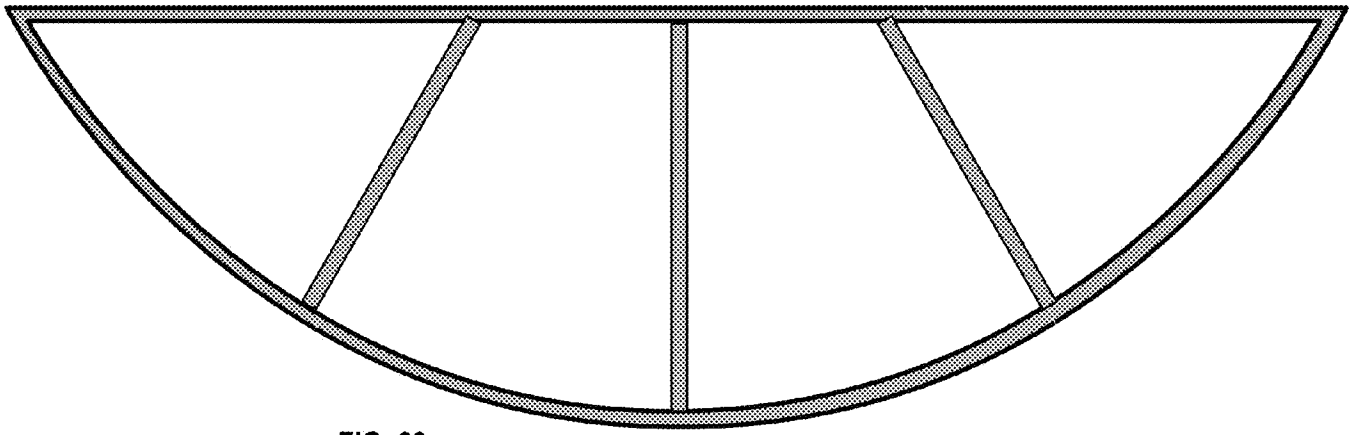
FIG. 63 is a top view diagram of an embodiment of a frame for a front section of a sectional pitching mound in accordance with the present invention.

FIG. 62 is a cross sectional side view diagram and FIG. 63 is a top view diagram of an embodiment of a frame 260 for a front section 216. In this diagram, the frame 260 includes one possible structure to support the front section tray 262. As shown, the frame 260 may be constructed of L beams for the outer perimeter of the frame and flat pieces to provide support and securing mechanism areas in the middle area of the frame. In an alternate implementation, the frame 260 may a solid piece molded or fabricated from plastic, fiberglass, carbon fiber, or some other moldable material. In another alternate implementation, the frame may include sheet metal (or the like) on the top of the frame to provide a solid surface for mounting the tray 262.

The horizontal section of the frame 260 has a length of 60 inches. Each of the sloped sections has a length of 59.8 inches. The height of the frame at the perimeter is 6 to 9 inches and is 10 to 13 inches at the horizontal section.

Figure 65:
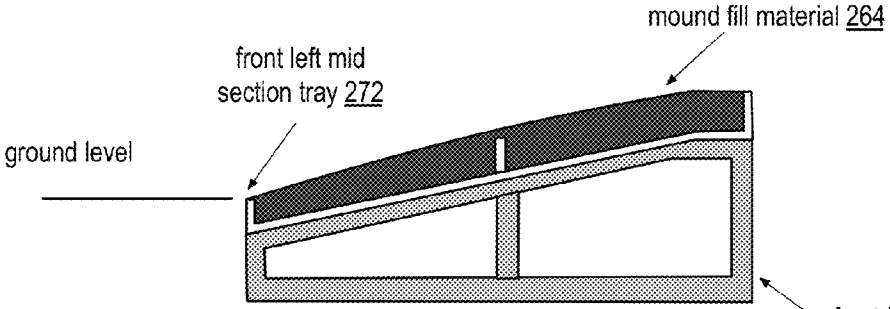
FIG. 65 is a cross sectional top side view diagram of an embodiment of a front left mid section of a sectional pitching mound in accordance with the present invention.
Figure 66:
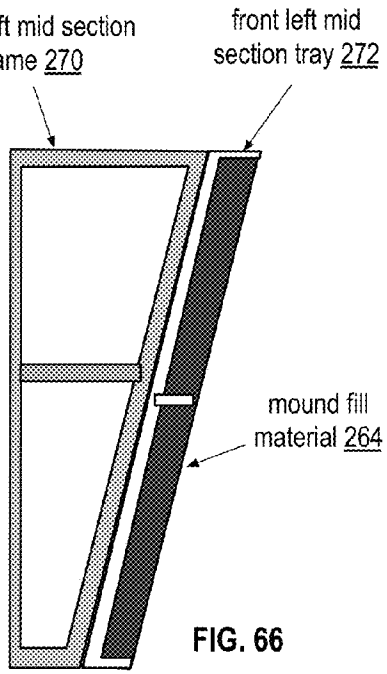
FIG. 66 is a cross sectional right side view diagram of an embodiment of a front left mid section of a sectional pitching mound in accordance with the present invention.
Figure 64:
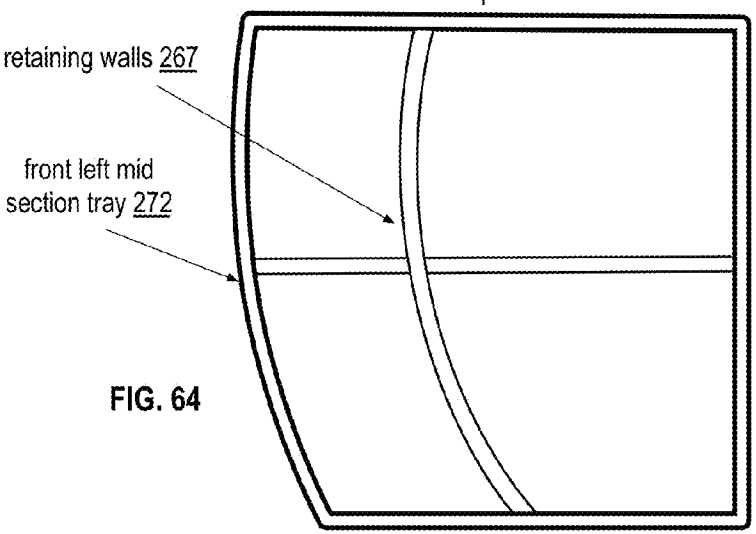
FIG. 64 is a top view diagram of an embodiment of a front left mid section of a sectional pitching mound in accordance with the present invention.

FIGS. 64-66 are a top view, a cross sectional top side view, and a cross sectional right side view diagrams of an embodiment of the front left mid section 218. The front left mid section 218 includes a front left mid section frame 270, a front left mid section tray 272, and mound fill material 264. The frame 270 includes first securing mechanism (not shown) to secure the frame 270 to the tray section 272 and second securing mechanism (not shown) to secure the frame 270 to the mounting platform 230. The frame 270 may further include an interlocking mechanism (not shown) to connect to adjacent sections of the sectional pitching mound 210. The securing mechanisms may be one or more of screws, nuts & bolts, latches, clips, pins, adhesives, press-fit, welding, etc., and the interlocking mechanism may include one or more of tongue & groove, a securing mechanism, aligning guides, etc.

The front left mid section tray 272 may be may be comprised of a rubber, fiberglass, plastic, carbon fiber, and/or another material that provides for some flexibility to minimize interference of use of the mound while securely holding the mound fill. Further, the tray 272 may be fabricated in a similar manner as the replaceable tray 32 or 42 and/or the receptacle 30 or 40. For instance, the tray 272 may include a textured interior surface, an array of fingers, and/or a flexible fringe top. In an example, the tray 272 has top view dimensions as discussed with reference to FIG. 59.

From the top and/or right side views, the tray 272 has a height, or depth, of 3 to 6 inches. Also from the right view perspective, the tray 272 has a length of 72 inches that that corresponds to the length of the sloped area 214. As shown in the top view, the outer edge of the tray 272 at the perimeter of the front left mid section 218 is at ground level and the other end is at a height of 10 inches above ground level (which corresponds to the height of the level area abutting the sloped area). As shown in the right side view, the bottom edge of the tray 272 is 4 inches above ground level (which corresponds to the height of the sloped area at its front end) and the top edge of the tray 272 is at 10 inches above ground level (which corresponds to the height of the level area abutting the sloped area). Note that the tray 272 may include a drainage feature (e.g., holes, a perforated bottom, etc.) to reduce collection of moisture. Further note that the tray 272 may include retaining walls 267 to facilitate holding the mound fill material in place, where the top edges of the retaining walls 267 may include a flexible fringe as previously discussed. Still further note that the tray 272 may omit one or more of the walls that abuts to the sloped area 214, the front section 216 and the rear section 222.

The frame 270 may be comprised of a metal (e.g., aluminum, steel, etc.), fiberglass, plastic, carbon fiber, and/or another material that provides a solid base. In this example assume that the mounting platform 230 is 12 inches below ground level. With respect to the right side view, the frame 270 has a height of 10-14 at the bottom edge and sloping up to 16 to 19 inches at the top edge. With respect to the top view, the frame has a height at its perimeter of 6 to 9 inches depending on the depth of the tray 262 and a height of 16-19 inches at the inner edge of the frame 270. The slope of the frame 270 from its perimeter to its top, bottom, and inner edges is as discussed with reference FIG. 52.

In an alternate embodiment, the front left mid section 218 may omit the frame 270 and, as such, the front left mid section tray 272 would extend to the mounting platform 230. In this embodiment, the tray 272 includes a securing mechanism for securing to the mounting platform and may further include an interlocking mechanism for securing to other sections of the mound 210. In an example, the tray 272 has dimensions of corresponding to the combination of the tray 272 and the frame 270. Note that the tray 272 may also include a drainage feature to reduce collection of moisture.

Figure 68:
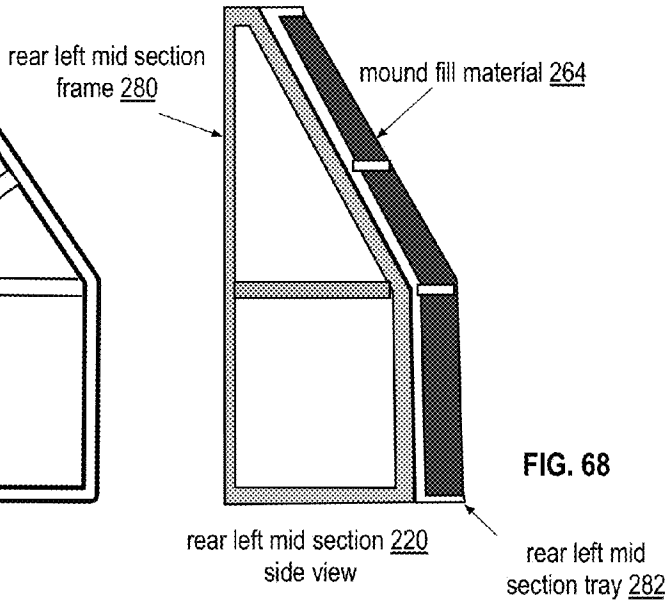
FIG. 68 is a cross sectional side view diagram of an embodiment of a rear left mid section of a sectional pitching mound in accordance with the present invention.
Figure 67:
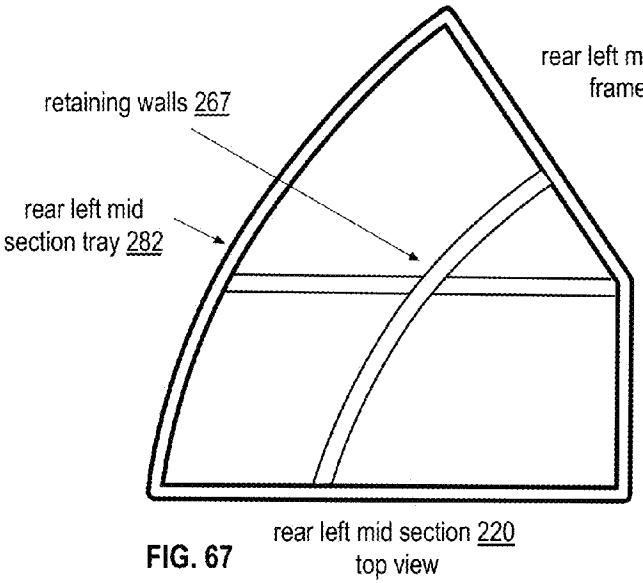
FIG. 67 is a top view diagram of an embodiment of a rear left mid section of a sectional pitching mound in accordance with the present invention.
Figure 69:
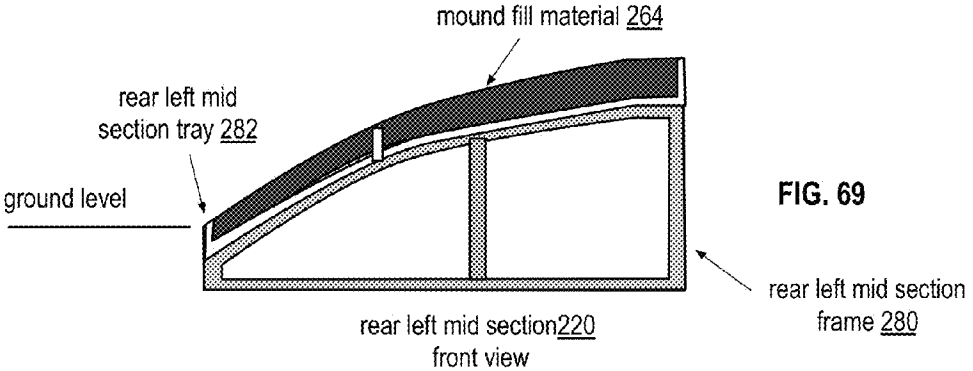
FIG. 69 is a cross sectional front view diagram of an embodiment of a rear left mid section of a sectional pitching mound in accordance with the present invention.

FIGS. 67-69 are a top view, a cross sectional side view, and a cross sectional front view diagrams of an embodiment of a rear left mid section 220. The rear left mid section 220 includes a rear left mid section frame 280, a rear left mid section tray 282, and mound fill material 264. The frame 280 includes first securing mechanism (not shown) to secure the frame 280 to the tray section 282 and second securing mechanism (not shown) to secure the frame 280 to the mounting platform 230. The frame 280 may further include an interlocking mechanism (not shown) to connect to adjacent sections of the sectional pitching mound 210. The securing mechanisms may be one or more of screws, nuts & bolts, latches, clips, pins, adhesives, press-fit, welding, etc., and the interlocking mechanism may include one or more of tongue & groove, a securing mechanism, aligning guides, etc.

The rear left mid section tray 282 may be may be comprised of a rubber, fiberglass, plastic, carbon fiber, and/or another material that provides for some flexibility to minimize interference of use of the mound while securely holding the mound fill. Further, the tray 282 may be fabricated in a similar manner as the replaceable tray 32 or 42 and/or the receptacle 30 or 40. For instance, the tray 282 may include a textured interior surface, an array of fingers, and/or a flexible fringe top. In an example, the tray 282 has top view dimensions as discussed with reference to FIG. 59.

From the front and/or side views, the tray 282 has a height, or depth, of 3 to 6 inches. From the side view perspective, the tray 282 has a level portion that is 34 inches long (which corresponds to the abutment to the level area 212) and slopes to ground level at the perimeter of the section 220. As shown in the front view, the outer edge of the tray 282 at the perimeter of the rear left mid section 220 is at ground level and the other end is at a height of 10 inches above ground level (which corresponds to the height of the level area). Note that the tray 282 may include a drainage feature (e.g., holes, a perforated bottom, etc.) to reduce collection of moisture. Further note that the tray 282 may include retaining walls 267 to facilitate holding the mound fill material in place, where the top edges of the retaining walls 267 may include a flexible fringe as previously discussed. Still further note that the tray 282 may omit one or more of the walls that abuts to the level area 212, the front left mid section 218, and the rear section 222.

The frame 280 may be comprised of a metal (e.g., aluminum, steel, etc.), fiberglass, plastic, carbon fiber, and/or another material that provides a solid base. In this example assume that the mounting platform 230 is 12 inches below ground level. With respect to the front view, the frame 280 has a height of 16 to 19 inches at the left edge. With respect to the side view, the frame 280 has a height at its perimeter of 6 to 9 inches depending on the depth of the tray 292 at the perimeter end and a height of 16-19 inches at the bottom edge of the frame 280 and along the level area abutment. The slope of the frame 280 from its perimeter to its top, bottom, and inner edges is as discussed with reference FIG. 52.

In an alternate embodiment, the rear left mid section 220 may omit the frame 280 and, as such, the rear left mid section tray 282 would extend to the mounting platform 230. In this embodiment, the tray 282 includes a securing mechanism for securing to the mounting platform and may further include an interlocking mechanism for securing to other sections of the mound 210. In an example, the tray 282 has dimensions of corresponding to the combination of the tray 282 and the frame 280. Note that the tray 282 may also include a drainage feature to reduce collection of moisture.

Figure 70:
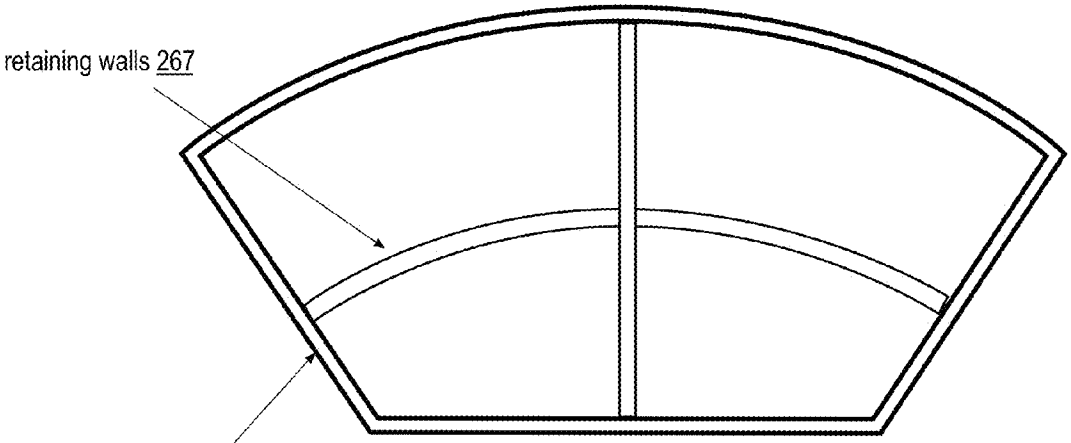
FIG. 70 is a top view diagram of an embodiment of a rear section of a sectional pitching mound in accordance with the present invention.
Figure 71:
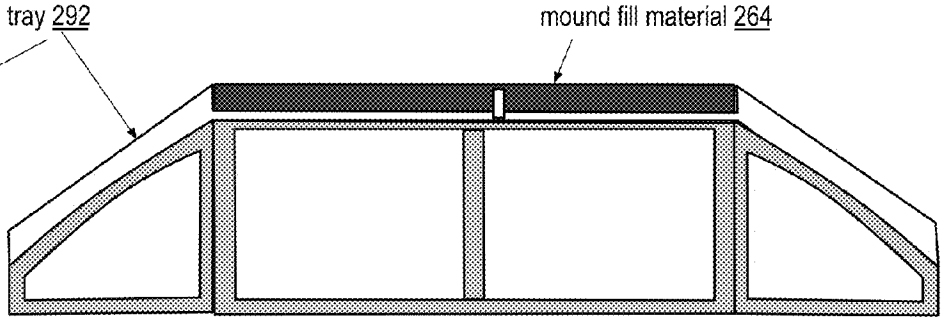
FIG. 71 is a cross sectional front view diagram of an embodiment of a rear section of a sectional pitching mound in accordance with the present invention.
Figure 72:
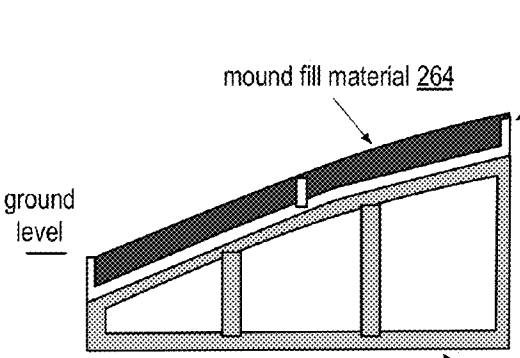
FIG. 72 is a cross sectional side view diagram of an embodiment of a rear section of a sectional pitching mound in accordance with the present invention.

FIGS. 70-72 are a top view, a cross sectional front view, and a cross sectional side view diagrams of an embodiment of a rear section 222 of a sectional pitching mound 210. The rear section 222 includes a rear section frame 290, a rear section tray 292, and mound fill material 264. The frame 290 includes first securing mechanism (not shown) to secure the frame 290 to the tray section 292 and second securing mechanism (not shown) to secure the frame 290 to the mounting platform 230. The frame 290 may further include an interlocking mechanism (not shown) to connect to adjacent sections of the sectional pitching mound 210. The securing mechanisms may be one or more of screws, nuts & bolts, latches, clips, pins, adhesives, press-fit, welding, etc., and the interlocking mechanism may include one or more of tongue & groove, a securing mechanism, aligning guides, etc.

The rear section tray 292 may be may be comprised of a rubber, fiberglass, plastic, carbon fiber, and/or another material that provides for some flexibility to minimize interference of use of the mound while securely holding the mound fill. Further, the tray 292 may be fabricated in a similar manner as the replaceable tray 32 or 42 and/or the receptacle 30 or 40. For instance, the tray 292 may include a textured interior surface, an array of fingers, and/or a flexible fringe top. In an example, the tray 272 has top view dimensions as discussed with reference to FIG. 59.

From the front and/or side views, the tray 292 has a height, or depth, of 3 to 6 inches. From the side view perspective, the tray 292 slopes from the right inner corner (i.e., wherein the rear section abuts the level area) to ground level at the perimeter of the section 222. As shown in the front view, the outer edge of the tray 292 at the perimeter of the rear section 222 is at ground level and the front end is at a height of 10 inches above ground level (which corresponds to the height of the level area). Note that the tray 292 may include a drainage feature (e.g., holes, a perforated bottom, etc.) to reduce collection of moisture. Further note that the tray 292 may include retaining walls 267 to facilitate holding the mound fill material in place, where the top edges of the retaining walls 267 may include a flexible fringe as previously discussed. Still further note that the tray 292 may omit one or more of the walls that abuts to the level area 212, the rear left mid section 220, and the rear right mid section 224.

The frame 290 may be comprised of a metal (e.g., aluminum, steel, etc.), fiberglass, plastic, carbon fiber, and/or another material that provides a solid base. In this example assume that the mounting platform 230 is 12 inches below ground level. With respect to the front view, the frame 290 has a height of 16 to 19 inches at the front edge (i.e., the edge that abuts to the level area). With respect to the side view, the frame 290 has a height at its perimeter of 6 to 9 inches depending on the depth of the tray 292 at the perimeter end and a height of 16-19 inches at the right inner edge of the frame 290. The slope of the frame 290 from its perimeter to its top front edge is as discussed with reference FIG. 52.

In an alternate embodiment, the rear section 222 may omit the frame 290 and, as such, the rear section tray 292 would extend to the mounting platform 230. In this embodiment, the tray 292 includes a securing mechanism for securing to the mounting platform and may further include an interlocking mechanism for securing to other sections of the mound 210. In an example, the tray 292 has dimensions of corresponding to the combination of the tray 292 and the frame 290. Note that the tray 292 may also include a drainage feature to reduce collection of moisture.

The rear section 222 may further include an area to support a "spike cleaner" (e.g., a 12×12 inch area that includes a plurality of semi-flexible fingers that scrap the bottom of a spike when the spike is rubbed across the surface of the area). The area of the rear section may be implemented in a variety of ways. For example, the area includes a receptacle to receive a replaceable spike cleaner. As another example, the area includes the spike cleaner that secures to the frame and/or tray of the rear section.

Figure 73:
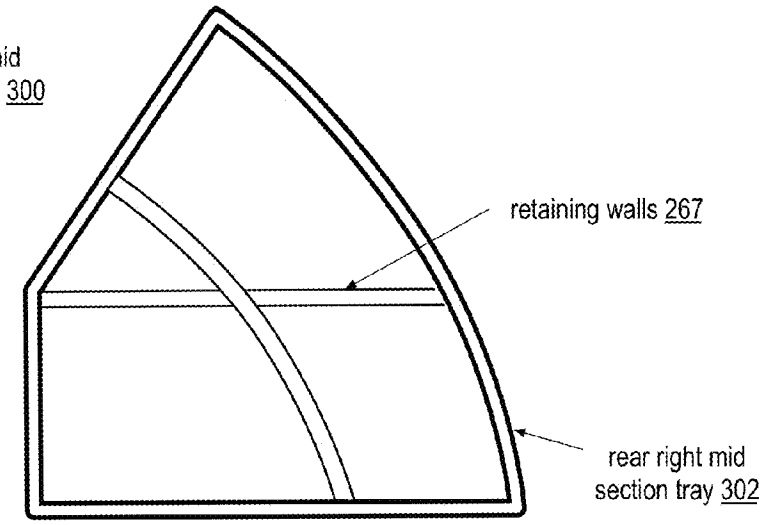
FIG. 73 is a top view diagram of an embodiment of a rear right mid section of a sectional pitching mound in accordance with the present invention.
Figure 74:
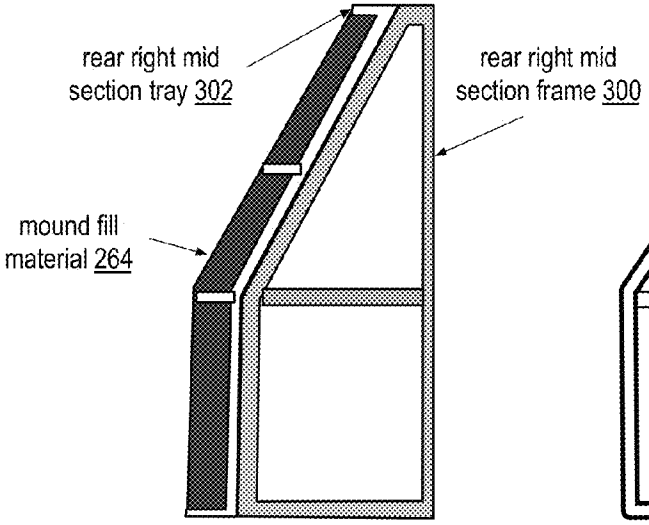
FIG. 74 is a cross sectional side view diagram of an embodiment of a rear right mid section of a sectional pitching mound in accordance with the present invention.
Figure 75:
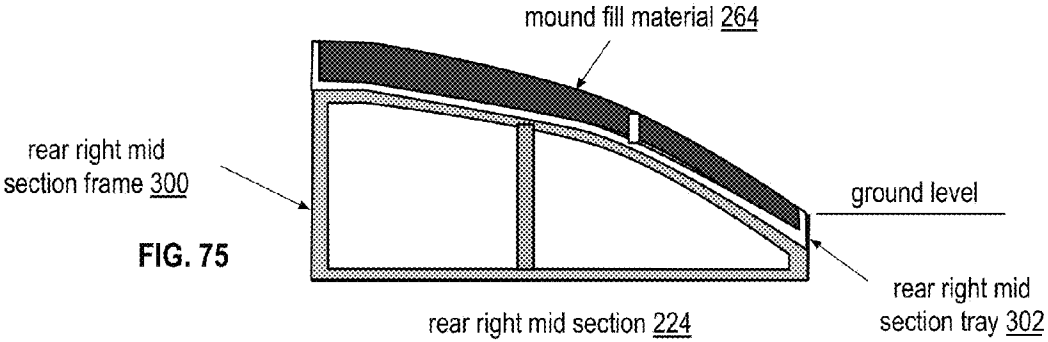
FIG. 75 is a cross sectional front view diagram of an embodiment of a rear right mid section of a sectional pitching mound in accordance with the present invention.

FIGS. 73-75 are a top view, a cross sectional side view, and a cross sectional front view diagrams of an embodiment of a rear right mid section 224. The rear right mid section 224 includes a rear right mid section frame 300, a rear right mid section tray 302, and mound fill material 264. The frame 300 includes first securing mechanism (not shown) to secure the frame 300 to the tray section 302 and second securing mechanism (not shown) to secure the frame 300 to the mounting platform 230. The frame 300 may further include an interlocking mechanism (not shown) to connect to adjacent sections of the sectional pitching mound 210. The securing mechanisms may be one or more of screws, nuts & bolts, latches, clips, pins, adhesives, press-fit, welding, etc., and the interlocking mechanism may include one or more of tongue & groove, a securing mechanism, aligning guides, etc.

The rear right mid section tray 302 may be may be comprised of a rubber, fiberglass, plastic, carbon fiber, and/or another material that provides for some flexibility to minimize interference of use of the mound while securely holding the mound fill. Further, the tray 302 may be fabricated in a similar manner as the replaceable tray 32 or 42 and/or the receptacle 30 or 40. For instance, the tray 302 may include a textured interior surface, an array of fingers, and/or a flexible fringe top. In an example, the tray 302 has top view dimensions as discussed with reference to FIG. 59.

From the front and/or side views, the tray 302 has a height, or depth, of 3 to 6 inches. From the side view perspective, the tray 302 has a level portion that is 34 inches long (which corresponds to the abutment to the level area 212) and slopes to ground level at the perimeter of the section 224. As shown in the front view, the outer edge of the tray 302 at the perimeter of the rear right mid section 224 is at ground level and the other end is at a height of 10 inches above ground level (which corresponds to the height of the level area). Note that the tray 302 may include a drainage feature (e.g., holes, a perforated bottom, etc.) to reduce collection of moisture. Further note that the tray 302 may include retaining walls 267 to facilitate holding the mound fill material in place, where the top edges of the retaining walls 267 may include a flexible fringe as previously discussed. Still further note that the tray 302 may omit one or more of the walls that abuts to the level area 212, the front right mid section 226, and the rear section 222.

The frame 300 may be comprised of a metal (e.g., aluminum, steel, etc.), fiberglass, plastic, carbon fiber, and/or another material that provides a solid base. In this example assume that the mounting platform 230 is 12 inches below ground level. With respect to the front view, the frame 300 has a height of 16 to 19 inches at the left edge. With respect to the side view, the frame 300 has a height at its perimeter of 6 to 9 inches depending on the depth of the tray 302 at the perimeter end and a height of 16-19 inches at the bottom edge of the frame 300 and along the level area abutment. The slope of the frame 300 from its perimeter to its top, bottom, and inner edges is as discussed with reference FIG. 52.

In an alternate embodiment, the rear right mid section 224 may omit the frame 300 and, as such, the rear right mid section tray 302 would extend to the mounting platform 230. In this embodiment, the tray 302 includes a securing mechanism for securing to the mounting platform and may further include an interlocking mechanism for securing to other sections of the mound 210. In an example, the tray 302 has dimensions of corresponding to the combination of the tray 302 and the frame 300. Note that the tray 302 may also include a drainage feature to reduce collection of moisture.

FIGS. 76-78 are a top view, a cross sectional top side view, and a cross sectional side view diagrams of an embodiment of the front right mid section 226. The front right mid section 226 includes a front right mid section frame 310, a front right mid section tray 312, and mound fill material 264. The frame 310 includes first securing mechanism (not shown) to secure the frame 310 to the tray section 312 and second securing mechanism (not shown) to secure the frame 310 to the mounting platform 230. The frame 310 may further include an interlocking mechanism (not shown) to connect to adjacent sections of the sectional pitching mound 210. The securing mechanisms may be one or more of screws, nuts & bolts, latches, clips, pins, adhesives, press-fit, welding, etc., and the interlocking mechanism may include one or more of tongue & groove, a securing mechanism, aligning guides, etc.

The front right mid section tray 312 may be may be comprised of a rubber, fiberglass, plastic, carbon fiber, and/or another material that provides for some flexibility to minimize interference of use of the mound while securely holding the mound fill. Further, the tray 312 may be fabricated in a similar manner as the replaceable tray 32 or 42 and/or the receptacle 30 or 40. For instance, the tray 312 may include a textured interior surface, an array of fingers, and/or a flexible fringe top. In an example, the tray 272 has top view dimensions as discussed with reference to FIG. 59.

From the top and/or side views, the tray 312 has a height, or depth, of 3 to 6 inches. Also from the side view perspective, the tray 312 has a length of 72 inches that that corresponds to the length of the sloped area 214. As shown in the top view, the outer edge of the tray 312 at the perimeter of the front right mid section 226 is at ground level and the other end is at a height of 10 inches above ground level (which corresponds to the height of the level area abutting the sloped area). As shown in the side view, the bottom edge of the tray 312 is 4 inches above ground level (which corresponds to the height of the sloped area at its front end) and the top edge of the tray 312 is at 10 inches above ground level (which corresponds to the height of the level area abutting the sloped area). Note that the tray 312 may include a drainage feature (e.g., holes, a perforated bottom, etc.) to reduce collection of moisture. Further note that the tray 312 may include retaining walls 267 to facilitate holding the mound fill material in place, where the top edges of the retaining walls 267 may include a flexible fringe as previously discussed. Still further note that the tray 312 may omit one or more of the walls that abuts to the sloped area 214, the front section 216 and the rear right mid section 224.

The frame 310 may be comprised of a metal (e.g., aluminum, steel, etc.), fiberglass, plastic, carbon fiber, and/or another material that provides a solid base. In this example assume that the mounting platform 230 is 12 inches below ground level. With respect to the side view, the frame 310 has a height of 10-14 at the bottom edge and sloping up to 16 to 19 inches at the top edge. With respect to the top view, the frame has a height at its perimeter of 6 to 9 inches depending on the depth of the tray 262 and a height of 16-19 inches at the inner edge of the frame 310. The slope of the frame 310 from its perimeter to its top, bottom, and inner edges is as discussed with reference FIG. 52.

In an alternate embodiment, the front right mid section 226 may omit the frame 310 and, as such, the front right mid section tray 312 would extend to the mounting platform 230. In this embodiment, the tray 312 includes a securing mechanism for securing to the mounting platform and may further include an interlocking mechanism for securing to other sections of the mound 210. In an example, the tray 312 has dimensions of corresponding to the combination of the tray 312 and the frame 310. Note that the tray 312 may also include a drainage feature to reduce collection of moisture.

Figure 79:
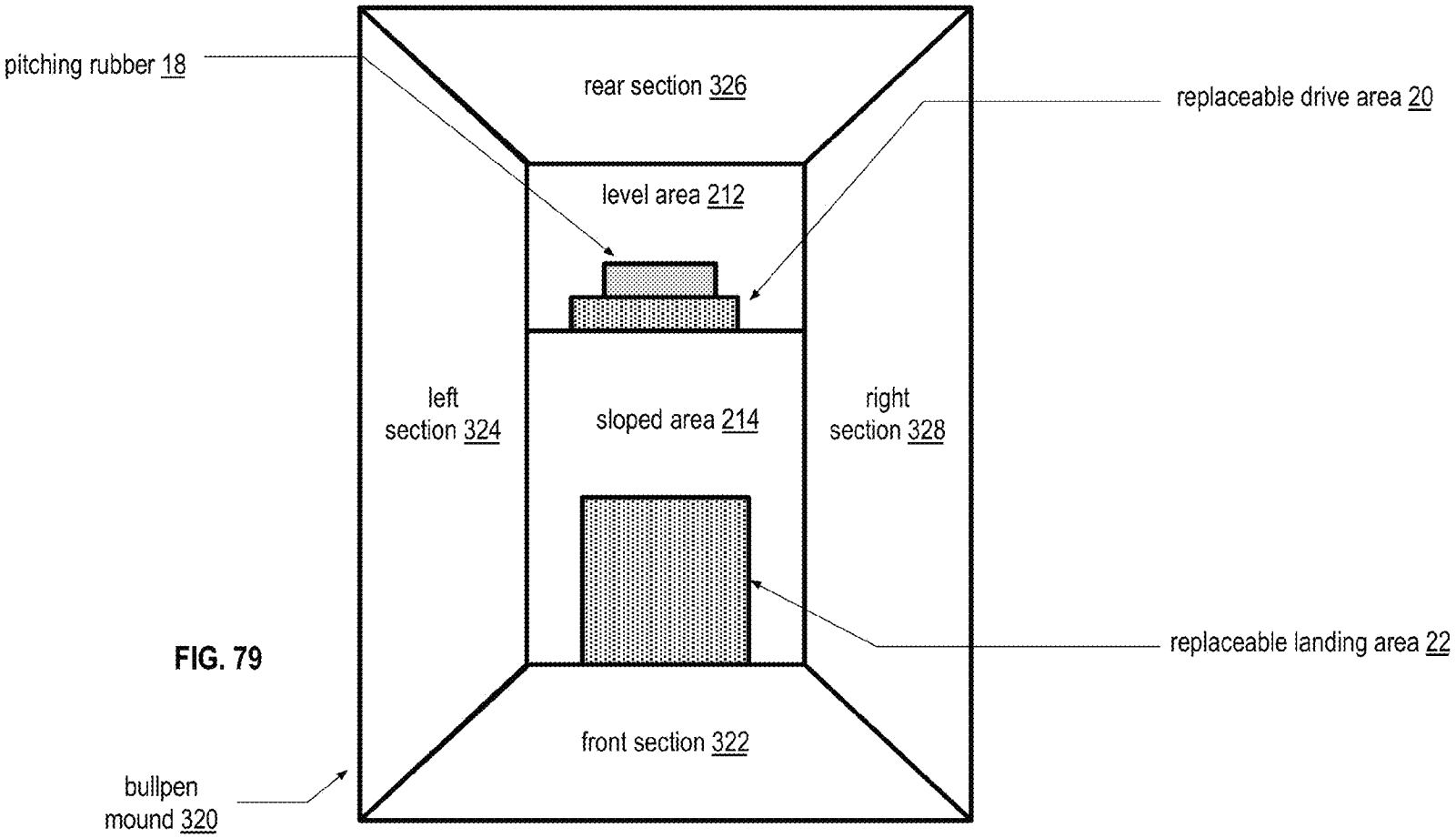
FIG. 79 is a top view diagram of an embodiment of a sectional bullpen mound in accordance with the present invention.

FIG. 79 is a top view diagram of an embodiment of a sectional bullpen mound 320 that includes the level area 212, the sloped area 214, a front section 322, a left section 324, a rear section 326, and a right section 328. The overall dimensions of the sectional bullpen mound may vary depending on available space. In one example, the sectional bullpen may be 10 feet wide (e.g., 5 feet for the width of the level area 212 and the sloped area 214 and 2.5 feet for each of the left and right sections 324 and 328) by 13 feet 10 inches (e.g., 34 inches for the level area 212, 72 inches for the sloped area 214, and 2.5 feet for each of the rear and front sections 326 and 322). Alternatively, the rear section may be up to 10 feet long and have a slope of 1 inch per foot.

Each of the surrounding sections 322-328 slopes from the level area 212 or from the sloped area 214 to ground level and may include a base and one or more trays to hold mound fill material. The surrounding areas 332-326, the level area 212, and the sloped area 214 connect to each other to form a unified bullpen mound that, with respect to the level area and sloped area, conforms to baseball rules (e.g., a height of 10 inches, the level area is 34×60 inches, and the sloped area is 60×72 inches with a slope of 1 inch per foot). The connecting of the sections may be done by abutment, by track mechanisms, by hardware, etc. Note that there may be more or less surrounding areas based on ease of movement, ease of assembly, etc. Further note that once the bullpen mound 320 is assembled, it may be desirable to add and tamp mound fill material along the edges of the sections to better blend the sections together. With such a sectional bullpen mound 320, a bullpen mound that conforms to the baseball rules can be repeatedly created and recreated from baseball field to baseball field.

Figure 80:
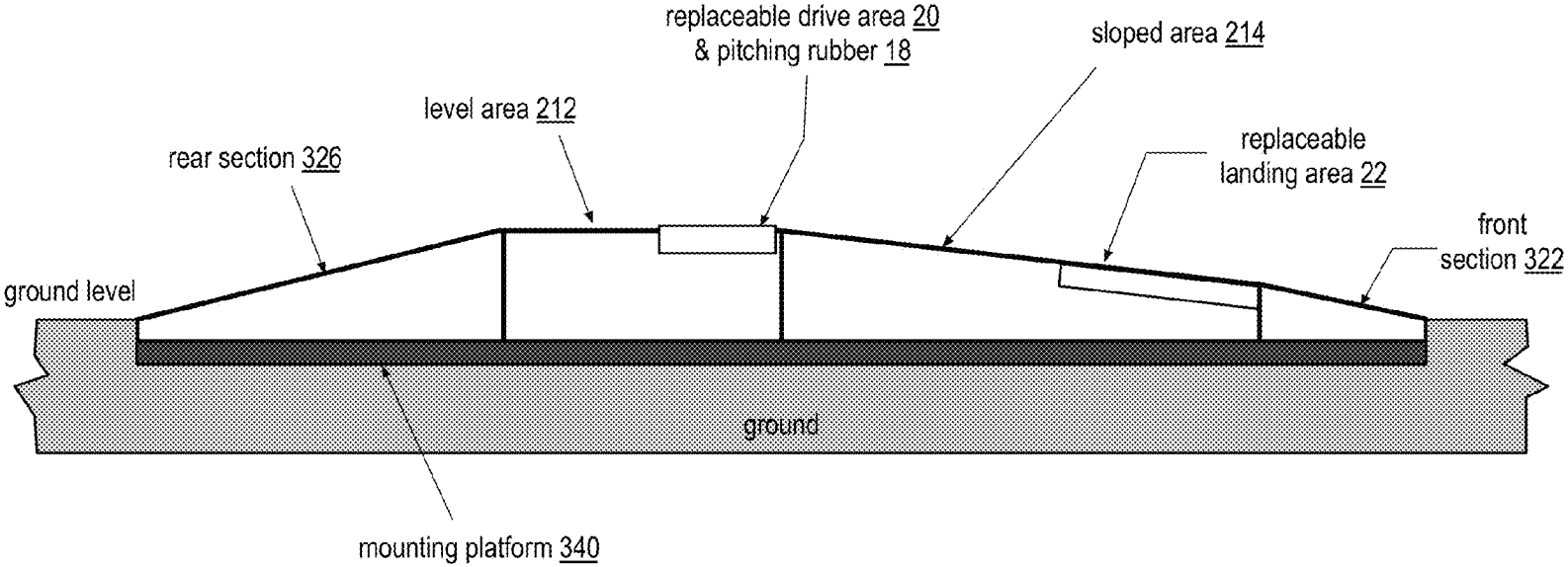
FIG. 80 is a cross sectional side view diagram of an embodiment of a sectional pitching mound in accordance with the present invention.
Figures 81, 82, 83, 84:
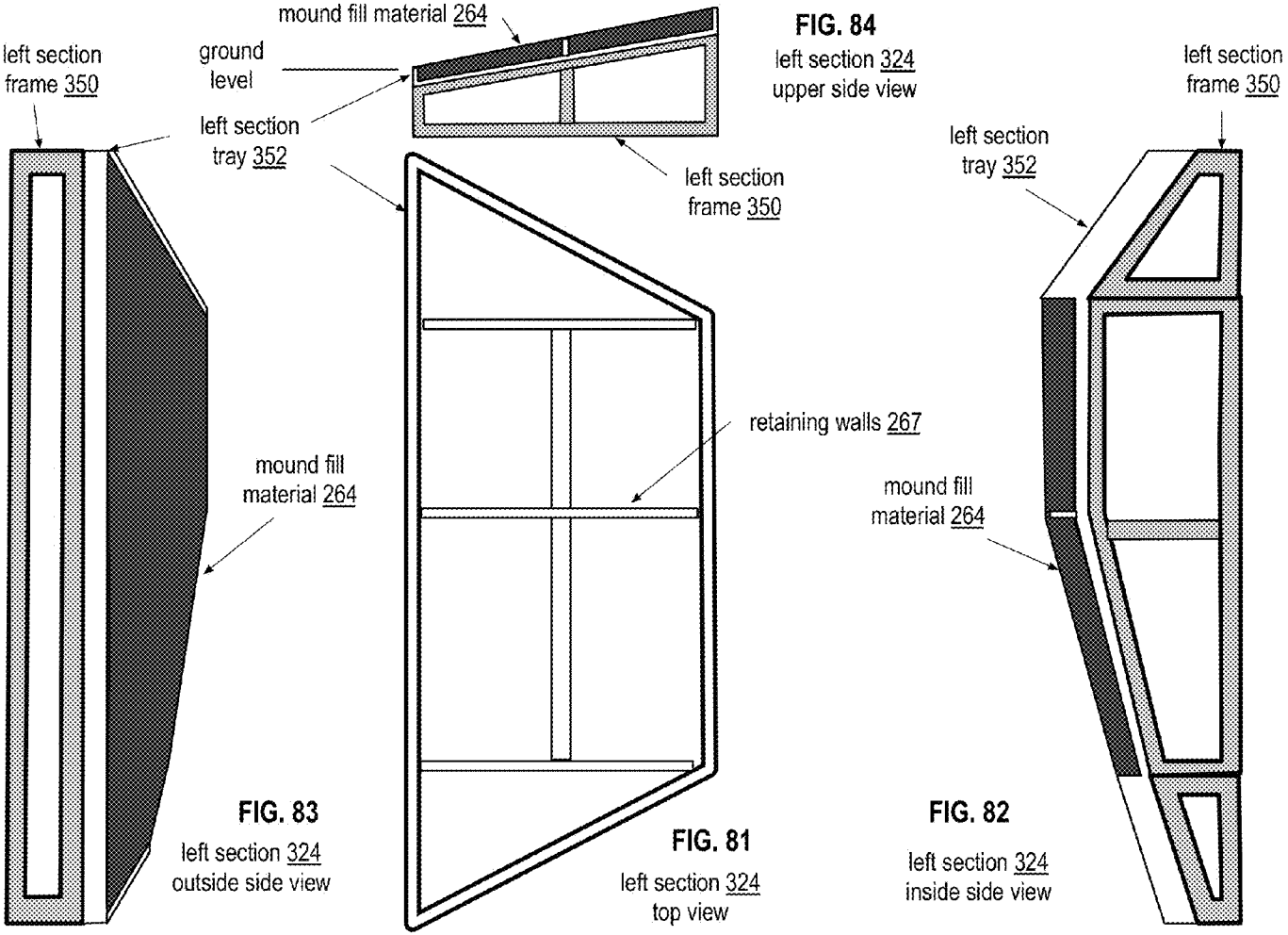
FIG. 81 is a top view diagram of an embodiment of a left section of a sectional bullpen mound in accordance with the present invention.
FIG. 82 is a cross sectional inside view diagram of an embodiment of a left section of a sectional bullpen mound in accordance with the present invention.
FIG. 83 is an outside view diagram of an embodiment of a left section of a sectional bullpen mound in accordance with the present invention.
FIG. 84 is a cross sectional top side view diagram of an embodiment of a left section of a sectional bullpen mound in accordance with the present invention.
Figure 92:
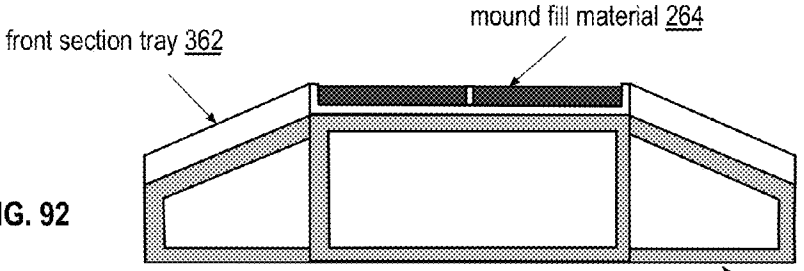
FIG. 92 is a rear view diagram of an embodiment of a front section of a sectional bullpen mound in accordance with the present invention.
Figure 89:
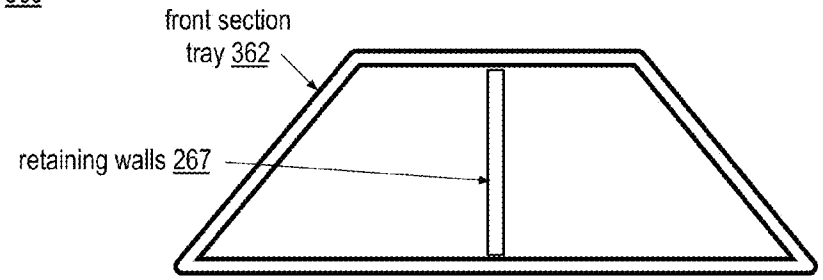
FIG. 89 is a top view diagram of an embodiment of a front section of a sectional bullpen mound in accordance with the present invention.
Figure 90:
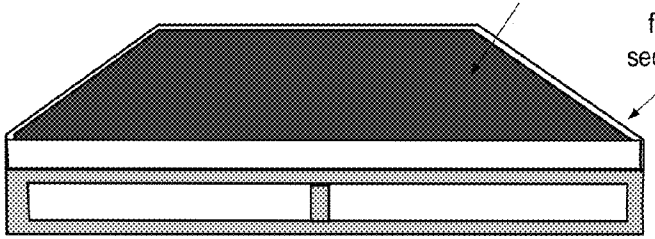
FIG. 90 is a front view diagram of an embodiment of a front section of a sectional bullpen mound in accordance with the present invention.
Figure 91:
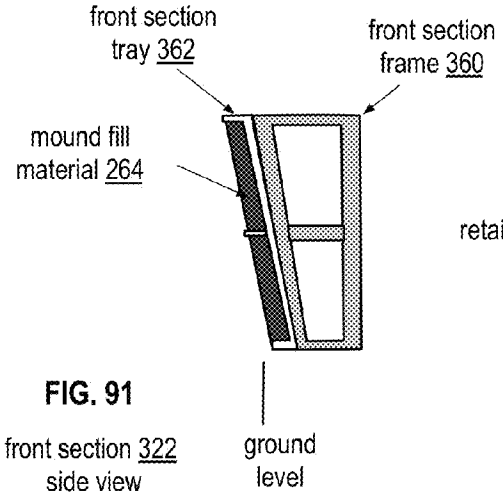
FIG. 91 is a side view diagram of an embodiment of a front section of a sectional bullpen mound in accordance with the present invention.
Figure 96:
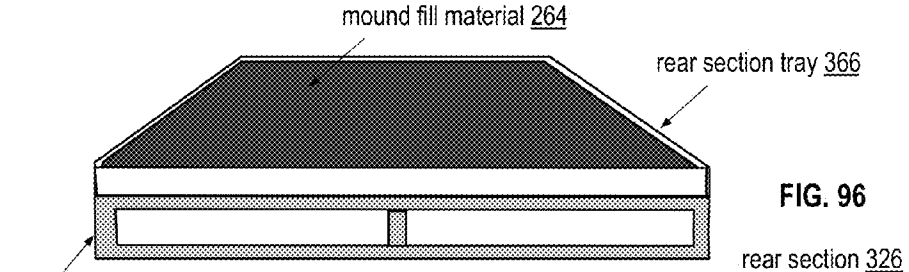
FIG. 96 is a rear view diagram of an embodiment of a rear section of a sectional bullpen mound in accordance with the present invention.
Figure 93:
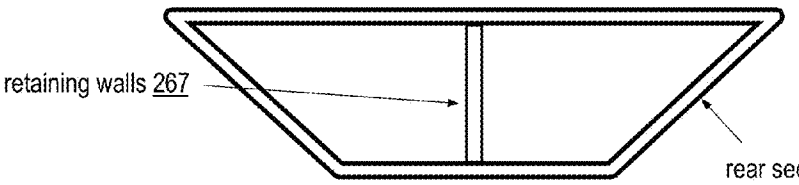
FIG. 93 is a top view diagram of an embodiment of a rear section of a sectional bullpen mound in accordance with the present invention.
Figure 94:
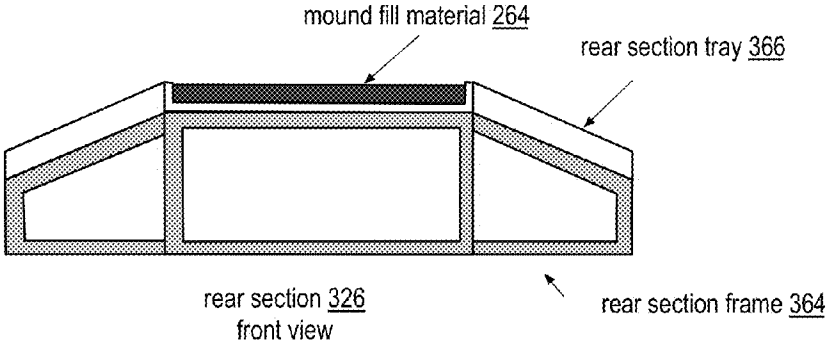
FIG. 94 is a front view diagram of an embodiment of a rear section of a sectional bullpen mound in accordance with the present invention.
Figure 95:
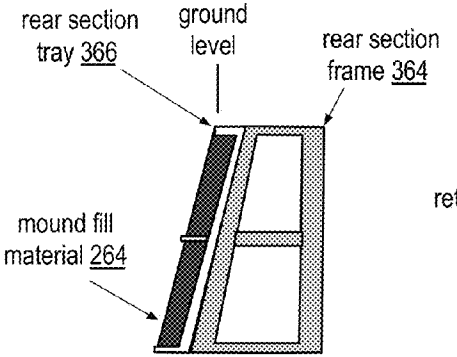
FIG. 95 is a side view diagram of an embodiment of a rear section of a sectional bullpen mound in accordance with the present invention.

FIG. 80 is a cross sectional side view diagram of an embodiment of a sectional bullpen pitching mound 320 coupled to a mounting platform 340. The sectional bullpen pitching mound 320 includes the level area 212, the sloped area 214, and one or more surrounding areas 322-328. The level area 212 includes the pitching rubber 18 or 102 and the replaceable drive area 20; and the sloped area 214 includes the replaceable landing area 22 and may further includes the access box 100.

The mounting platform 340 includes a securing mechanism (e.g., mounting hardware, pins, dowels, clips, latches, etc.) and the sections 212, 214, and 322-328 include complimentary securing mechanisms such that the sections 212, 214, and 322-328 securely mate with the mounting platform 340. The mounting platform 340 may be 6-12 inches below ground level and may be comprised of a concrete slab, a series of concrete posts, metal, wood, plastic, fiberglass, and/or a combination thereof. If the mounting platform 320 is a contiguous piece, it may further include drainage holes.

The one or more surrounding sections 322-328 slope from the level area 212 and/or the sloped area 214 to ground level. The slope of the surround sections 322-328 may be a linear decline, curved decline, or spherical decline. Note that, from surrounding section to surrounding section, the slope may be the same or different.

As an alternative to using a mounting platform 340, each of the sections 322-328 includes one or more mounting posts to secure the section into the ground. For example, the mounting posts may be stakes that are driven into the ground to secure the section to the ground. In addition, the sections have interlocking structures (e.g., tongue and groove, clips, latches, pins, dowels, hardware, etc.) to secure the sections together. Without the mounting platform 340, it may still be desirable to dig out a hole to place the sections of the bullpen mound to further add stability to the mound.

FIGS. 81-84 are a top view, a cross sectional inside view, an outside view, and a cross sectional top side view diagrams of an embodiment of a left section 324 of a sectional bullpen mound 310. The left section 324 includes a left section frame 350, a left section tray 352, and mound fill material 264. The frame 350 includes first securing mechanism (not shown) to secure the frame 350 to the tray section 352 and second securing mechanism (not shown) to secure the frame 350 to the mounting platform 340. The frame 350 may further include an interlocking mechanism (not shown) to connect to adjacent sections of the sectional pitching mound 320. The securing mechanisms may be one or more of screws, nuts & bolts, latches, clips, pins, adhesives, press-fit, welding, etc., and the interlocking mechanism may include one or more of tongue & groove, a securing mechanism, aligning guides, etc.

The left section tray 352 may be may be comprised of a rubber, fiberglass, plastic, carbon fiber, and/or another material that provides for some flexibility to minimize interference of use of the mound while securely holding the mound fill. Further, the tray 352 may be fabricated in a similar manner as the replaceable tray 32 or 42 and/or the receptacle 30 or 40. For instance, the tray 352 may include a textured interior surface, an array of fingers, and/or a flexible fringe top. In an example, the tray 352 has top view dimensions of an outer length of 13 feet 10 inches, a level area inner length of 34 inches, and a sloped area inner length of 72 inches.

From the top and/or inside views, the tray 352 has a height, or depth, of 3 to 6 inches. Also from the inside view perspective, the tray 352 has a first portion having a length of 72 inches that that corresponds to the length of the sloped area 214, a second portion having a length of 34 inches that corresponds to the level area 212 and two outer portions, each having a length of 2.5 feet. As shown in the top view, the outer edge of the tray 352 at the perimeter of the left section 324 is at ground level and the other end is at a height of 10 inches above ground level (which corresponds to the height of the level area). Note that the tray 352 may include a drainage feature (e.g., holes, a perforated bottom, etc.) to reduce collection of moisture. Further note that the tray 352 may include retaining walls 267 to facilitate holding the mound fill material in place, where the top edges of the retaining walls 267 may include a flexible fringe as previously discussed. Still further note that the tray 352 may omit the wall that abuts to the sloped area 214 and the level area 212.

The frame 350 may be comprised of a metal (e.g., aluminum, steel, etc.), fiberglass, plastic, carbon fiber, and/or another material that provides a solid base. In this example assume that the mounting platform 340 is 12 inches below ground level. With respect to the inside view, the frame 350 has a height of 6-9 inches at the bottom edge, sloping up at 1 inch per foot for six feet to a level area, where the height of the frame is 16-19 inches, and slopes back to a height of 6-9 inches. With respect to the top view, the frame has a height at its perimeter of 6 to 9 inches depending on the depth of the tray 352 and a height of 16-19 inches at the inner edge of the frame 350. The slope of the frame 350 from its perimeter to its top, bottom, and inner edges may be linear.

In an alternate embodiment, the left section 324 may omit the frame 350 and, as such, the left section tray 352 would extend to the mounting platform 340. In this embodiment, the tray 352 includes a securing mechanism for securing to the mounting platform and may further include an interlocking mechanism for securing to other sections of the bullpen mound 320. In an example, the tray 352 has dimensions of corresponding to the combination of the tray 352 and the frame 350. Note that the tray 352 may also include a drainage feature to reduce collection of moisture.

FIGS. 85-88 are a top view, an inside view, an outside view, and an upper side view diagrams of an embodiment of a right section 328 of a sectional bullpen mound 310. The right section 328 includes a right section frame 354, a right section tray 356, and mound fill material 264. The frame 354 includes first securing mechanism (not shown) to secure the frame 354 to the tray section 356 and second securing mechanism (not shown) to secure the frame 354 to the mounting platform 340. The frame 354 may further include an interlocking mechanism (not shown) to connect to adjacent sections of the sectional pitching mound 320. The securing mechanisms may be one or more of screws, nuts & bolts, latches, clips, pins, adhesives, press-fit, welding, etc., and the interlocking mechanism may include one or more of tongue & groove, a securing mechanism, aligning guides, etc.

The right section tray 356 may be may be comprised of a rubber, fiberglass, plastic, carbon fiber, and/or another material that provides for some flexibility to minimize interference of use of the mound while securely holding the mound fill. Further, the tray 356 may be fabricated in a similar manner as the replaceable tray 32 or 42 and/or the receptacle 30 or 40. For instance, the tray 356 may include a textured interior surface, an array of fingers, and/or a flexible fringe top. In an example, the tray 356 has top view dimensions of an outer length of 13 feet 10 inches, a level area inner length of 34 inches, and a sloped area inner length of 72 inches.

From the upper and/or inside views, the tray 356 has a height, or depth, of 3 to 6 inches. Also from the inside view perspective, the tray 356 has a first portion having a length of 72 inches that that corresponds to the length of the sloped area 214, a second portion having a length of 34 inches that corresponds to the level area 212 and two outer portions, each having a length of 2.5 feet. As shown in the upper view, the outer edge of the tray 356 at the perimeter of the right section 328 is at ground level and the other end is at a height of 10 inches above ground level (which corresponds to the height of the level area). Note that the tray 356 may include a drainage feature (e.g., holes, a perforated bottom, etc.) to reduce collection of moisture. Further note that the tray 356 may include retaining walls 267 to facilitate holding the mound fill material in place, where the top edges of the retaining walls 267 may include a flexible fringe as previously discussed. Still further note that the tray 356 may omit the wall that abuts to the sloped area 214 and the level area 212.

The frame 354 may be comprised of a metal (e.g., aluminum, steel, etc.), fiberglass, plastic, carbon fiber, and/or another material that provides a solid base. In this example assume that the mounting platform 340 is 12 inches below ground level. With respect to the inside view, the frame 354 has a height of 6-9 inches at the bottom edge, sloping up at 1 inch per foot for six feet to a level area, where the height of the frame is 16-19 inches, and slopes back to a height of 6-9 inches. With respect to the upper view, the frame has a height at its perimeter of 6 to 9 inches depending on the depth of the tray 352 and a height of 16-19 inches at the inner edge of the frame 354. The slope of the frame 354 from its perimeter to its top, bottom, and inner edges may be linear.

In an alternate embodiment, the right section 328 may omit the frame 354 and, as such, the right section tray 356 would extend to the mounting platform 340. In this embodiment, the tray 356 includes a securing mechanism for securing to the mounting platform and may further include an interlocking mechanism for securing to other sections of the bullpen mound 320. In an example, the tray 356 has dimensions of corresponding to the combination of the tray 356 and the frame 354. Note that the tray 356 may also include a drainage feature to reduce collection of moisture.

FIGS. 89-92 are a top view, a front view, a side view, and a rear view diagrams of an embodiment of a front section 322 of a sectional bullpen mound 310. The front section 322 includes a front section frame 360, a front section tray 362, and mound fill material 264. The frame 360 includes first securing mechanism (not shown) to secure the frame 360 to the tray section 362 and second securing mechanism (not shown) to secure the frame 360 to the mounting platform 340. The frame 360 may further include an interlocking mechanism (not shown) to connect to adjacent sections of the sectional pitching mound 320. The securing mechanisms may be one or more of screws, nuts & bolts, latches, clips, pins, adhesives, press-fit, welding, etc., and the interlocking mechanism may include one or more of tongue & groove, a securing mechanism, aligning guides, etc.

The front section tray 362 may be may be comprised of a rubber, fiberglass, plastic, carbon fiber, and/or another material that provides for some flexibility to minimize interference of use of the mound while securely holding the mound fill. Further, the tray 362 may be fabricated in a similar manner as the replaceable tray 32 or 42 and/or the receptacle 30 or 40. For instance, the tray 362 may include a textured interior surface, an array of fingers, and/or a flexible fringe top. In an example, the tray 362 has top view dimensions of an outer length of 10 feet and inner length of 60 inches.

From the rear and/or side views, the tray 362 has a height, or depth, of 3 to 6 inches. Also from the side view perspective, the tray 362 has a length of 2.5 feet and slopes from the height of the level area to ground level. As shown in the rear view, the inner edge of the tray 362, which abuts to the level area, is at a height of 10 inches above ground level (which corresponds to the height of the level area) and the outer edge is at ground level. Note that the tray 362 may include a drainage feature (e.g., holes, a perforated bottom, etc.) to reduce collection of moisture. Further note that the tray 362 may include retaining walls 267 to facilitate holding the mound fill material in place, where the top edges of the retaining walls 267 may include a flexible fringe as previously discussed. Still further note that the tray 362 may omit the wall that abuts to the level area 212.

The frame 360 may be comprised of a metal (e.g., aluminum, steel, etc.), fiberglass, plastic, carbon fiber, and/or another material that provides a solid base. In this example assume that the mounting platform 340 is 12 inches below ground level. With respect to the side view, the frame 360 has a height of 6-9 inches at the bottom edge, sloping up to a height of 16-19 inches. With respect to the front view, the frame has a height at its perimeter of 6 to 9 inches depending on the depth of the tray 362 and, with respect to the rear view, has a height of 16-19 inches at the inner edge abutting the level area 212. The slope of the frame 360 from its perimeter to its top, bottom, and inner edges may be linear.

In an alternate embodiment, the front section 322 may omit the frame 360 and, as such, the front section tray 362 would extend to the mounting platform 340. In this embodiment, the tray 362 includes a securing mechanism for securing to the mounting platform and may further include an interlocking mechanism for securing to other sections of the bullpen mound 320. In an example, the tray 362 has dimensions of corresponding to the combination of the tray 362 and the frame 360. Note that the tray 362 may also include a drainage feature to reduce collection of moisture.

FIGS. 93-96 are a top view, a front view, a side view, and a rear view diagrams of an embodiment of a rear section 326 of a sectional bullpen mound 310. The rear section 326 includes a rear section frame 364, a rear section tray 364, and mound fill material 264. The frame 364 includes first securing mechanism (not shown) to secure the frame 364 to the tray section 366 and second securing mechanism (not shown) to secure the frame 366 to the mounting platform 340. The frame 364 may further include an interlocking mechanism (not shown) to connect to adjacent sections of the sectional pitching mound 320. The securing mechanisms may be one or more of screws, nuts & bolts, latches, clips, pins, adhesives, press-fit, welding, etc., and the interlocking mechanism may include one or more of tongue & groove, a securing mechanism, aligning guides, etc.

The rear section tray 366 may be may be comprised of a rubber, fiberglass, plastic, carbon fiber, and/or another material that provides for some flexibility to minimize interference of use of the mound while securely holding the mound fill. Further, the tray 366 may be fabricated in a similar manner as the replaceable tray 32 or 42 and/or the receptacle 30 or 40. For instance, the tray 366 may include a textured interior surface, an array of fingers, and/or a flexible fringe top. In an example, the tray 366 has top view dimensions of an outer length of 10 feet and inner length of 60 inches.

From the rear and/or side views, the tray 366 has a height, or depth, of 3 to 6 inches. Also from the side view perspective, the tray 366 has a length of 2.5 feet and slopes from the height of the level area to ground level. As shown in the front view, the inner edge of the tray 366, which abuts to the level area, is at a height of 10 inches above ground level (which corresponds to the height of the level area) and the outer edge is at ground level. Note that the tray 366 may include a drainage feature (e.g., holes, a perforated bottom, etc.) to reduce collection of moisture. Further note that the tray 366 may include retaining walls 267 to facilitate holding the mound fill material in place, where the top edges of the retaining walls 267 may include a flexible fringe as previously discussed. Still further note that the tray 366 may omit the wall that abuts to the level area 212.

The frame 364 may be comprised of a metal (e.g., aluminum, steel, etc.), fiberglass, plastic, carbon fiber, and/or another material that provides a solid base. In this example assume that the mounting platform 340 is 12 inches below ground level. With respect to the side view, the frame 364 has a height of 6-9 inches at the bottom edge, sloping up to a height of 16-19 inches. With respect to the rear view, the frame has a height at its perimeter of 6 to 9 inches depending on the depth of the tray 366 and, with respect to the front view, has a height of 16-19 inches at the inner edge abutting the level area 212. The slope of the frame 364 from its perimeter to its top, bottom, and inner edges may be linear.

In an alternate embodiment, the rear section 326 may omit the frame 364 and, as such, the rear section tray 366 would extend to the mounting platform 340. In this embodiment, the tray 366 includes a securing mechanism for securing to the mounting platform and may further include an interlocking mechanism for securing to other sections of the bullpen mound 320. In an example, the tray 366 has dimensions of corresponding to the combination of the tray 366 and the frame 364. Note that the tray 366 may also include a drainage feature to reduce collection of moisture.

Figure 97:
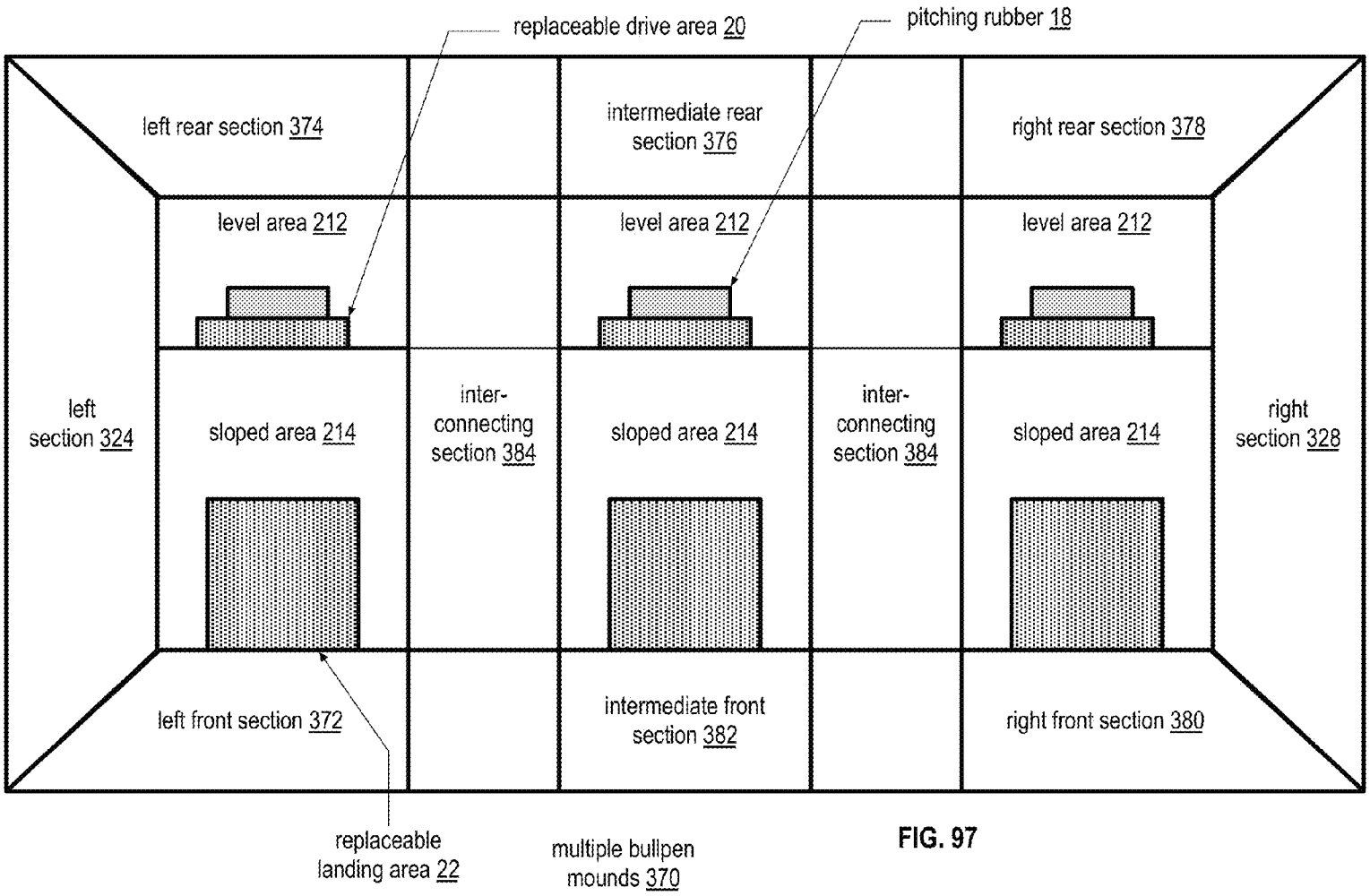
FIG. 97 is a top view diagram of an embodiment of sectional multiple bullpen mounds in accordance with the present invention.
Figures 98, 99, 100, 101:
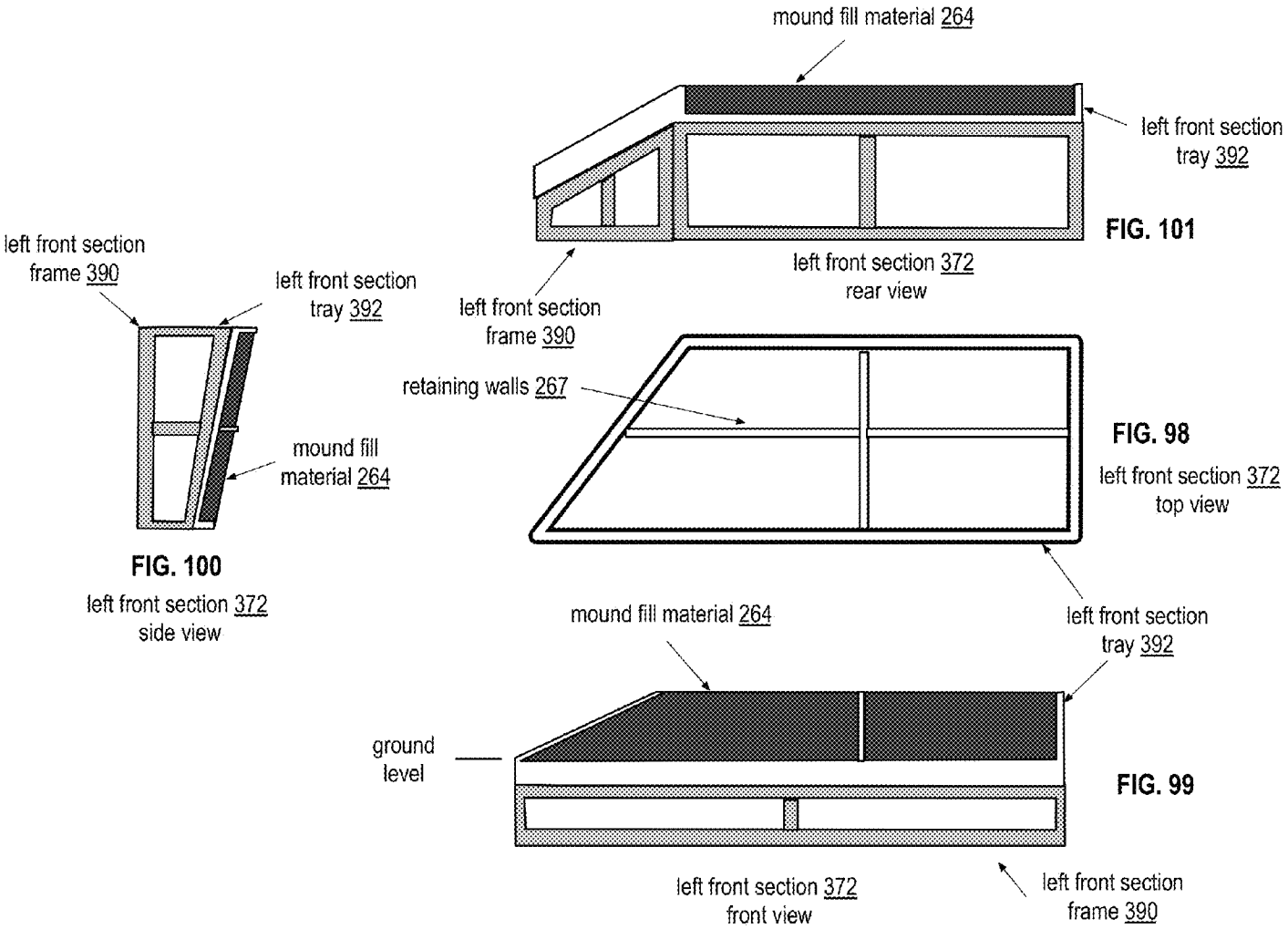
FIG. 98 is a top view diagram of an embodiment of a left front section of sectional multiple bullpen mounds in accordance with the present invention.
FIG. 99 is a front view diagram of an embodiment of a left front section of sectional multiple bullpen mounds in accordance with the present invention.
FIG. 100 is a side view diagram of an embodiment of a left front section of sectional multiple bullpen mounds in accordance with the present invention.
FIG. 101 is a rear view diagram of an embodiment of a left front section of sectional multiple bullpen mounds in accordance with the present invention.
Figure 109:
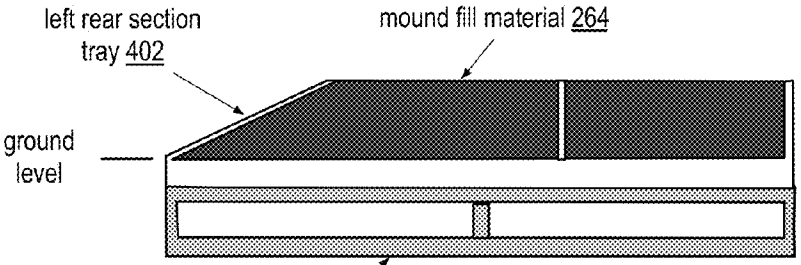
FIG. 109 is a rear view diagram of an embodiment of a left rear section of sectional multiple bullpen mounds in accordance with the present invention.
Figure 106:
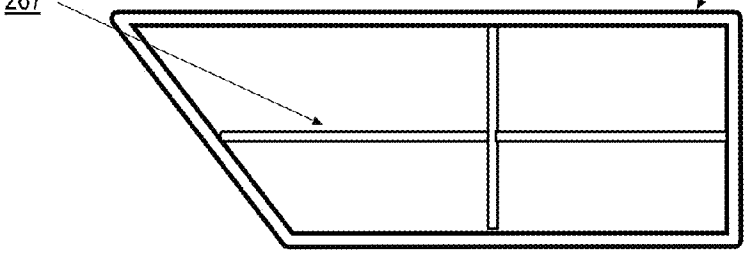
FIG. 106 is a top view diagram of an embodiment of a left rear section of sectional multiple bullpen mounds in accordance with the present invention.
Figure 107:
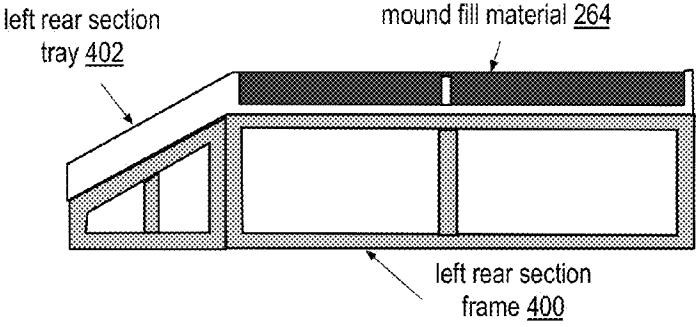
FIG. 107 is a front view diagram of an embodiment of a left rear section of sectional multiple bullpen mounds in accordance with the present invention.
Figure 108:
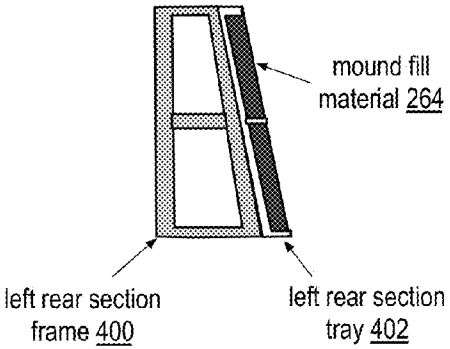
FIG. 108 is a side view diagram of an embodiment of a left rear section of sectional multiple bullpen mounds in accordance with the present invention.
Figure 113:
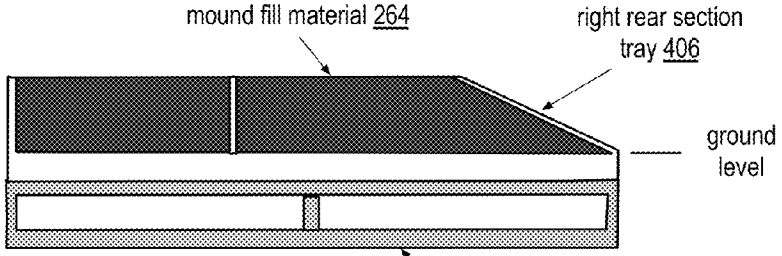
FIG. 113 is a rear view diagram of an embodiment of a right rear section of sectional multiple bullpen mounds in accordance with the present invention.
Figure 110:
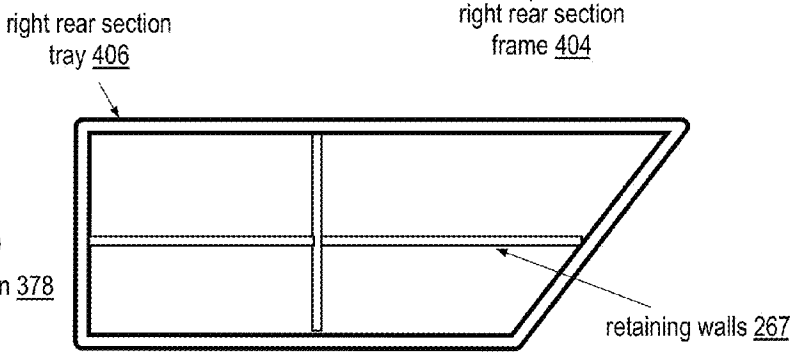
FIG. 110 is a top view diagram of an embodiment of a right rear section of sectional multiple bullpen mounds in accordance with the present invention.
Figure 112:
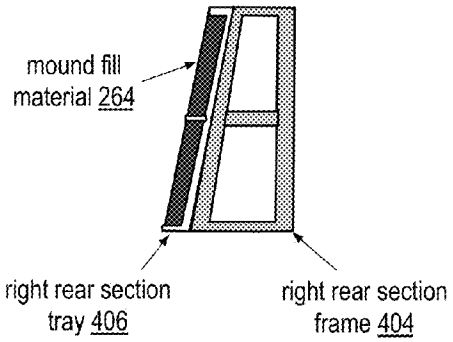
FIG. 112 is a side view diagram of an embodiment of a right rear section of sectional multiple bullpen mounds in accordance with the present invention.
Figure 111:
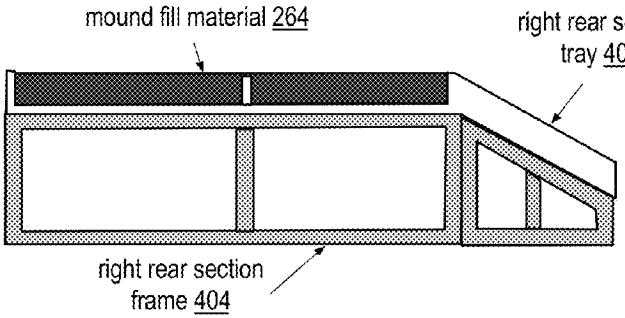
FIG. 111 is a front view diagram of an embodiment of a right rear section of sectional multiple bullpen mounds in accordance with the present invention.

FIG. 97 is a top view diagram of an embodiment of sectional multiple bullpen mounds 370 that includes several level areas 212, several sloped areas 214, a left front section 372, the left section 324, a left rear section 374, an intermediate rear section 376, a right rear section 378, the right section 328, a right front section 380, an intermediate front section 382, and interconnecting sections 384. The sectional multiple bullpen mounds 370 may include more or less than 3 pitching areas (e.g., the combination of a level area and a sloped area). For example, if the sectional multiple bullpen mounds 370 include two pitching areas, then bullpen mounds would eliminate the center pitching area, one of the interconnecting sections 384, the intermediate rear section 376, and the intermediate front section 382. As another example, if the sectional multiple bullpen mounds 370 includes four pitching areas, then an additional pitching area, an interconnecting section 384, an intermediate rear section 376, and an intermediate front section 382 would be included to the left or to the right of the center pitching area of the present figure.

The overall dimensions of the sectional multiple bullpen mounds 370 will vary depending on the number of pitching areas. In one example, the sectional multiple bullpen mounds includes 3 pitching areas may be 26 feet wide (e.g., 5 feet for the width of each of the level areas 212 and the sloped areas 214, 2.5 feet for each of the left and right sections 324 and 328, and 3 feet for each of the interconnecting sections 384) by 13 feet 10 inches (e.g., 34 inches for the level area 212, 72 inches for the sloped area 214, and 2.5 feet for each of the various rear and front sections 372-382).

Each of the surrounding sections 372-382 and the interconnecting sections 384 slopes from the level area 212 and/or from the sloped area 214 to ground level at their peripheries and may include a base and one or more trays to hold mound fill material. The various sections of the bullpen mounds 370 connect to each other to form multiple unified bullpen mounds that, with respect to the level area and sloped area, conforms to baseball rules (e.g., a height of 10 inches, the level area is 34×60 inches, and the sloped area is 60×72 inches with a slope of 1 inch per foot). The connecting of the sections may be done by abutment, by track mechanisms, by hardware, etc. Note that there may be more or less surrounding areas based on ease of movement, ease of assembly, etc. Further note that once the bullpen mounds 370 are assembled, it may be desirable to add and tamp mound fill material along the edges of the sections to better blend the sections together. The sectional multiple bullpen mounds 320 provide bullpen mounds that conform to the baseball rules and ones that can be repeatedly created and recreated from baseball field to baseball field. Note that the sectional multiple bullpen mounds 370 may include a mounting platform similar to mounting platform 340 of FIG. 80.

FIGS. 98-102 are a top view, a front view, a side view, and a rear view diagrams of an embodiment of a left front section 372 of sectional multiple bullpen mounds 370. The left front section 372 includes a left front section frame 390, a left front section tray 392, and mound fill material 264. The frame 390 includes first securing mechanism (not shown) to secure the frame 390 to the tray section 392 and second securing mechanism (not shown) to secure the frame 390 to a mounting platform. The frame 390 may further include an interlocking mechanism (not shown) to connect to adjacent sections of the sectional multiple bullpen mounds 370.

The left front section tray 392 may be may be comprised of a rubber, fiberglass, plastic, carbon fiber, and/or another material that provides for some flexibility to minimize interference of use of the mound while securely holding the mound fill. Further, the tray 392 may be fabricated in a similar manner as the replaceable tray 32 or 42 and/or the receptacle 30 or 40. For instance, the tray 392 may include a textured interior surface, an array of fingers, and/or a flexible fringe top. In an example, the tray 392 has top view dimensions of an outer length of 7.5 feet and inner length of 60 inches.

From the rear and/or side views, the tray 392 has a height, or depth, of 3 to 6 inches. Also from the side view perspective, the tray 392 has a length of 2.5 feet and slopes from the height of the front edge of the landing area 214 (e.g., 4 inches above ground level) to ground level. As shown in the front view, the inner edge of the tray 392, which abuts to the front edge of the sloped area 214, is at a height of 4 inches above ground level, and a length of 60 inches. The outer edge is at ground level and has a length of 7.5 feet. Note that the tray 392 may include a drainage feature (e.g., holes, a perforated bottom, etc.) to reduce collection of moisture. Further note that the tray 392 may include retaining walls 267 to facilitate holding the mound fill material in place, where the top edges of the retaining walls 267 may include a flexible fringe as previously discussed. Still further note that the tray 392 may omit the wall that abuts to one or more adjacent sections.

The frame 390 may be comprised of a metal (e.g., aluminum, steel, etc.), fiberglass, plastic, carbon fiber, and/or another material that provides a solid base. In this example assume that the mounting platform is 12 inches below ground level. With respect to the side view, the frame 390 has a height of 6-9 inches at the bottom edge, sloping up to a height of 10-13 inches. With respect to the rear view, the frame 390 has a height at its perimeter of 6 to 9 inches depending on the depth of the tray 392 and, with respect to the front view, has a height of 10-13 inches at the inner edge abutting the sloped area 214. The slope of the frame 390 from its perimeter to its top, bottom, and inner edges may be linear. Further, the angular edge may be at a 45 degree angle to abut to the left section 324.

In an alternate embodiment, the left front section 372 may omit the frame 390 and, as such, the left front section tray 392 would extend to the mounting platform. In this embodiment, the tray 392 includes a securing mechanism for securing to the mounting platform and may further include an interlocking mechanism for securing to other sections of the bullpen mounds 370. In an example, the tray 392 has dimensions of corresponding to the combination of the tray 392 and the frame 390. Note that the tray 392 may also include a drainage feature to reduce collection of moisture.

FIGS. 102-105 are a top view, a front view, a side view, and a rear view diagrams of an embodiment of a right front section 380 of sectional multiple bullpen mounds 370. The right front section 380 includes a right front section frame 394, a right front section tray 396, and mound fill material 264. The frame 394 includes first securing mechanism (not shown) to secure the frame 394 to the tray section 394 and second securing mechanism (not shown) to secure the frame 394 to a mounting platform. The frame 394 may further include an interlocking mechanism (not shown) to connect to adjacent sections of the sectional multiple bullpen mounds 370.

The right front section tray 396 may be may be comprised of a rubber, fiberglass, plastic, carbon fiber, and/or another material that provides for some flexibility to minimize interference of use of the mound while securely holding the mound fill. Further, the tray 396 may be fabricated in a similar manner as the replaceable tray 32 or 42 and/or the receptacle 30 or 40. For instance, the tray 396 may include a textured interior surface, an array of fingers, and/or a flexible fringe top. In an example, the tray 396 has top view dimensions of an outer length of 7.5 feet and inner length of 60 inches.

From the front and/or side views, the tray 396 has a height, or depth, of 3 to 6 inches. Also from the side view perspective, the tray 396 has a length of 2.5 feet and slopes from the height of the front edge of the landing area 214 (e.g., 4 inches above ground level) to ground level. As shown in the front view, the inner edge of the tray 396, which abuts to the front edge of the sloped area 214, is at a height of 4 inches above ground level, and a length of 60 inches. The outer edge is at ground level and has a length of 7.5 feet. Note that the tray 396 may include a drainage feature (e.g., holes, a perforated bottom, etc.) to reduce collection of moisture. Further note that the tray 396 may include retaining walls 267 to facilitate holding the mound fill material in place, where the top edges of the retaining walls 267 may include a flexible fringe as previously discussed. Still further note that the tray 396 may omit the wall that abuts to one or more adjacent sections.

The frame 394 may be comprised of a metal (e.g., aluminum, steel, etc.), fiberglass, plastic, carbon fiber, and/or another material that provides a solid base. In this example assume that the mounting platform is 12 inches below ground level. With respect to the side view, the frame 394 has a height of 6-9 inches at the bottom edge, sloping up to a height of 10-13 inches. With respect to the rear view, the frame 394 has a height at its perimeter of 6 to 9 inches depending on the depth of the tray 396 and, with respect to the front view, has a height of 10-13 inches at the inner edge abutting the sloped area 214. The slope of the frame 394 from its perimeter to its top, bottom, and inner edges may be linear. Further, the angular edge may be at a 45 degree angle to abut to the right section 328.

In an alternate embodiment, the right front section 380 may omit the frame 394 and, as such, the right front section tray 396 would extend to the mounting platform. In this embodiment, the tray 396 includes a securing mechanism for securing to the mounting platform and may further include an interlocking mechanism for securing to other sections of the bullpen mounds 370. In an example, the tray 396 has dimensions of corresponding to the combination of the tray 396 and the frame 394. Note that the tray 396 may also include a drainage feature to reduce collection of moisture.

FIGS. 106-109 are a top view, a front view, a side view, and a rear view diagrams of an embodiment of a left rear section 374 of sectional multiple bullpen mounds 370. The left rear section 374 includes a left rear section frame 400, a left rear section tray 402, and mound fill material 264. The frame 400 includes first securing mechanism (not shown) to secure the frame 400 to the tray section 402 and second securing mechanism (not shown) to secure the frame 400 to a mounting platform. The frame 400 may further include an interlocking mechanism (not shown) to connect to adjacent sections of the sectional multiple bullpen mounds 370.

The left rear section tray 402 may be may be comprised of a rubber, fiberglass, plastic, carbon fiber, and/or another material that provides for some flexibility to minimize interference of use of the mound while securely holding the mound fill. Further, the tray 402 may be fabricated in a similar manner as the replaceable tray 32 or 42 and/or the receptacle 30 or 40. For instance, the tray 402 may include a textured interior surface, an array of fingers, and/or a flexible fringe top. In an example, the tray 402 has top view dimensions of an outer length of 7.5 feet and inner length of 60 inches.

From the front and/or side views, the tray 402 has a height, or depth, of 3 to 6 inches. Also from the side view perspective, the tray 402 has a length of 2.5 feet and slopes from the height of the back edge of the level area 212 (e.g., 10 inches above ground level) to ground level. As shown in the front view, the inner edge of the tray 402, which abuts to the back edge of the level area 212, is at a height of 10 inches above ground level, and a length of 60 inches. The outer edge is at ground level and has a length of 7.5 feet. Note that the tray 402 may include a drainage feature (e.g., holes, a perforated bottom, etc.) to reduce collection of moisture. Further note that the tray 402 may include retaining walls 267 to facilitate holding the mound fill material in place, where the top edges of the retaining walls 267 may include a flexible fringe as previously discussed. Still further note that the tray 402 may omit the wall that abuts to one or more adjacent sections.

The frame 400 may be comprised of a metal (e.g., aluminum, steel, etc.), fiberglass, plastic, carbon fiber, and/or another material that provides a solid base. In this example assume that the mounting platform is 12 inches below ground level. With respect to the side view, the frame 400 has a height of 6-9 inches at the bottom edge, sloping up to a height of 16-19 inches. With respect to the rear view, the frame 400 has a height at its perimeter of 6 to 9 inches depending on the depth of the tray 402 and, with respect to the front view, has a height of 16-19 inches at the inner edge abutting the level area 212. The slope of the frame 400 from its perimeter to its top, bottom, and inner edges may be linear. Further, the angular edge may be at a 45 degree angle to abut to the left section 324.

In an alternate embodiment, the left rear section 374 may omit the frame 400 and, as such, the left rear section tray 402 would extend to the mounting platform. In this embodiment, the tray 402 includes a securing mechanism for securing to the mounting platform and may further include an interlocking mechanism for securing to other sections of the bullpen mounds 370. In an example, the tray 402 has dimensions of corresponding to the combination of the tray 402 and the frame 400. Note that the tray 402 may also include a drainage feature to reduce collection of moisture.

FIGS. 110-113 are a top view, a front view, a side view, and a rear view diagrams of an embodiment of a right rear section 378 of sectional multiple bullpen mounds 370. The right rear section 378 includes a right rear section frame 404, a right rear section tray 406, and mound fill material 264. The frame 404 includes first securing mechanism (not shown) to secure the frame 404 to the tray section 406 and second securing mechanism (not shown) to secure the frame 404 to a mounting platform. The frame 404 may further include an interlocking mechanism (not shown) to connect to adjacent sections of the sectional multiple bullpen mounds 370.

The right rear section tray 406 may be may be comprised of a rubber, fiberglass, plastic, carbon fiber, and/or another material that provides for some flexibility to minimize interference of use of the mound while securely holding the mound fill. Further, the tray 406 may be fabricated in a similar manner as the replaceable tray 32 or 42 and/or the receptacle 30 or 40. For instance, the tray 406 may include a textured interior surface, an array of fingers, and/or a flexible fringe top. In an example, the tray 406 has top view dimensions of an outer length of 7.5 feet and inner length of 60 inches.

From the front and/or side views, the tray 404 has a height, or depth, of 3 to 6 inches. Also from the side view perspective, the tray 404 has a length of 2.5 feet and slopes from the height of the back edge of the level area 212 (e.g., 10 inches above ground level) to ground level. As shown in the front view, the inner edge of the tray 406, which abuts to the back edge of the level area 212, is at a height of 10 inches above ground level, and a length of 60 inches. The outer edge is at ground level and has a length of 7.5 feet. Note that the tray 406 may include a drainage feature (e.g., holes, a perforated bottom, etc.) to reduce collection of moisture. Further note that the tray 406 may include retaining walls 267 to facilitate holding the mound fill material in place, where the top edges of the retaining walls 267 may include a flexible fringe as previously discussed. Still further note that the tray 406 may omit the wall that abuts to one or more adjacent sections.

The frame 404 may be comprised of a metal (e.g., aluminum, steel, etc.), fiberglass, plastic, carbon fiber, and/or another material that provides a solid base. In this example assume that the mounting platform is 12 inches below ground level. With respect to the side view, the frame 404 has a height of 6-9 inches at the bottom edge, sloping up to a height of 16-19 inches. With respect to the rear view, the frame 404 has a height at its perimeter of 6 to 9 inches depending on the depth of the tray 402 and, with respect to the front view, has a height of 16-19 inches at the inner edge abutting the level area 212. The slope of the frame 404 from its perimeter to its top, bottom, and inner edges may be linear. Further, the angular edge may be at a 45 degree angle to abut to the right section 328.

In an alternate embodiment, the right rear section 378 may omit the frame 404 and, as such, the left rear section tray 406 would extend to the mounting platform. In this embodiment, the tray 406 includes a securing mechanism for securing to the mounting platform and may further include an interlocking mechanism for securing to other sections of the bullpen mounds 370. In an example, the tray 406 has dimensions of corresponding to the combination of the tray 406 and the frame 404. Note that the tray 406 may also include a drainage feature to reduce collection of moisture.

Figure 114:
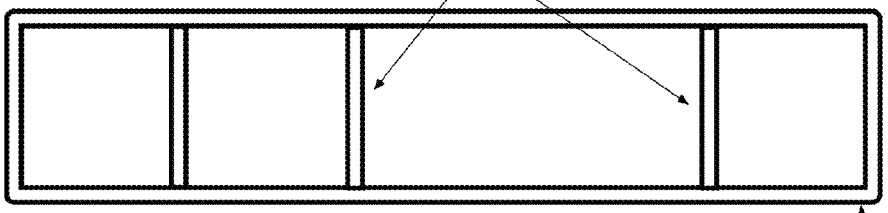
FIG. 114 is a top view diagram of an embodiment of an interconnecting section of sectional multiple bullpen mounds in accordance with the present invention.
Figure 115:
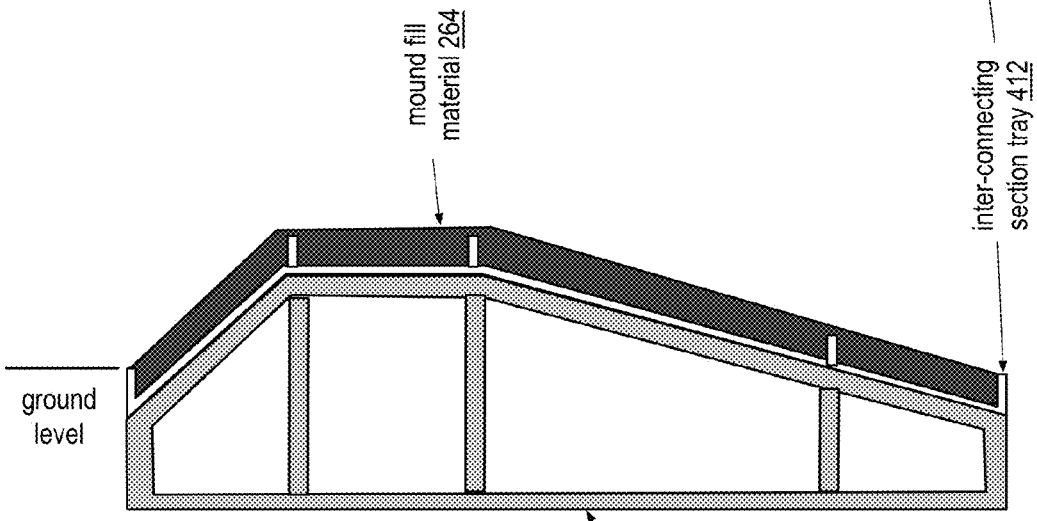
FIG. 115 is a side view diagram of an embodiment of an interconnecting section of sectional multiple bullpen mounds in accordance with the present invention.

FIGS. 114 and 115 are a top view and a side view diagrams of an embodiment of an interconnecting section 384 of sectional multiple bullpen mounds 370. The interconnecting section 384 includes an interconnecting section frame 410, an interconnecting section tray 412, and mound fill material 264. The frame 410 includes first securing mechanism (not shown) to secure the frame 410 to the tray section 412 and second securing mechanism (not shown) to secure the frame 410 to a mounting platform. The frame 410 may further include an interlocking mechanism (not shown) to connect to adjacent sections of the sectional multiple bullpen mounds 370.

The interconnecting section tray 412 may be may be comprised of a rubber, fiberglass, plastic, carbon fiber, and/or another material that provides for some flexibility to minimize interference of use of the mound while securely holding the mound fill. Further, the tray 412 may be fabricated in a similar manner as the replaceable tray 32 or 42 and/or the receptacle 30 or 40. For instance, the tray 412 may include a textured interior surface, an array of fingers, and/or a flexible fringe top. In an example, the tray 412 has top view dimensions of a length of 13 feet-10 inches and a width of 3 feet.

From the side view, the tray 412 has a height, or depth, of 3 to 6 inches. Also from the side view perspective, the tray 412 has a length of 13 feet-10 inches and has several regions with various slopes. The first region slopes from the back edge, which is at ground level, to the level area 212. The second region is flat and corresponds to the level area. The third region slopes downward at 1 inch per foot corresponding to the slope of the sloped area 214. The fourth region slopes from the front edge of the sloped area to ground level. Note that the tray 412 may include a drainage feature (e.g., holes, a perforated bottom, etc.) to reduce collection of moisture. Further note that the tray 412 may include retaining walls 267 to facilitate holding the mound fill material in place, where the top edges of the retaining walls 267 may include a flexible fringe as previously discussed. Still further note that the tray 412 may omit the wall that abuts to one or more adjacent sections.

The frame 410 may be comprised of a metal (e.g., aluminum, steel, etc.), fiberglass, plastic, carbon fiber, and/or another material that provides a solid base. In this example assume that the mounting platform is 12 inches below ground level. With respect to the side view, the frame 410 includes four regions, each 3 feet wide. The first region has a height of 6-9 inches at the outer edge, a height of 16-19 inches at the inner edge, which corresponds to the level area, and length of 2.5 feet. The second region of the frame 410 is level, which corresponds to the level area, and has a height of 16-19 inches and a length of 34 inches. The third region of the frame 410 slopes from 16-19 to 10-13 at a slope of 1 inch per foot, which corresponds to the sloped area 214, and has a length of 6 feet. The fourth region of the frame 410 slopes for 10-13 inches to 6-9 inches and has a length of 2.5 feet.

In an alternate embodiment, the interconnecting section 384 may omit the frame 410 and, as such, the interconnection section tray 412 would extend to the mounting platform. In this embodiment, the tray 412 includes a securing mechanism for securing to the mounting platform and may further include an interlocking mechanism for securing to other sections of the bullpen mounds 370. In an example, the tray 412 has dimensions of corresponding to the combination of the tray 412 and the frame 410. Note that the tray 412 may also include a drainage feature to reduce collection of moisture.

Figures 116, 117:
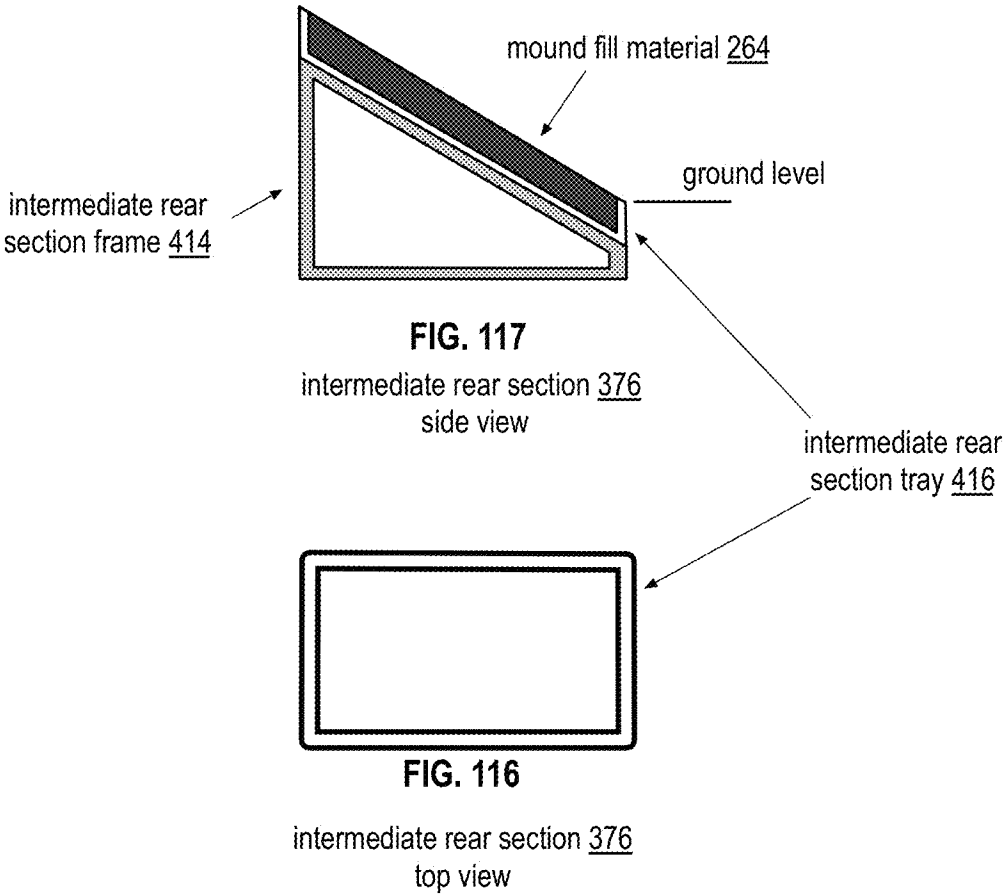
FIG. 116 is a top view diagram of an embodiment of an intermediate rear section of sectional multiple bullpen mounds in accordance with the present invention.
FIG. 117 is a side view diagram of an embodiment of an intermediate rear section of sectional multiple bullpen mounds in accordance with the present invention.

FIGS. 116 and 117 are a top view and a side view diagrams of an embodiment of an intermediate rear section 376 of sectional multiple bullpen mounds 370. The intermediate rear section 376 includes an intermediate rear section frame 414, an intermediate rear section tray 416, and mound fill material 264. The frame 414 includes first securing mechanism (not shown) to secure the frame 414 to the tray section 416 and second securing mechanism (not shown) to secure the frame 414 to a mounting platform. The frame 414 may further include an interlocking mechanism (not shown) to connect to adjacent sections of the sectional multiple bullpen mounds 370.

The intermediate rear section tray 416 may be may be comprised of a rubber, fiberglass, plastic, carbon fiber, and/or another material that provides for some flexibility to minimize interference of use of the mound while securely holding the mound fill. Further, the tray 416 may be fabricated in a similar manner as the replaceable tray 32 or 42 and/or the receptacle 30 or 40. For instance, the tray 416 may include a textured interior surface, an array of fingers, and/or a flexible fringe top. In an example, the tray 416 has top view dimensions of a length of 2.5 feet and a width of 3 feet.

From the side view, the tray 416 has a height, or depth, of 3 to 6 inches. Also from the side view, the tray 416 has a length of 2.5 feet and slopes from ground level to the back edge of the level area 212. Note that the tray 416 may include a drainage feature (e.g., holes, a perforated bottom, etc.) to reduce collection of moisture. Further note that the tray 416 may omit the wall that abuts to one or more adjacent sections.

The frame 414 may be comprised of a metal (e.g., aluminum, steel, etc.), fiberglass, plastic, carbon fiber, and/or another material that provides a solid base. In this example assume that the mounting platform is 12 inches below ground level. With respect to the side view, the frame 414 has a height of 6-9 inches at the outer edge, a height of 16-19 inches at the inner edge, which corresponds to the level area, and length of 2.5 feet.

In an alternate embodiment, the intermediate rear section 376 may omit the frame 414 and, as such, the interconnection section tray 416 would extend to the mounting platform. In this embodiment, the tray 416 includes a securing mechanism for securing to the mounting platform and may further include an interlocking mechanism for securing to other sections of the bullpen mounds 370. In an example, the tray 416 has dimensions of corresponding to the combination of the tray 416 and the frame 414. Note that the tray 416 may also include a drainage feature to reduce collection of moisture.

Figures 118, 119:
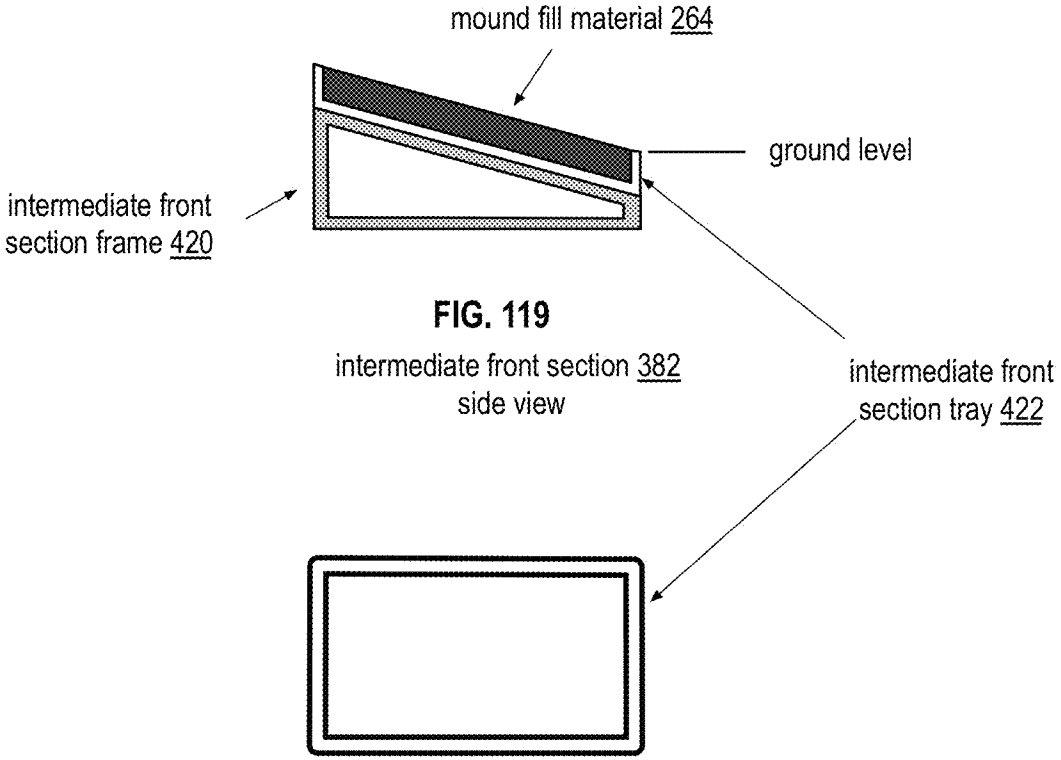
FIG. 118 is a top view diagram of an embodiment of an intermediate front section of sectional multiple bullpen mounds in accordance with the present invention.
FIG. 119 is a side view diagram of an embodiment of an intermediate front section of sectional multiple bullpen mounds in accordance with the present invention.

FIGS. 118 and 119 are a top view and a side view diagrams of an embodiment of an intermediate front section 382 of sectional multiple bullpen mounds 370. The intermediate front section 382 includes an intermediate front section frame 420, an intermediate front section tray 422, and mound fill material 264. The frame 420 includes first securing mechanism (not shown) to secure the frame 420 to the tray section 422 and second securing mechanism (not shown) to secure the frame 420 to a mounting platform. The frame 420 may further include an interlocking mechanism (not shown) to connect to adjacent sections of the sectional multiple bullpen mounds 370.

The intermediate rear section tray 422 may be may be comprised of a rubber, fiberglass, plastic, carbon fiber, and/or another material that provides for some flexibility to minimize interference of use of the mound while securely holding the mound fill. Further, the tray 422 may be fabricated in a similar manner as the replaceable tray 32 or 42 and/or the receptacle 30 or 40. For instance, the tray 422 may include a textured interior surface, an array of fingers, and/or a flexible fringe top. In an example, the tray 422 has top view dimensions of a length of 2.5 feet and a width of 3 feet.

From the side view, the tray 422 has a height, or depth, of 3 to 6 inches. Also from the side view, the tray 422 has a length of 2.5 feet and slopes from ground level to the front edge of the sloped area 214. Note that the tray 422 may include a drainage feature (e.g., holes, a perforated bottom, etc.) to reduce collection of moisture. Further note that the tray 422 may omit the wall that abuts to one or more adjacent sections.

The frame 420 may be comprised of a metal (e.g., aluminum, steel, etc.), fiberglass, plastic, carbon fiber, and/or another material that provides a solid base. In this example assume that the mounting platform is 12 inches below ground level. With respect to the side view, the frame 420 has a height of 6-9 inches at the outer edge, a height of 10-113 inches at the inner edge, which corresponds to the sloped area, and length of 2.5 feet.

In an alternate embodiment, the intermediate left section 382 may omit the frame 420 and, as such, the interconnection section tray 422 would extend to the mounting platform. In this embodiment, the tray 422 includes a securing mechanism for securing to the mounting platform and may further include an interlocking mechanism for securing to other sections of the bullpen mounds 370. In an example, the tray 422 has dimensions of corresponding to the combination of the tray 422 and the frame 420. Note that the tray 422 may also include a drainage feature to reduce collection of moisture.

Figure 120:
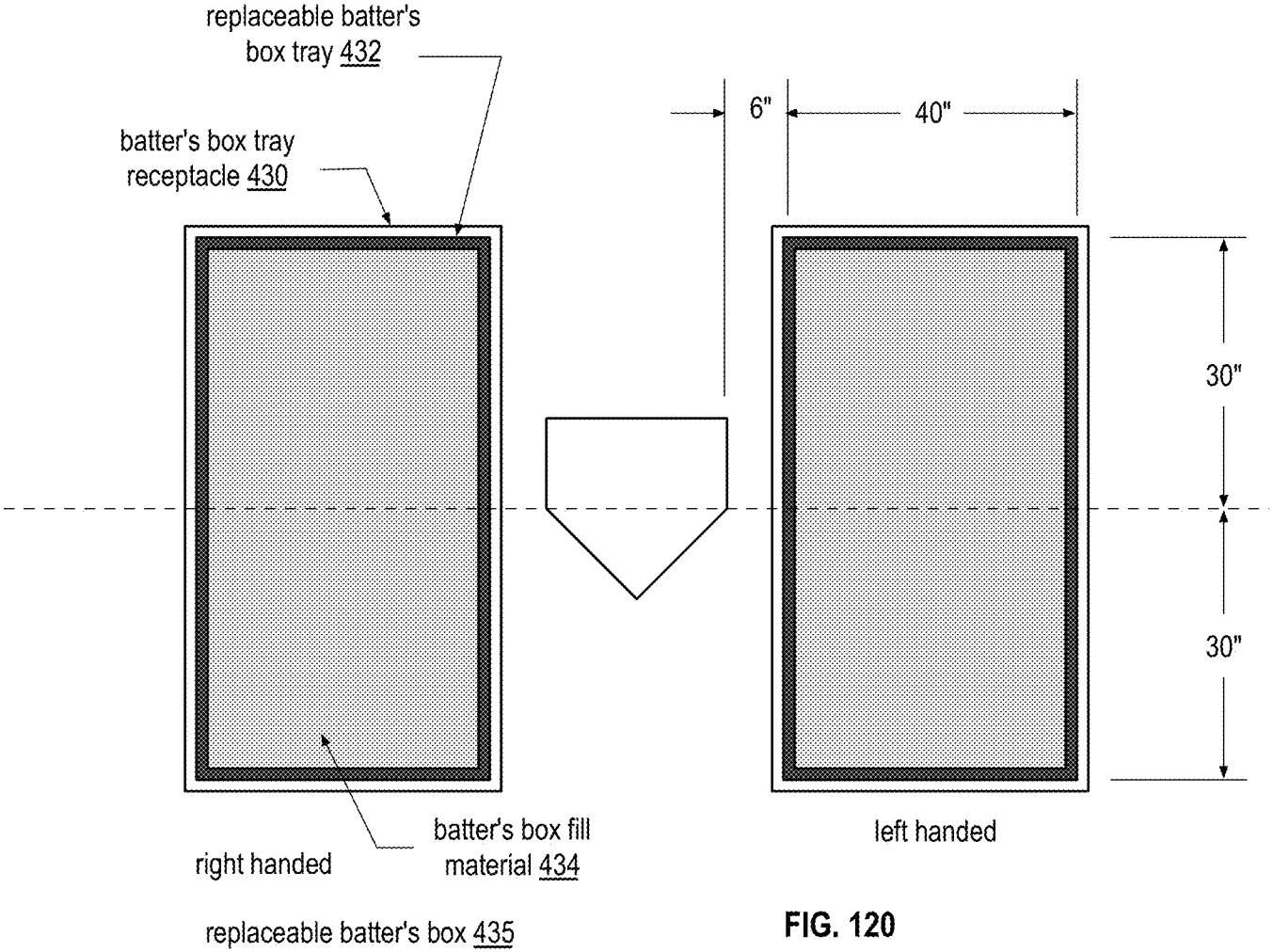
FIG. 120 is a top view diagram of an embodiment of a replaceable batter's box in accordance with the present invention.

FIG. 120 is a top view diagram of an embodiment of a replaceable batter's box 435 that includes a left-handed batter's box and a right-handed batter's box. The left and right-handed batter's boxes are similar and include a batter's box tray receptacle 430, a replaceable batter's box tray 432, and batter's box fill material 434. The fill material may be dirt, clay, a moisture absorbent material, a composite material, rubber composite, and/or a combination thereof.

Each of the batter's box is 6 inches from home plate, is 40 inches wide, and 60 inches long. Further, each batter's box may include chalk lines at its perimeter. As such, every time the batter's boxes are replaced, the chalk lines are also replaced. Note that the replaceable batter's box trays and corresponding receptacles may be the same size as the batter's box or may be up to 12 inches larger in one or more directions than the batter's box.

As an alternative to replacing the entire batter's box, one or more sections may be replaced. For example, the batter's box may be divided into two or more sections, where each section includes a receptacle and a tray. As the fill material in a section is worn down from use, the section can be replaced.

Figure 121:
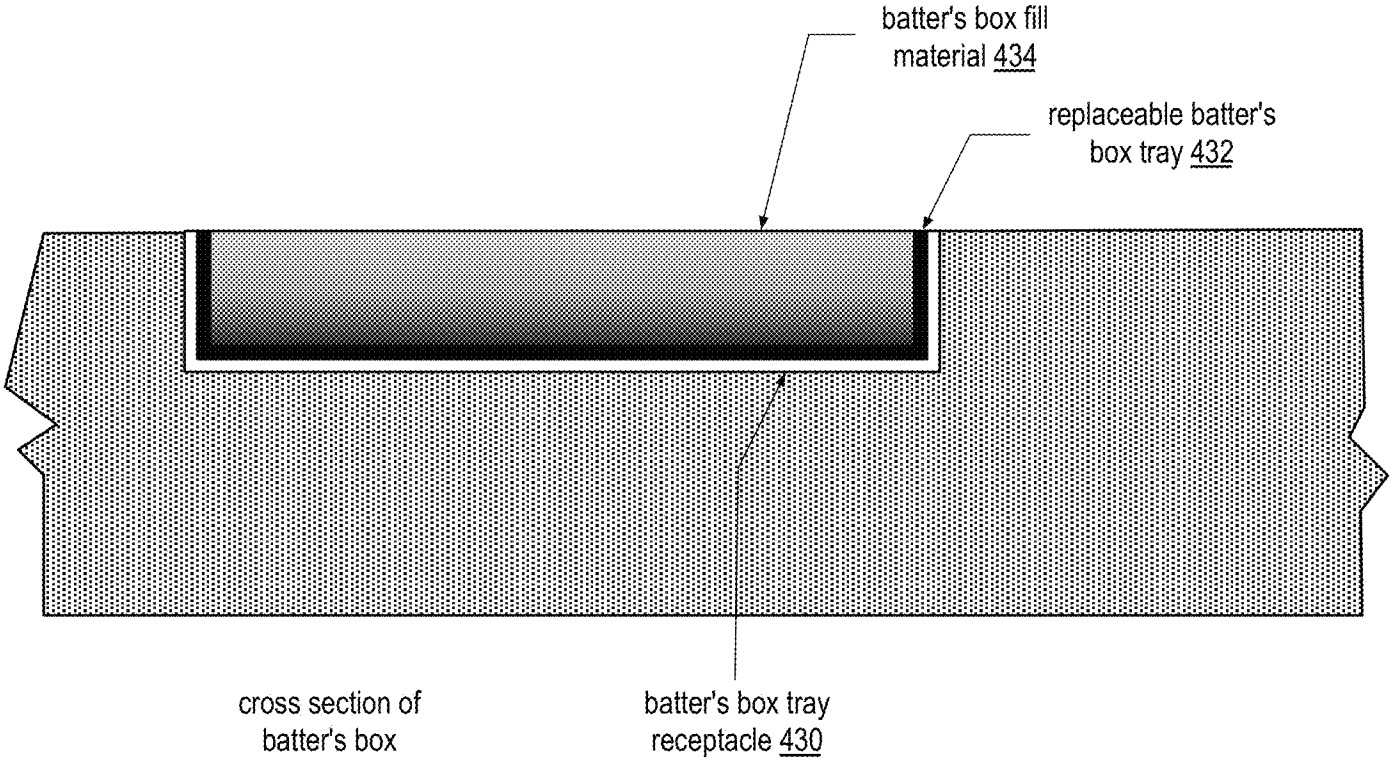
FIG. 121 is a cross sectional side view diagram of an embodiment of a replaceable batter's box in accordance with the present invention.

FIG. 121 is a cross sectional side view diagram of an embodiment of a replaceable batter's box 435 and surrounding home plate area, which includes fill material similar to the batter's box fill material 434. The batter's box 435 includes the receptacle 430, the tray 432, and the batter's box fill material 434. Note that the receptacle 430 may have mounting ledges similar to those shown in FIGS. 47 and/or 48.

In this embodiment, the replaceable batter's box tray 432 and the replaceable batter's box receptacle 430 have a rectangular cross sectional shape (but may have a shape similar to the replaceable drive area and/or replaceable landing area). The inner dimensions of the replaceable batter's box receptacle 430 are of sufficient size to receive the replaceable batter's box tray 432 and, via a pressure fit, securely hold the replaceable batter's box tray 432 in place. The receptacle 430 may include guides, ridges, and/or other aligning mechanisms to align with corresponding guides, ridges, and/or aligning mechanisms of the tray 432. Note that the tray 432 may have a depth of 3 to 6 inches. Further note that, as an alternative to a pressure fit, the replaceable batter's box 435 may include a securing and/or retraction mechanism as previously discussed.

Figure 122:
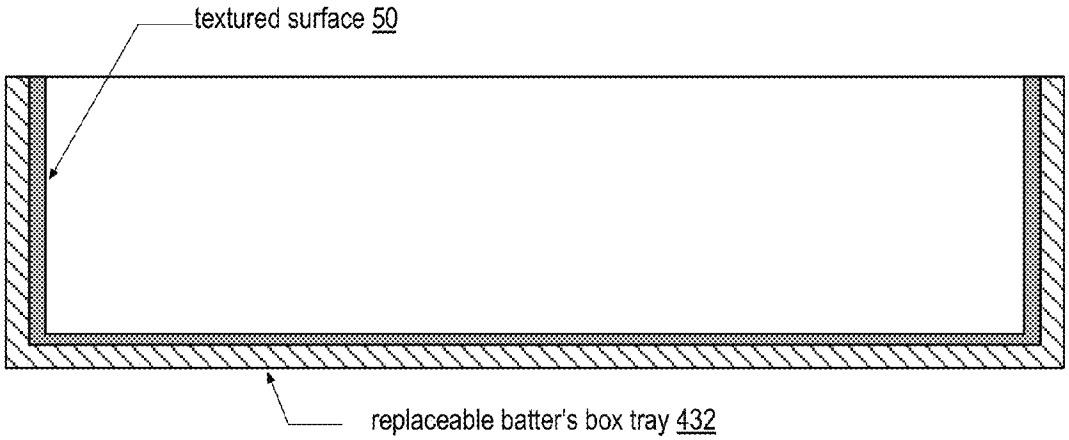
FIG. 122 is a cross sectional side view diagram of an embodiment of a receptacle for a replaceable batter's box in accordance with the present invention.

FIG. 122 is a cross sectional side view diagram of an embodiment of a tray 432 for a replaceable batter's box 435. The tray 432 may be comprised of plastic, wood, fiberglass, rubber, carbon fiber, aluminum, and/or other material that may be shaped into a tray. To reduce shifting of the fill material 434 as a result of the force applied by the batter, the inside walls of the tray 432 may include a textured surface 50 (e.g., a series of bumps, a series of dimples, a rough surface, a varying thickness, an adhesive, etc., and/or a combination thereof). The textured surface 50 may be fabricated into the tray 432 (e.g., molded into tray) or added to the tray (e.g., sprayed on and/or etched off).

Figure 123:
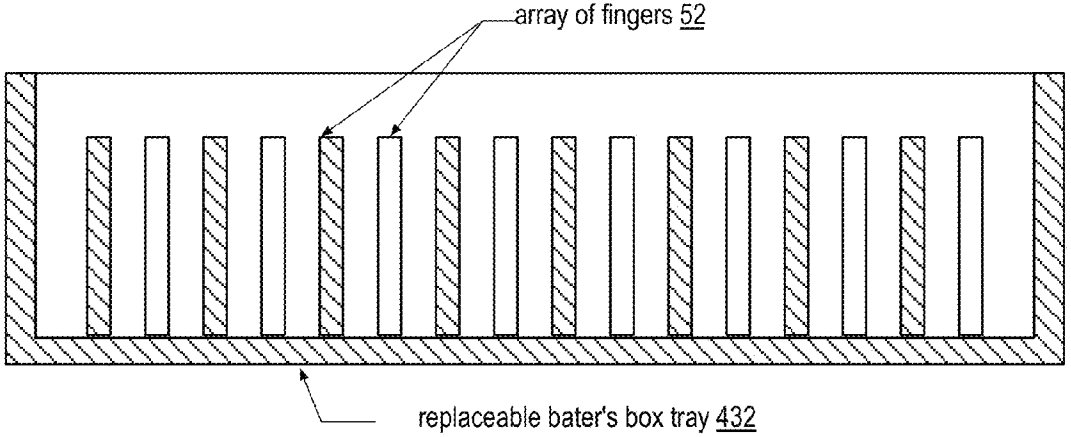
FIG. 123 is a cross sectional side view diagram of another embodiment of a receptacle for a replaceable batter's box in accordance with the present invention.

FIG. 123 is a cross sectional side view diagram of another embodiment of a replaceable batter's box tray 432 that may be comprised of plastic, wood, fiberglass, rubber, carbon fiber, aluminum, and/or other material that may be shaped into a tray. To reduce shifting of the mound fill material 434 as a result of the force applied by the batter, the tray 432 includes an array of fingers 52. The fingers 52 may be of the same material and/or of a different material than that of the tray 432. From finger to finger, the length, width, and shape may vary. For example, one finger is of the same material as the tray, has a length that is 1 inch less than the depth of the tray, has a width of ⅛ inch, and a cylinder shape and a second finger is of a different material, has a length that is 1.5 inches less than the depth of the tray, has width of ¼ inch, and has a cross-sectional star shape. The fingers 52 may fabricated into the tray 432 (e.g., molded into the tray) and/or may be subsequently added to the tray (e.g., secured to the tray).

Figure 124:
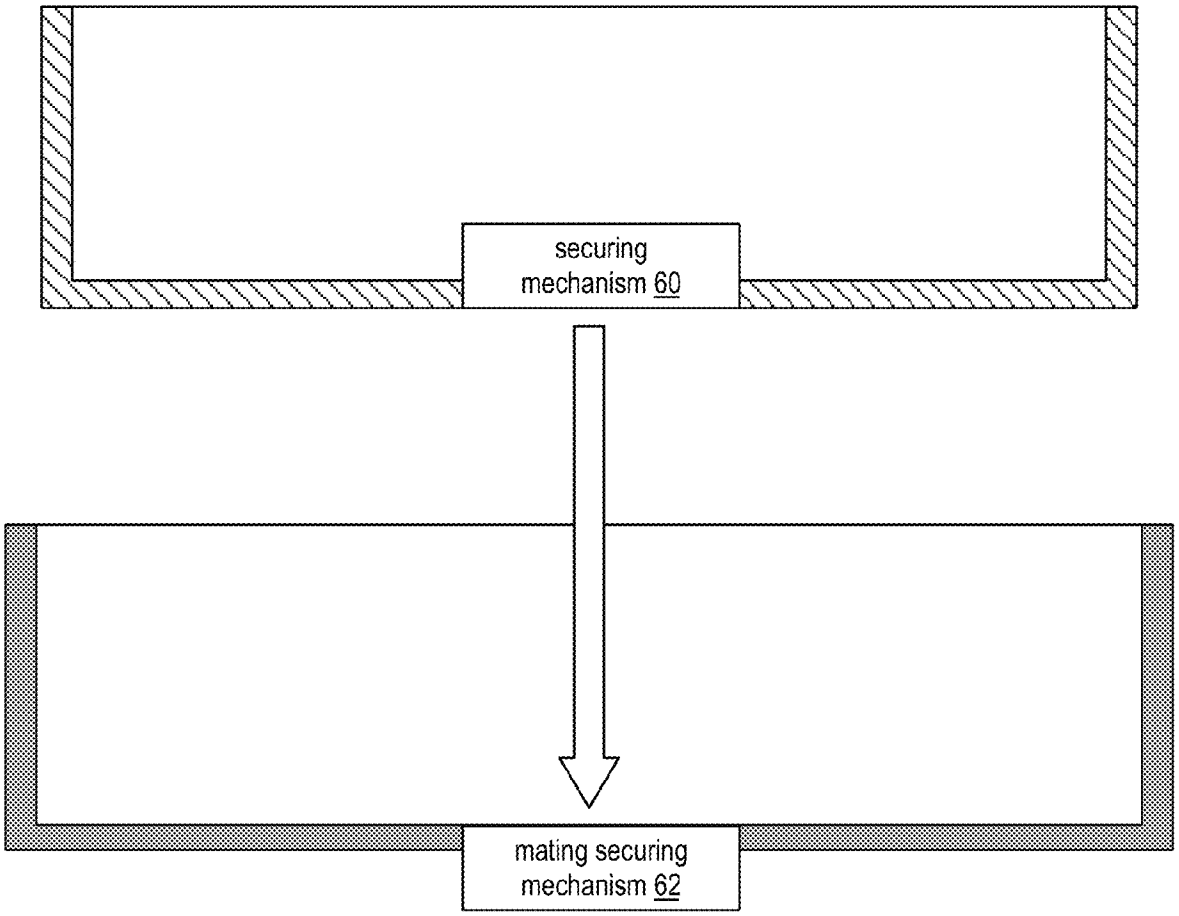
FIG. 124 is a cross sectional side view diagram of an embodiment of securing a replaceable tray to a receptacle of a replaceable batter's box in accordance with the present invention.

FIG. 124 is a cross sectional side view diagram of an embodiment of securing a replaceable batter's box tray 432 to a batter's box receptacle 430. The tray 432 includes a securing mechanism 60 and the receptacle 430 includes a complimentary securing mechanism 62. The securing of the tray 432 to the receptacle 430 may be done in a variety of ways. For example, the securing mechanism 60 includes screws and/or bolts and the complimentary securing mechanism 62 includes nuts, threaded holes, etc., to receive the screws and/or bolts.

In another example, the securing mechanism 60 includes one or more guided clips and the complementary securing mechanism 62 includes a corresponding receptacle for the guided clips. In yet another example, the securing mechanism 60 includes an electromagnetic circuit and the complementary securing mechanism 62 includes a magnetic plate and/or a complementary magnetic circuit. In a further example, the securing mechanism 60 includes a latch and the complementary securing mechanism 62 includes a latch receptacle. Other examples, and/or furtherance of these examples, are discussed with reference to one or more previous figures.

Figure 125:
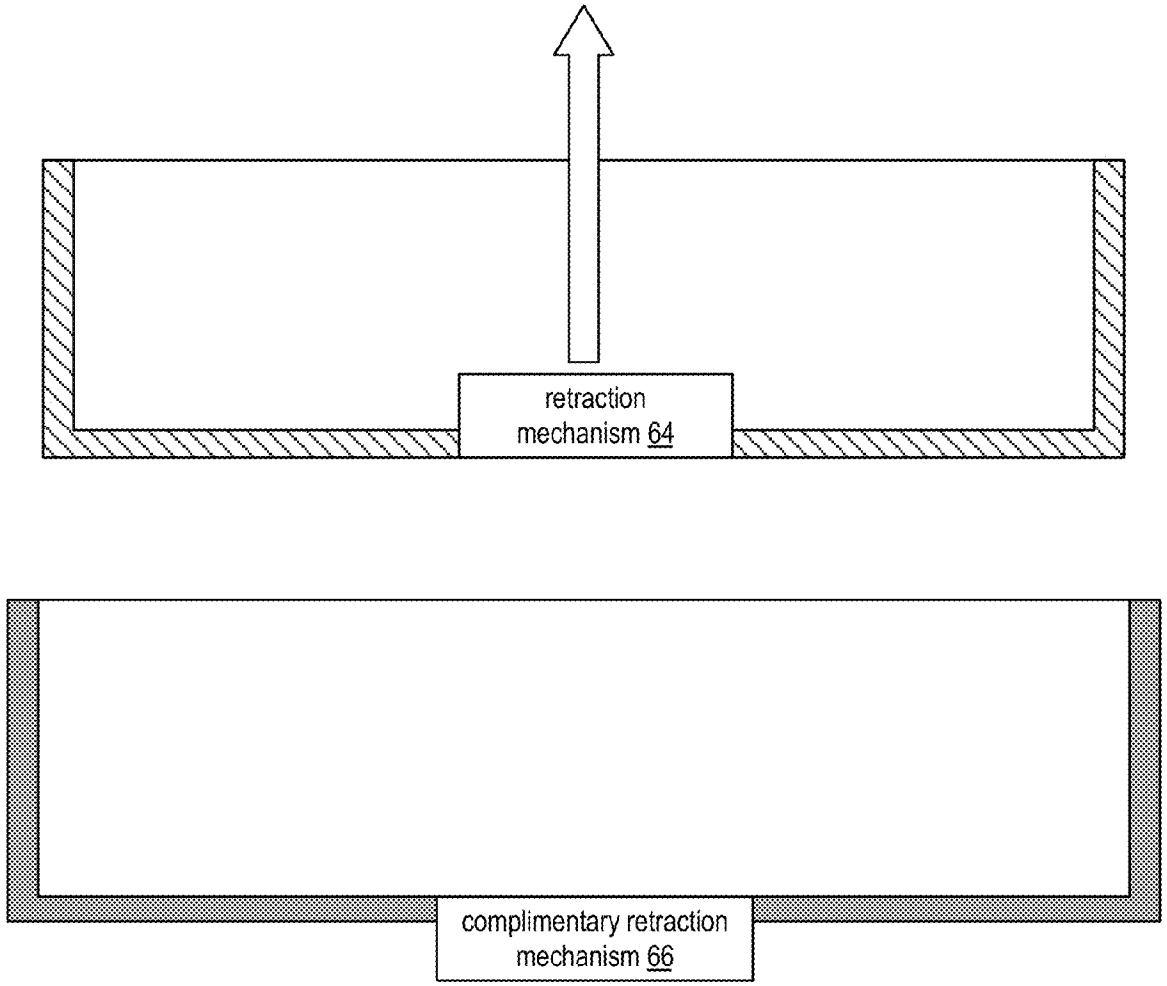
FIG. 125 is a cross sectional side view diagram of an embodiment of retracting a replaceable tray from a receptacle for a replaceable batter's box in accordance with the present invention.

FIG. 125 is a cross sectional side view diagram of an embodiment of retracting a replaceable batter's box tray 432 from a batter's box receptacle 430. The tray 432 includes a retraction mechanism 64 and the receptacle 430 may include a complimentary retraction mechanism 66. The retraction of the tray 432 from the receptacle 430 may be done in a variety of ways. For example, retraction mechanism 64 may be hooks, or other structure, that an extraction tool can grasp to extract the tray 432 from the receptacle 430 or 40. Other examples, and/or furtherance of this example, are discussed with reference to one or more previous figures.

Figure 126:
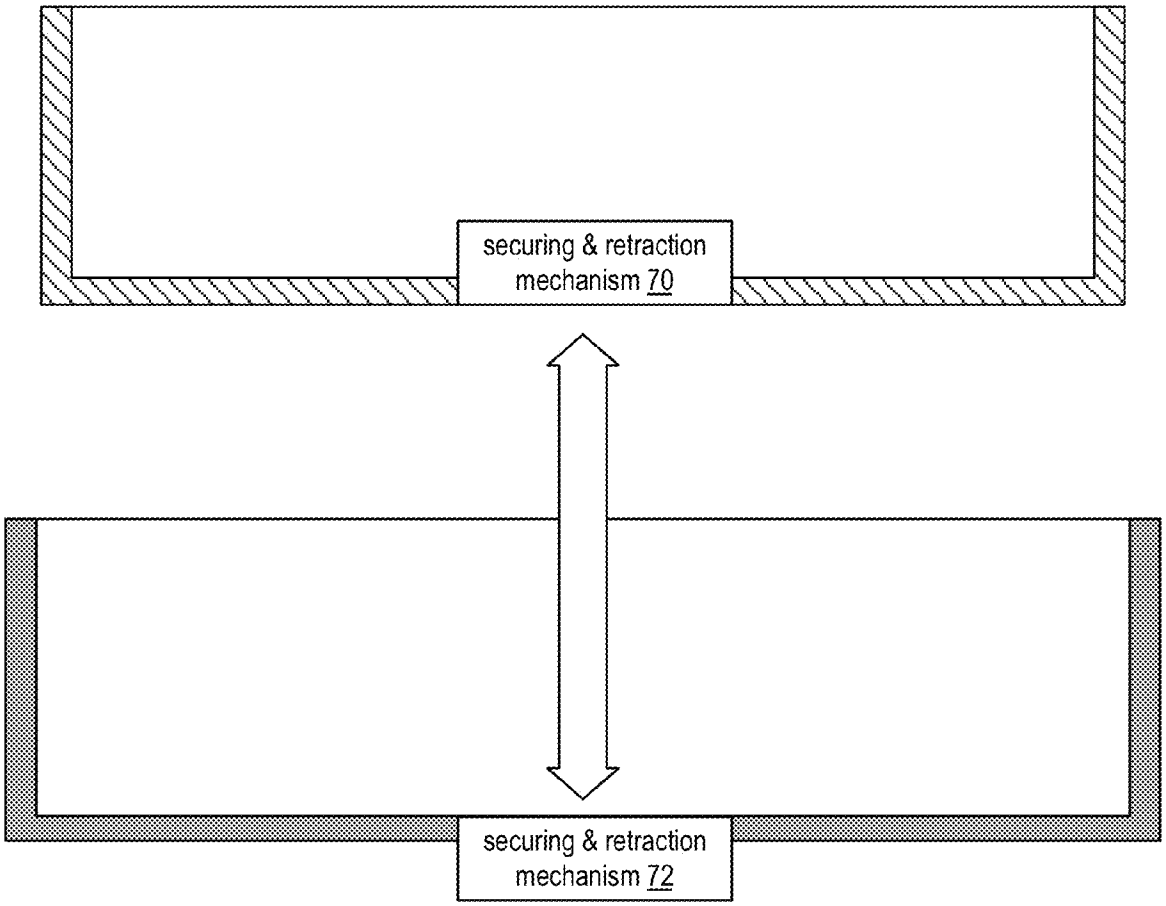
FIG. 126 is a cross sectional side view diagram of an embodiment of securing and retracting a replaceable tray to/from a receptacle for a replaceable batter's box in accordance with the present invention.

FIG. 126 is a cross sectional side view diagram of an embodiment of securing and retracting a replaceable batter's box tray 432 to/from a batter's box receptacle 430. The tray 432 includes a securing and retraction mechanism 70 and the receptacle 430 includes a complimentary securing and retraction mechanism 72. The securing and retraction of the tray 432 to/from the receptacle 430 may be done in a variety of ways as previously discussed.

Figure 127:
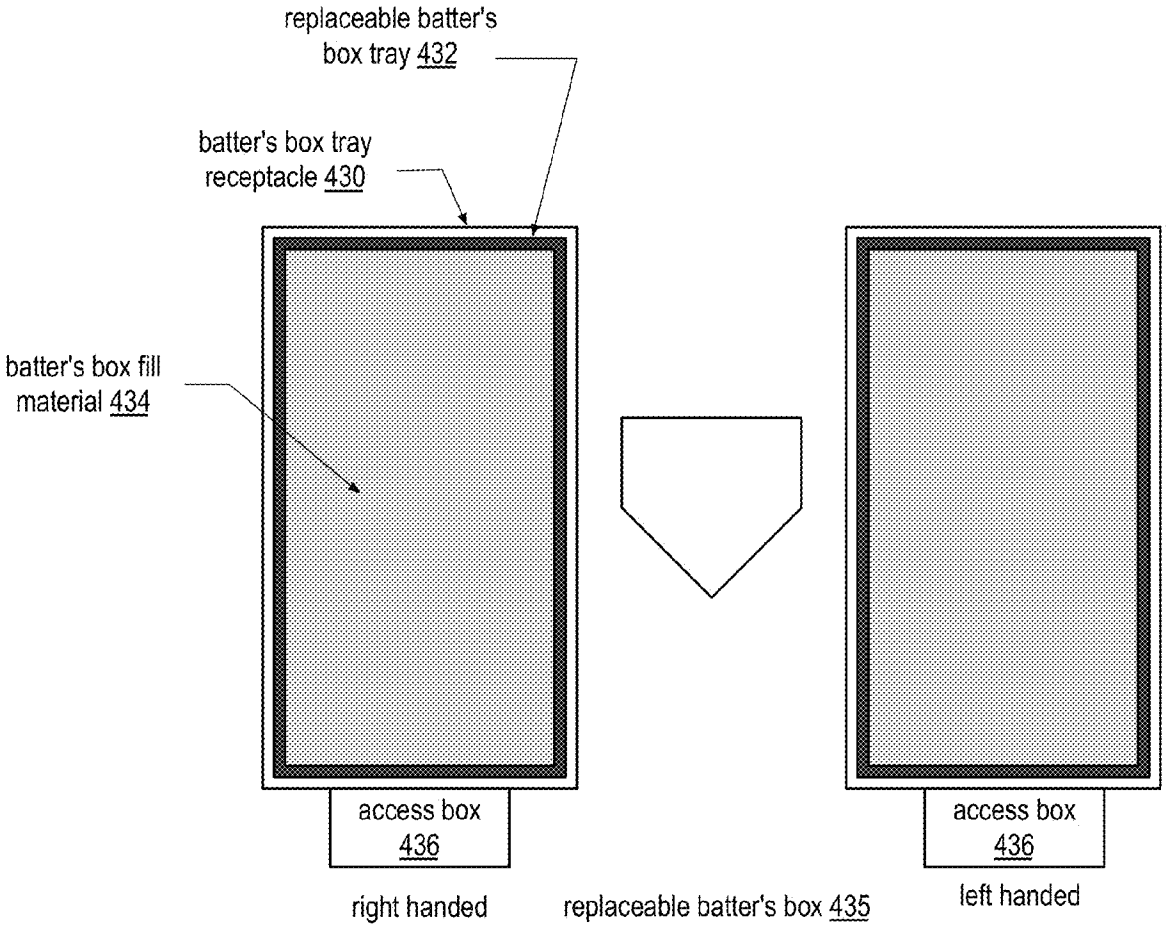
FIG. 127 is a top view diagram of another embodiment of a replaceable batter's box in accordance with the present invention.

FIG. 127 is a top view diagram of another embodiment of a replaceable batter's box 435 that includes a left-handed batter's box and a right-handed batter's box. The left and right-handed batter's boxes are similar and include a batter's box tray receptacle 430, a replaceable batter's box tray 432, batter's box fill material 434, and an access box 436. The access box 436 is similar to implementation and function as access box 100 of the previous figures. Further, the tray 432 and/or the receptacle 430 includes securing and/or retraction mechanisms similar to the trays 32 and/or 42 and the receptacles 30 and/or 40 of the previous figures for securing and/or retracting the trays 432 to/from the receptacles 430.

As an alternative to the access boxes 436, home plate may be a structure similar to the pitching rubber 102 that includes a base and a lid. Within the base, home plate may include securing mechanism and/or retraction mechanism lever and/or triggering mechanisms as previously discussed. Corresponding, the receptacle 430 and tray 432 includes securing mechanism and/or retraction mechanism.

As may be used herein, the terms "substantially" and "approximately" provides an industry-accepted tolerance for its corresponding term and/or relativity between items. Such an industry-accepted tolerance ranges from less than one percent to fifty percent and corresponds to, but is not limited to, component values, integrated circuit process variations, temperature variations, rise and fall times, and/or thermal noise. Such relativity between items ranges from a difference of a few percent to magnitude differences. As may also be used herein, the term(s) "operably coupled to", "coupled to", and/or "coupling" includes direct coupling between items and/or indirect coupling between items via an intervening item (e.g., an item includes, but is not limited to, a component, an element, a circuit, and/or a module) where, for indirect coupling, the intervening item does not modify the information of a signal but may adjust its current level, voltage level, and/or power level. As may further be used herein, inferred coupling (i.e., where one element is coupled to another element by inference) includes direct and indirect coupling between two items in the same manner as "coupled to". As may even further be used herein, the term "operable to" or "operably coupled to" indicates that an item includes one or more of power connections, input(s), output(s), etc., to perform, when activated, one or more its corresponding functions and may further include inferred coupling to one or more other items. As may still further be used herein, the term "associated with", includes direct and/or indirect coupling of separate items and/or one item being embedded within another item. As may be used herein, the term "compares favorably", indicates that a comparison between two or more items, signals, etc., provides a desired relationship. For example, when the desired relationship is that signal 1 has a greater magnitude than signal 2, a favorable comparison may be achieved when the magnitude of signal 1 is greater than that of signal 2 or when the magnitude of signal 2 is less than that of signal 1.

As may also be used herein, the terms "processing module", "processing circuit", and/or "processing unit" may be a single processing device or a plurality of processing devices. Such a processing device may be a microprocessor, microcontroller, digital signal processor, microcomputer, central processing unit, field programmable gate array, programmable logic device, state machine, logic circuitry, analog circuitry, digital circuitry, and/or any device that manipulates signals (analog and/or digital) based on hard coding of the circuitry and/or operational instructions. The processing module, module, processing circuit, and/or processing unit may be, or further include, memory and/or an integrated memory element, which may be a single memory device, a plurality of memory devices, and/or embedded circuitry of another processing module, module, processing circuit, and/or processing unit. Such a memory device may be a read-only memory, random access memory, volatile memory, non-volatile memory, static memory, dynamic memory, flash memory, cache memory, and/or any device that stores digital information. Note that if the processing module, module, processing circuit, and/or processing unit includes more than one processing device, the processing devices may be centrally located (e.g., directly coupled together via a wired and/or wireless bus structure) or may be distributedly located (e.g., cloud computing via indirect coupling via a local area network and/or a wide area network). Further note that if the processing module, module, processing circuit, and/or processing unit implements one or more of its functions via a state machine, analog circuitry, digital circuitry, and/or logic circuitry, the memory and/or memory element storing the corresponding operational instructions may be embedded within, or external to, the circuitry comprising the state machine, analog circuitry, digital circuitry, and/or logic circuitry. Still further note that, the memory element may store, and the processing module, module, processing circuit, and/or processing unit executes, hard coded and/or operational instructions corresponding to at least some of the steps and/or functions illustrated in one or more of the Figures. Such a memory device or memory element can be included in an article of manufacture.

The present invention has been described above with the aid of method steps illustrating the performance of specified functions and relationships thereof. The boundaries and sequence of these functional building blocks and method steps have been arbitrarily defined herein for convenience of description. Alternate boundaries and sequences can be defined so long as the specified functions and relationships are appropriately performed. Any such alternate boundaries or sequences are thus within the scope and spirit of the claimed invention. Further, the boundaries of these functional building blocks have been arbitrarily defined for convenience of description. Alternate boundaries could be defined as long as the certain significant functions are appropriately performed. Similarly, flow diagram blocks may also have been arbitrarily defined herein to illustrate certain significant functionality. To the extent used, the flow diagram block boundaries and sequence could have been defined otherwise and still perform the certain significant functionality. Such alternate definitions of both functional building blocks and flow diagram blocks and sequences are thus within the scope and spirit of the claimed invention. One of average skill in the art will also recognize that the functional building blocks, and other illustrative blocks, modules and components herein, can be implemented as illustrated or by discrete components, application specific integrated circuits, processors executing appropriate software and the like or any combination thereof.

The present invention may have also been described, at least in part, in terms of one or more embodiments. An embodiment of the present invention is used herein to illustrate the present invention, an aspect thereof, a feature thereof, a concept thereof, and/or an example thereof. A physical embodiment of an apparatus, an article of manufacture, a machine, and/or of a process that embodies the present invention may include one or more of the aspects, features, concepts, examples, etc., described with reference to one or more of the embodiments discussed herein. Further, from figure to figure, the embodiments may incorporate the same or similarly named functions, steps, modules, etc., that may use the same or different reference numbers and, as such, the functions, steps, modules, etc., may be the same or similar functions, steps, modules, etc., or different ones.

In one or more embodiments, dimensions may be included to provide context to the size and/or shape of an element of the embodiment. Such dimensions are included for example purposes and are not considered to be a limitation of the invention. In particular, the dimensions provided may be altered by several factors and still be within the scope of the invention.

Unless specifically stated to the contra, signals to, from, and/or between elements in a figure of any of the figures presented herein may be analog or digital, continuous time or discrete time, and single-ended or differential. For instance, if a signal path is shown as a single-ended path, it also represents a differential signal path. Similarly, if a signal path is shown as a differential path, it also represents a single-ended signal path. While one or more particular architectures are described herein, other architectures can likewise be implemented that use one or more data buses not expressly shown, direct connectivity between elements, and/or indirect coupling between other elements as recognized by one of average skill in the art.

The term "module" is used in the description of the various embodiments of the present invention. A module includes a processing module, a functional block, hardware, and/or software stored on memory for performing one or more functions as may be described herein. Note that, if the module is implemented via hardware, the hardware may operate independently and/or in conjunction software and/or firmware. As used herein, a module may contain one or more sub-modules, each of which may be one or more modules.

While particular combinations of various functions and features of the present invention have been expressly described herein, other combinations of these features and functions are likewise possible. The present invention is not limited by the particular examples disclosed herein and expressly incorporates these other combinations.

What is claimed is:

1. A portable pitching mound comprises:

a drive tray that includes a pitching rubber area and a drive reservoir for being filled with a pitching mound material;

a landing tray that includes a drive reservoir for being filled with the pitching mound material;

a level section;

a sloped section; and a base structure that mechanically couples to the level section and the sloped section, wherein, when mechanically coupled to the base structure, the level section and the sloped section create a drive tray receptacle area and a landing tray receptacle area, wherein the drive tray fits within the drive tray receptacle area and wherein the landing trays fits within the landing tray receptacle area.

2. The portable pitching mound of claim 1 further comprises:

the sloped section having an upper sloped section that encircles a first portion of the drive tray and a lower sloped section that encircles to a first portion of the landing tray; and a front section coupled to the sloped section, wherein the front section encircles a second portion of the landing tray.

3. The portable pitching mound of claim 2, wherein the level section comprises:

a section that encircles a second portion of the drive tray.

4. The portable pitching mound of claim 1, wherein the base structure comprises:

a support area for supporting the drive tray; and one or more open areas in the support area to facilitate installation and retraction of the drive tray.

5. The portable pitching mound of claim 1, wherein the pitching mound material comprises one or more of:

dirt;

clay;

sand;

gravel;

rubber;

a composite material; and a moisture absorbent material.

6. The portable pitching mound of claim 1 further comprises:

the drive tray having a level depth within the drive reservoir from the pitching rubber area to six inches in front of the pitching rubber area and then a one-inch-per-one-foot slope depth to a front edge of the drive reservoir; and the landing tray having a constant depth within the drive reservoir, wherein the landing tray has the one-inch-per-one-foot slope from a back edge of the landing tray to a front edge of the landing tray.

7. The portable pitching mound of claim 1 further comprises:

when mechanically coupled to the base structure, a top surface of the level section is ten inches above a bottom of the base structure and wherein a top surface of the sloped section at front edge of the sloped section is the inches above a bottom of the base structure with a decreasing height at a slope of one-inch-per-one-foot.

* * * * *